US009624918B2

(12) United States Patent
Goertzen et al.

(10) Patent No.: US 9,624,918 B2
(45) Date of Patent: Apr. 18, 2017

(54) PUMPING DEVICE

(71) Applicant: Invacare Corporation, Elyria, OH (US)

(72) Inventors: Gerold Goertzen, Homerville, OH (US); William A. Null, Jr., Sullivan, OH (US)

(73) Assignee: Invacare Corporation, Elyria, OH (US)

( * ) Notice: Subject to any disclaimer, the term of this patent is extended or adjusted under 35 U.S.C. 154(b) by 98 days.

(21) Appl. No.: 13/758,242

(22) Filed: Feb. 4, 2013

(65) Prior Publication Data

US 2013/0209297 A1 Aug. 15, 2013

Related U.S. Application Data

(60) Provisional application No. 61/594,746, filed on Feb. 3, 2012.

(51) Int. Cl.

| | |
|---|---|
| ***F04D 25/00*** | (2006.01) |
| ***F04B 25/00*** | (2006.01) |
| ***F04B 1/00*** | (2006.01) |
| ***F04B 27/04*** | (2006.01) |
| ***F04B 53/00*** | (2006.01) |

(52) U.S. Cl.
CPC ..... *F04B 25/00* (2013.01); *F04B 1/00* (2013.01); *F04B 27/0451* (2013.01); *F04B 53/006* (2013.01)

(58) Field of Classification Search
CPC ..... F04B 25/00; F04B 27/0451; F04B 53/006
USPC ..... 417/273, 569, 570, 313
See application file for complete search history.

(56) References Cited

U.S. PATENT DOCUMENTS

| | | | | |
|---|---|---|---|---|
| 875,297 | A | 12/1907 | Stanley | |
| 1,261,061 | A | 4/1918 | Seymour | |
| 1,494,741 | A | 5/1924 | Hale | |
| 1,528,086 | A * | 3/1925 | Scovel, Jr. | 417/504 |
| 1,610,869 | A | 12/1926 | Loranger et al. | |
| 1,697,181 | A | 1/1929 | Gurley | |
| 1,746,394 | A | 2/1930 | Guild | |
| 1,764,655 | A | 6/1930 | Spreen | |
| 1,787,643 | A | 1/1931 | Schaer | |

(Continued)

FOREIGN PATENT DOCUMENTS

| | | |
|---|---|---|
| CA | 2228779 | 8/1998 |
| CN | 2351587 | 2/1999 |

(Continued)

OTHER PUBLICATIONS

Final Office action from Control No. 90/008,167 dated Mar. 17, 2008.

(Continued)

*Primary Examiner* — Devon Kramer
*Assistant Examiner* — Kenneth J Hansen
(74) *Attorney, Agent, or Firm* — Calfee, Halter & Griswold LLP

(57) ABSTRACT

A pumping device compresses fluid, provides a vacuum, or both compresses fluid and provides a vacuum. A pumping device may be used to force gas through a sieve bed, draw gas out of a sieve bed, or both force gas through a sieve bed and drawing gas out of a sieve bed. A pumping device may be operated at high speed to provide a high fluid flow rate with a small pumping device.

7 Claims, 55 Drawing Sheets

(56) References Cited

U.S. PATENT DOCUMENTS 1,846,655 A 2/1932 Rayfield
1,873,878 A 8/1932 Goldsborough
1,900,858 A 3/1933 Bruckner
1,910,636 A 5/1933 Pownall
1,936,167 A 11/1933 Kniskern
1,964,679 A 6/1934 Springfield
2,030,759 A 2/1936 Neal
2,057,158 A 10/1936 Moffitt
2,141,057 A 12/1938 Whiles
2,151,825 A 3/1939 Aikman
2,312,335 A 3/1943 Halleck
2,373,780 A 4/1945 Ricardo
2,427,638 A 9/1947 Vilter et al.
2,550,369 A 4/1951 Moreillon
2,572,711 A 10/1951 Fischer
2,628,015 A 2/1953 Neugebauer et al.
2,650,018 A 8/1953 Paget
2,944,627 A 7/1960 Skarstrom
2,956,738 A 10/1960 Rosenchold et al.
3,072,317 A 1/1963 Esper
3,119,410 A 1/1964 Noecker
3,149,778 A 9/1964 Fromm
3,203,357 A 8/1965 Delorme
3,208,288 A 9/1965 Cohen
3,216,648 A 11/1965 Ford
3,313,091 A 4/1967 Berlin
3,448,664 A 6/1969 Hulsing
3,510,233 A 5/1970 Habegger et al.
3,692,434 A 9/1972 Schnear
3,838,948 A 10/1974 McCorvey
3,839,946 A 10/1974 Paget
3,898,047 A 8/1975 Cramer
3,924,968 A 12/1975 Gaines et al.
3,964,866 A 6/1976 Shelby
4,013,429 A 3/1977 Sircar et al.
4,186,656 A 2/1980 Weber
4,194,890 A 3/1980 McCombs et al.
4,222,750 A 9/1980 Gauthier et al.
4,253,524 A 3/1981 Erickson
4,263,018 A 4/1981 McCombs et al.
4,331,455 A 5/1982 Sato
4,334,833 A 6/1982 Gozzi
4,349,357 A 9/1982 Russell
4,353,682 A 10/1982 Linnert et al.
4,381,179 A 4/1983 Pareja
4,428,372 A 1/1984 Beysel et al.
4,449,990 A * 5/1984 Tedford, Jr. ..... 95/26
4,456,440 A 6/1984 Korner
4,465,436 A 8/1984 Schonwald
4,505,333 A 3/1985 Ricks, Sr.
4,516,424 A 5/1985 Rowland
4,573,886 A 3/1986 Maasberg et al.
4,576,616 A 3/1986 Mottram et al.
4,599,049 A 7/1986 Gordon et al.
4,610,700 A 9/1986 Miller
4,627,860 A 12/1986 Rowland
4,636,226 A 1/1987 Canfora
4,638,694 A 1/1987 Slee
4,643,651 A 2/1987 Couillard
4,645,428 A 2/1987 Arregui et al.
4,670,223 A 6/1987 Delachapelle
4,673,415 A 6/1987 Stanford
4,698,075 A 10/1987 Dechene
4,700,663 A 10/1987 Dunn
4,706,664 A 11/1987 Snook et al.
4,765,804 A 8/1988 Lloyd-Williams et al.
4,844,059 A 7/1989 Koch
4,860,803 A 8/1989 Wells
4,867,766 A 9/1989 Campbell et al.
4,869,733 A 9/1989 Stanford
4,880,443 A 11/1989 Miller et al.
4,905,685 A 3/1990 Olsson et al.
4,922,900 A 5/1990 Kiske et al.
4,948,391 A 8/1990 Noguchi
4,957,107 A 9/1990 Sipin
4,974,554 A 12/1990 Emery
4,979,882 A 12/1990 Wipf
4,983,190 A 1/1991 Verrando et al.
4,991,616 A 2/1991 Fabregat
5,020,974 A 6/1991 Searle
5,033,940 A 7/1991 Baumann
5,049,039 A 9/1991 Knoth et al.
5,071,453 A 12/1991 Hradek et al.
5,078,580 A 1/1992 Miller et al.
5,078,757 A 1/1992 Rottner et al.
5,099,748 A 3/1992 Neubauer
5,144,945 A 9/1992 Nishino et al.
5,154,737 A 10/1992 Jenkins et al.
5,163,818 A 11/1992 Betsill et al.
5,163,978 A 11/1992 Leavitt et al.
5,195,874 A 3/1993 Odagiri
5,199,423 A 4/1993 Harral et al.
5,207,806 A 5/1993 Lagree et al.
5,237,987 A 8/1993 Anderson et al.
5,248,320 A 9/1993 Garrett et al.
5,314,314 A 5/1994 Hinkle
5,326,231 A 7/1994 Pandeya et al.
5,354,361 A 10/1994 Coffield
5,405,249 A 4/1995 Benson
5,474,595 A 12/1995 McCombs
5,490,871 A 2/1996 Coates et al.
5,531,807 A 7/1996 McCombs
5,584,669 A 12/1996 Becker
5,593,291 A 1/1997 Lynn
5,593,478 A 1/1997 Hill et al.
5,613,837 A 3/1997 Konishi et al.
5,704,964 A 1/1998 Kaneko et al.
5,709,536 A 1/1998 Renfro et al.
5,730,778 A 3/1998 Hill et al.
5,755,561 A 5/1998 Couillard et al.
5,823,186 A 10/1998 Rossen et al.
5,858,062 A 1/1999 McCulloh et al.
5,863,186 A 1/1999 Green et al.
5,875,783 A 3/1999 Kullik
5,893,275 A 4/1999 Henry
5,893,944 A 4/1999 Dong
5,897,305 A 4/1999 Roddis
5,906,672 A 5/1999 Michaels et al.
5,917,135 A 6/1999 Michaels et al.
5,988,165 A 11/1999 Richey, II et al.
6,024,542 A 2/2000 Phillips et al.
6,132,177 A 10/2000 Loprete et al.
6,183,211 B1 2/2001 Wood
6,203,285 B1 3/2001 Wagner et al.
6,287,085 B1 9/2001 Goettel et al.
6,302,107 B1 10/2001 Richey, II et al.
6,352,057 B1 3/2002 Drecq
6,393,802 B1 5/2002 Bowser et al.
6,422,237 B1 7/2002 Engel et al.
6,478,857 B2 11/2002 Czabala
6,508,638 B2 1/2003 Sagar
6,547,534 B1 4/2003 Sakamoto et al.
6,651,658 B1 11/2003 Hill et al.
6,666,656 B2 12/2003 Pressel
6,684,755 B2 2/2004 Boyd et al.
6,688,854 B2 2/2004 Sakamoto et al.
6,695,591 B2 2/2004 Grimmer et al.
6,776,587 B2 8/2004 Meyer et al.
6,805,122 B2 10/2004 Richey et al.
6,823,891 B2 11/2004 Schulze et al.
6,889,726 B2 5/2005 Richey, II et al.
6,923,180 B2 8/2005 Richey, II et al.
7,178,552 B2 2/2007 Takeda
7,204,249 B1 4/2007 Richey, II et al.
7,244,107 B2 7/2007 Cheng
7,294,170 B2 11/2007 Richey, II et al.
7,296,591 B2 11/2007 Moe et al.
7,459,008 B2 12/2008 Aylsworth et al.
8,062,003 B2 11/2011 Goertzen et al.
8,123,497 B2 2/2012 Richey, II et al.
2002/0014237 A1 2/2002 Richey, II
2004/0103895 A1 6/2004 Richey, II et al.
2005/0047904 A1 3/2005 Rival
2006/0000474 A1 1/2006 Richey, II et al.

(56) References Cited

U.S. PATENT DOCUMENTS

| | | | | |
|---|---|---|---|---|
| 2007/0065301 | A1 | 3/2007 | Goertzen et al. | |
| 2007/0214960 | A1 | 9/2007 | Aylsworth et al. | |
| 2008/0118373 | A1 | 5/2008 | Richey, II | |
| 2008/0213114 | A1 | 9/2008 | Miller | |
| 2008/0314355 | A1 | 12/2008 | Harju | |
| 2009/0047159 | A1 | 2/2009 | Inoue | |
| 2009/0277196 | A1* | 11/2009 | Gambiana et al. | 62/115 |
| 2010/0236648 | A1* | 9/2010 | Cheng | F04B 25/00 137/565.13 |
| 2011/0038740 | A1 | 2/2011 | Goertzen et al. | |
| 2011/0158825 | A1* | 6/2011 | Speir | 417/53 |

FOREIGN PATENT DOCUMENTS

| | | | |
|---|---|---|---|
| CN | 101307754 | A | 11/2008 |
| CN | 100439705 | | 12/2008 |
| CN | 201190646 | | 2/2009 |
| CN | 101678907 | A | 3/2010 |
| CN | 101970291 | A | 2/2011 |
| DE | 1403963 | | 11/1968 |
| DE | 4317091 | | 11/1994 |
| EP | 64177 | | 11/1984 |
| EP | 239713 | | 10/1987 |
| EP | 860647 | | 8/1998 |
| EP | 1334741 | | 8/2003 |
| EP | 1447569 | A1 | 8/2004 |
| GB | 374540 | | 6/1932 |
| GB | 581476 | | 10/1946 |
| GB | 1508318 | | 4/1978 |
| JP | 63307101 | | 12/1988 |
| JP | 64028208 | | 1/1989 |
| JP | 11-257222 | | 9/1999 |
| WO | 83/03983 | | 1/1983 |
| WO | 87/01599 | | 3/1987 |
| WO | 98/15735 | A1 | 4/1998 |
| WO | 99/16259 | | 4/1999 |
| WO | 00/60216 | | 10/2000 |
| WO | 02/34368 | | 5/2002 |
| WO | 03/024569 | | 3/2003 |
| WO | 2007/038065 | | 4/2007 |
| WO | 2009/034421 | | 3/2009 |
| WO | 2009/112478 | A1 | 9/2009 |

OTHER PUBLICATIONS

Response from Control No. 90/008,167 dated May 14, 2008.
Office action from U.S. Appl. No. 11/938,551 dated Apr. 29, 2011.
Response to Office Action from U.S. Appl. No. 11/938,551 dated Sep. 29, 2011.
Notice of Allowance from U.S. Appl. No. 11/938,551 dated Nov. 16, 2011.
Non-Final Office Action in U.S. Appl. No. 12/857,844 dated Feb. 8, 2013.
Examination Report No. 1 in AU Appl. 2010284357 dated Apr. 17, 2013.
Office action from Canadian application No. 2,426,685 date Mar. 9, 2010.
Communication from EP Application No. 06825006.7 dated Jan. 21, 2010.
Response to Communication from EP Application No. 06825006.7 dated May 20, 2010.
Communication from EP Application No. 06825006.7 dated Mar. 7, 2012.
First Examination Report for New Zealand Application No. 598,141 dated Oct. 29, 2012.
RIX Industries, "RIX SA Air Compressors—Oil-Free Breathing Air to 4,500 PSIG", 2 pgs, undated.
International Search Report and Written Opinion from PCT/US06/36398 dated May 11, 2007.
International Search Report from PCT/US02/29164 dated Dec. 13, 2002.
International Search Report and Written Opinion from PCT/US01/45433 dated Apr. 18, 2002.
International Preliminary Examination Report from PCT/US01/45433 dated Sep. 11, 2002.
International Search Report from PCT/US98/19282 dated May 10, 1999.
International Search Report from PCT/US10/45705 dated Oct. 5, 2010.
International Search Report from PCT/US2012/039132 dated Aug. 3, 2012.
International Search Report from PCT/US2013/24591 dated Apr. 12, 2013.
Request for Ex Parte Reexamination Transmittal Form (2 pgs.), Request for Reexamination (26 pgs.) and Certificate of Mailing (2 pgs.), Information Disclosure Statement (2 pgs) submitted to U.S. Patent Office on Aug. 16, 2006 for reexamination of U.S. Pat. No. 5,988,165 Control No. 90/008167.
Office action from U.S. Appl. No. 08/942,063, mailed Oct. 30, 1998.
Supplemental Amendment from U.S. Appl. No. 08/942,063 dated May 12, 1999.
Amendment A from U.S. Appl. No. 08/942,063 dated Feb. 23, 1999.
Notice of Allowance from U.S. Appl. No. 08/942,063, mailed Jul. 14, 1999.
Office action from U.S. Appl. No. 09/154,442, mailed Sep. 8, 2000.
Amendment from U.S. Appl. No. 09/154,442 dated Dec. 7, 2000.
Interview Summary from U.S. Appl. No. 09/154,442, mailed Jan. 24, 2001.
Notice of Allowance from U.S. Appl. No. 09/154,442, mailed Apr. 25, 2001.
Notice of Allowance from U.S. Appl. No. 09/154,442, mailed Jul. 17, 2001.
Office action from U.S. Appl. No. 09/952,763, mailed Jan. 29, 2003.
Amendment from U.S. Appl. No. 09/952,763 dated Apr. 24, 2003.
Notice of Allowance from U.S. Appl. No. 09/952,763, mailed Jul. 8, 2003.
Office action from U.S. Appl. No. 10/605,754, mailed May 17, 2004.
Response from U.S. Appl. No. 10/605,754 dated Oct. 20, 2004.
Office action from U.S. Appl. No. 10/605,754, mailed Nov. 15, 2004.
Interview Summary from U.S. Appl. No. 10/605,754 dated Feb. 2, 2005.
Response from U.S. Appl. No. 10/605,754 dated Mar. 14, 2005.
Notice of Allowance from U.S. Appl. No. 10/605,754, mailed Apr. 5, 2005.
Office action from U.S. Appl. No. 09/695,612, mailed May 7, 2003.
Response from U.S. Appl. No. 09/695,612 dated Nov. 7, 2003.
Office action from U.S. Appl. No. 09/695,612, mailed Feb. 6, 2004.
Response from U.S. Appl. No. 09/695,612 dated Jul. 9, 2004.
Office action from U.S. Appl. No. 09/695,612, mailed Sep. 30, 2004.
Response from U.S. Appl. No. 09/695,612 dated Feb. 2, 2005.
Office action from U.S. Appl. No. 09/695,612, mailed Mar. 22, 2005.
Response from U.S. Appl. No. 09/695,612 dated Sep. 14, 2005.
Office action from U.S. Appl. No. 09/695,612, mailed Oct. 19, 2005.
Response from U.S. Appl. No. 09/965,612 dated Dec. 8, 2005.
Office action from U.S. Appl. No. 09/695,612, mailed Jan. 25, 2006.
Response from U.S. Appl. No. 09/695,612 dated Mar. 6, 2006.
Office action from U.S. Appl. No. 09/695,612, mailed Mar. 29, 2006.
Response from U.S. Appl. No. 09/695,612 dated Jun. 5, 2006.
Notice of Allowance from U.S. Appl. No. 09/695,612, mailed Jun. 26, 2006.
Office action from U.S. Appl. No. 11/180,395, mailed Jun. 19, 2006.
Response from U.S. Appl. No. 11/180,395 dated Sep. 21, 2006.
Supplemental Response from U.S. Appl. No. 11/180,395 dated Oct. 18, 2006.
Office action from U.S. Appl. No. 11/180,395, mailed Dec. 1, 2006.
Response from U.S. Appl. No. 11/180,395 dated Jun. 1, 2007.
Notice of Allowance from U.S. Appl. No. 11/180,395, mailed Jun. 19, 2007.

(56) References Cited

OTHER PUBLICATIONS

Supplemental Notice of Allowability from U.S. Appl. No. 11/180,395, mailed Aug. 17, 2007.
Office action from U.S. Appl. No. 11/231,603 dated Feb. 8, 2008.
Response from U.S. Appl. No. 11/231,603 dated May 8, 2008.
Office action from U.S. Appl. No. 11/231,603 dated Aug. 11, 2008.
Response from U.S. Appl. No. 11/231,603 dated Nov. 11, 2008.
Advisory Action from U.S. Appl. No. 11/231,603 dated Dec. 4, 2008.
Amendment from U.S. Appl. No. 11/231,603 dated Feb. 10, 2009.
Office action from U.S. Appl. No. 11/231,603 dated May 1, 2009.
Response from U.S. Appl. No. 11/231,603 dated Jul. 30, 2009.
Office action from U.S. Appl. No. 11/231,603 dated Oct. 27, 2009.
Response from U.S. Appl. No. 11/231,603 dated Dec. 23, 2009.
Advisory Action from U.S. Appl. No. 11/231,603 dated Jan. 12, 2010.
Response from U.S. Appl. No. 11/231,603 dated Apr. 27, 2010.
Office action from U.S. Appl. No. 11/231,603 dated Aug. 3, 2010.
Response from U.S. Appl. No. 11/231,603 dated Feb. 1, 2011.
Office action from U.S. Appl. No. 11/231,603 dated Apr. 18, 2011.
Response from U.S. Appl. No. 11/231,603 dated Jun. 16, 2011.
Notice of Allowance from U.S. Appl. No. 11/231,603 dated Jul. 11, 2011.
Response to Interview Summary and Comments on Reasons for Allowance from U.S. Appl. No. 11/231,603 dated Jul. 21, 2011.
Office action from Control No. 90/008,167, mailed Dec. 12, 2007.
Response from Control 90/008,167 dated Feb. 12, 2008.
First Office Action in CA Appl. No. 2,621,748 dated Jul. 8, 2013.
Response from U.S. Appl. No. 12/857,844 dated Jul. 8, 2013.
Office action from U.S. Appl. No. 12/857,844 dated Aug. 7, 2013.
Office action from U.S. Appl. No. 13/404,848 dated Sep. 17, 2013.
Response to Office Action from U.S. Appl. No. 13/404,848 dated Dec. 16, 2013.
Office Action for U.S. Appl. No. 14/119,192 dated Jul. 5, 2016.
Restriction Requirement for U.S. Appl. No. 14/119,192 dated Feb. 18, 2016.
Response to Restriction Requirement for U.S. Appl. No. 14/119,192 dated May 12, 2016.
Response Office Action for U.S. Appl. No. 14/119,192 dated Nov. 7, 2016.
Office Action for U.S. Appl. No. 14/119,192 dated Dec. 6, 2016.

* cited by examiner

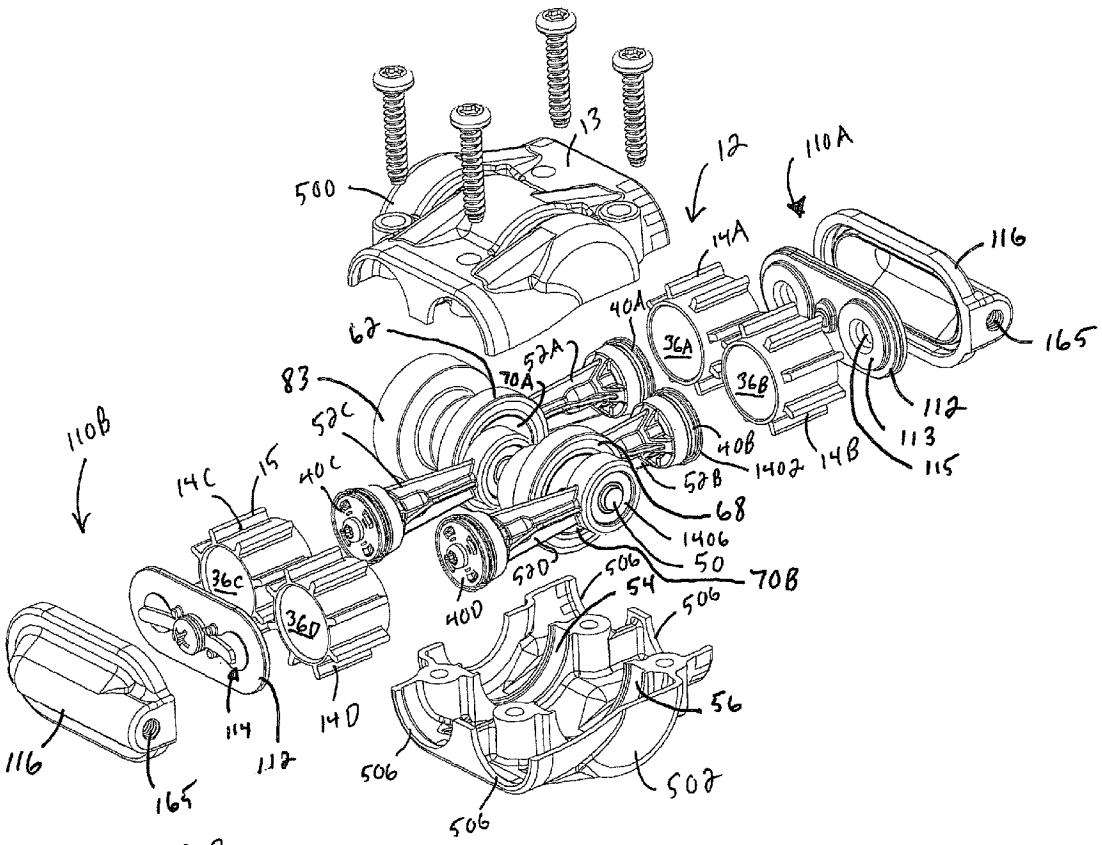
10
12
13
110A
110B
116
165
112
113
115
114B
114A
114C
114D
36A
36B
36C
36D
40A
40B
40C
40D
42
50
50A
50B
50C
50D
50E
50F
50G
50H
54
56
68
70A
70B
83
140B
140C
140D
140E
140F
140G
140H
140J
140K
140L
140M
140N
140P
140Q
140R
140S
140T
140U
140V
140W
140X
140Y
140Z
140AA
140BB
140CC
140DD
140EE
140FF
140GG
140HH
140II
140JJ
140KK
140LL
140MM
140NN
140OO
140PP
140QQ
140RR
140SS
140TT
140UU
140VV
140WW
140XX
140YY
140ZZ
140AAA
140BBB
140CCC
140DDD
140EEE
140FFF
140GGG
140HHH
140III
140JJJ
140KKK
140LLL
140MMM
140NNN
140OOO
140PPP
140QQQ
140RRR
140SSS
140TTT
140UUU
140VVV
140WWW
140XXX
140YYY
140ZZZ
140AAAA
140BBBB
140CCCC
140DDDD
140EEEE
140FFFF
140GGGG
140HHHH
140IIII
140JJJJ
140KKKK
140LLLL
140MMMM
140NNNN
140OOOO
140PPPP
140QQQQ
140RRRR
140SSSS
140TTTT
140UUUU
140VVVV
140WWWW
140XXXX
140YYYY
140ZZZZ
140AAAAA
140BBBBB
140CCCCC
140DDDDD
140EEEEE
140FFFFF
140GGGGG
140HHHHH
140IIIII
140JJJJJ
140KKKKK
140LLLLL
140MMMMM
140NNNNN
140OOOOO
140PPPPP
140QQQQQ
140RRRRR
140SSSSS
140TTTTT
140UUUUU
140VVVVV
140WWWWW
140XXXXX
140YYYYY
140ZZZZZ
140AAAAAA
140BBBBBB
140CCCCCC
140DDDDDD
140EEEEEE
140FFFFFF
140GGGGGG
140HHHHHH
140IIIIII
140JJJJJJ
140KKKKKK
140LLLLLL
140MMMMMM
140NNNNNN
140OOOOOO
140PPPPPP
140QQQQQQ
140RRRRRR
140SSSSSS
140TTTTTT
140UUUUUU
140VVVVVV
140WWWWWW
140XXXXXX
140YYYYYY
140ZZZZZZ
140AAAAAAA
140BBBBBBB
140CCCCCCC
140DDDDDDD
140EEEEEEE
140FFFFFFF
140GGGGGGG
140HHHHHHH
140IIIIIIII
140JJJJJJJ
140KKKKKKK
140LLLLLLL
140MMMMMMM
140NNNNNNN
140OOOOOOO
140PPPPPPP
140QQQQQQQ
140RRRRRRR
140SSSSSSS
140TTTTTTT
140UUUUUUU
140VVVVVVV
140WWWWWWW
140XXXXXXX
140YYYYYYY
140ZZZZZZZ
140AAAAAAAA
140BBBBBBBB
140CCCCCCCC
140DDDDDDDD
140EEEEEEEE
140FFFFFFFF
140GGGGGGGG
140HHHHHHHH
140IIIIIIIII
140JJJJJJJJ
140KKKKKKKK
140LLLLLLLL
140MMMMMMMM
140NNNNNNNN
140OOOOOOOO
140PPPPPPPP
140QQQQQQQQ
140RRRRRRRR
140SSSSSSSS
140TTTTTTTT
140UUUUUUUU
140VVVVVVVV
140WWWWWWWW
140XXXXXXXX
140YYYYYYYY
140ZZZZZZZZ
140AAAAAAAAA
140BBBBBBBBB
140CCCCCCCCC
140DDDDDDDDD
140EEEEEEEEE
140FFFFFFFFF
140GGGGGGGGG
140HHHHHHHHH
140IIIIIIIIII
140JJJJJJJJJ
140KKKKKKKKK
140LLLLLLLLL
140MMMMMMMMM
140NNNNNNNNN
140OOOOOOOOO
140PPPPPPPPP
140QQQQQQQQQ
140RRRRRRRRR
140SSSSSSSSS
140TTTTTTTTT
140UUUUUUUUU
140VVVVVVVVV
140WWWWWWWWW
140XXXXXXXXX
140YYYYYYYYY
140ZZZZZZZZZ
140AAAAAAAAAA
140BBBBBBBBBB
140CCCCCCCCCC
140DDDDDDDDDD
140EEEEEEEEEE
140FFFFFFFFFF
140GGGGGGGGGG
140HHHHHHHHHH
140IIIIIIIIIII
140JJJJJJJJJJ
140KKKKKKKKKK
140LLLLLLLLLL
140MMMMMMMMMM
140NNNNNNNNNN
140OOOOOOOOOO
140PPPPPPPPPP
140QQQQQQQQQQ
140RRRRRRRRRR
140SSSSSSSSSS
140TTTTTTTTTT
140UUUUUUUUUU
140VVVVVVVVVV
140WWWWWWWWWW
140XXXXXXXXXX
140YYYYYYYYYY
140ZZZZZZZZZZ
140AAAAAAAAAAA
140BBBBBBBBBBB
140CCCCCCCCCCC
140DDDDDDDDDDD
140EEEEEEEEEEE
140FFFFFFFFFFF
140GGGGGGGGGGG
140HHHHHHHHHHH
140IIIIIIIIIIII
140JJJJJJJJJJJ
140KKKKKKKKKKK
140LLLLLLLLLLL
140MMMMMMMMMMM
140NNNNNNNNNNN
140OOOOOOOOOOO
140PPPPPPPPPPP
140QQQQQQQQQQQ
140RRRRRRRRRRR
140SSSSSSSSSSS
140TTTTTTTTTTT
140UUUUUUUUUUU
140VVVVVVVVVVV
140WWWWWWWWWWW
140XXXXXXXXXXX
140YYYYYYYYYYY
140ZZZZZZZZZZZ
140AAAAAAAAAAAA
140BBBBBBBBBBBB
140CCCCCCCCCCCC
140DDDDDDDDDDDD
140EEEEEEEEEEEE
140FFFFFFFFFFFF
140GGGGGGGGGGGG
140HHHHHHHHHHHH
140IIIIIIIIIIIII
140JJJJJJJJJJJJ
140KKKKKKKKKKKK
140LLLLLLLLLLLL
140MMMMMMMMMMMM
140NNNNNNNNNNNN
140OOOOOOOOOOOO
140PPPPPPPPPPPP
140QQQQQQQQQQQQ
140RRRRRRRRRRRR
140SSSSSSSSSSSS
140TTTTTTTTTTTT
140UUUUUUUUUUUU
140VVVVVVVVVVVV
140WWWWWWWWWWWW
140XXXXXXXXXXXX
140YYYYYYYYYYYY
140ZZZZZZZZZZZZ
140AAAAAAAAAAAAA
140BBBBBBBBBBBBB
140CCCCCCCCCCCCC
140DDDDDDDDDDDDD
140EEEEEEEEEEEEE
140FFFFFFFFFFFFF
140GGGGGGGGGGGGG
140HHHHHHHHHHHHH
140IIIIIIIIIIIIII
140JJJJJJJJJJJJJ
140KKKKKKKKKKKKK
140LLLLLLLLLLLLL
140MMMMMMMMMMMMM
140NNNNNNNNNNNNN
140OOOOOOOOOOOOO
140PPPPPPPPPPPPP
140QQQQQQQQQQQQQ
140RRRRRRRRRRRRR
140SSSSSSSSSSSSS
140TTTTTTTTTTTTT
140UUUUUUUUUUUUU
140VVVVVVVVVVVVV
140WWWWWWWWWWWWW
140XXXXXXXXXXXXX
140YYYYYYYYYYYYY
140ZZZZZZZZZZZZZ
140AAAAAAAAAAAAAA
140BBBBBBBBBBBBBB
140CCCCCCCCCCCCCC
140DDDDDDDDDDDDDD
140EEEEEEEEEEEEEE
140FFFFFFFFFFFFFF
140GGGGGGGGGGGGGG
140HHHHHHHHHHHHHH
140IIIIIIIIIIIIIII
140JJJJJJJJJJJJJJ
140KKKKKKKKKKKKKK
140LLLLLLLLLLLLLL
140MMMMMMMMMMMMMM
140NNNNNNNNNNNNNN
140OOOOOOOOOOOOOO
140PPPPPPPPPPPPPP
140QQQQQQQQQQQQQQ
140RRRRRRRRRRRRRR
140SSSSSSSSSSSSSS
140TTTTTTTTTTTTTT
140UUUUUUUUUUUUUU
140VVVVVVVVVVVVVV
140WWWWWWWWWWWWWW
140XXXXXXXXXXXXXX
140YYYYYYYYYYYYYY
140ZZZZZZZZZZZZZZ
140AAAAAAAAAAAAAAA
140BBBBBBBBBBBBBBB
140CCCCCCCCCCCCCCC
140DDDDDDDDDDDDDDD
140EEEEEEEEEEEEEEE
140FFFFFFFFFFFFFFF
140GGGGGGGGGGGGGGG
140HHHHHHHHHHHHHHH
140IIIIIIIIIIIIIIII
140JJJJJJJJJJJJJJJ
140KKKKKKKKKKKKKKK
140LLLLLLLLLLLLLLL
140MMMMMMMMMMMMMMM
140NNNNNNNNNNNNNNN
140OOOOOOOOOOOOOOO
140PPPPPPPPPPPPPPP
140QQQQQQQQQQQQQQQ
140RRRRRRRRRRRRRRR
140SSSSSSSSSSSSSSS
140TTTTTTTTTTTTTTT
140UUUUUUUUUUUUUUU
140VVVVVVVVVVVVVVV
140WWWWWWWWWWWWWWW
140XXXXXXXXXXXXXXX
140YYYYYYYYYYYYYYY
140ZZZZZZZZZZZZZZZ
140AAAAAAAAAAAAAAAA
140BBBBBBBBBBBBBBBB
140CCCCCCCCCCCCCCCC
140DDDDDDDDDDDDDDDD
140EEEEEEEEEEEEEEEE
140FFFFFFFFFFFFFFFF
140GGGGGGGGGGGGGGGG
140HHHHHHHHHHHHHHHH
140IIIIIIIIIIIIIIIII
140JJJJJJJJJJJJJJJJ
140KKKKKKKKKKKKKKKK
140LLLLLLLLLLLLLLLL
140MMMMMMMMMMMMMMMM
140NNNNNNNNNNNNNNNN
140OOOOOOOOOOOOOOOO
140PPPPPPPPPPPPPPPP
140QQQQQQQQQQQQQQQQ
140RRRRRRRRRRRRRRRR
140SSSSSSSSSSSSSSSS
140TTTTTTTTTTTTTTTT
140UUUUUUUUUUUUUUUU
140VVVVVVVVVVVVVVVV
140WWWWWWWWWWWWWWWW
140XXXXXXXXXXXXXXXX
140YYYYYYYYYYYYYYYY
140ZZZZZZZZZZZZZZZZ
140AAAAAAAAAAAAAAAAA
140BBBBBBBBBBBBBBBBB
140CCCCCCCCCCCCCCCCC
140DDDDDDDDDDDDDDDDD
140EEEEEEEEEEEEEEEEE
140FFFFFFFFFFFFFFFFF
140GGGGGGGGGGGGGGGGG
140HHHHHHHHHHHHHHHHH
140IIIIIIIIIIIIIIIIII
140JJJJJJJJJJJJJJJJJ
140KKKKKKKKKKKKKKKKK
140LLLLLLLLLLLLLLLLL
140MMMMMMMMMMMMMMMMM
140NNNNNNNNNNNNNNNNN
140OOOOOOOOOOOOOOOOO
140PPPPPPPPPPPPPPPPP
140QQQQQQQQQQQQQQQQQ
140RRRRRRRRRRRRRRRRR
140SSSSSSSSSSSSSSSSS
140TTTTTTTTTTTTTTTTT
140UUUUUUUUUUUUUUUUU
140VVVVVVVVVVVVVVVVV
140WWWWWWWWWWWWWWWWW
140XXXXXXXXXXXXXXXXX
140YYYYYYYYYYYYYYYYY
140ZZZZZZZZZZZZZZZZZ
140AAAAAAAAAAAAAAAAAA
140BBBBBBBBBBBBBBBBBB
140CCCCCCCCCCCCCCCCCC
140DDDDDDDDDDDDDDDDDD
140EEEEEEEEEEEEEEEEEE
140FFFFFFFFFFFFFFFFFF
140GGGGGGGGGGGGGGGGGG
140HHHHHHHHHHHHHHHHHH
140IIIIIIIIIIIIIIIIIII
140JJJJJJJJJJJJJJJJJJ
140KKKKKKKKKKKKKKKKKK
140LLLLLLLLLLLLLLLLLL
140MMMMMMMMMMMMMMMMMM
140NNNNNNNNNNNNNNNNNN
140OOOOOOOOOOOOOOOOOO
140PPPPPPPPPPPPPPPPPP
140QQQQQQQQQQQQQQQQQQ
140RRRRRRRRRRRRRRRRRR
140SSSSSSSSSSSSSSSSSS
140TTTTTTTTTTTTTTTTTT
140UUUUUUUUUUUUUUUUUU
140VVVVVVVVVVVVVVVVVV
140WWWWWWWWWWWWWWWWWW
140XXXXXXXXXXXXXXXXXX
140YYYYYYYYYYYYYYYYYY
140Z

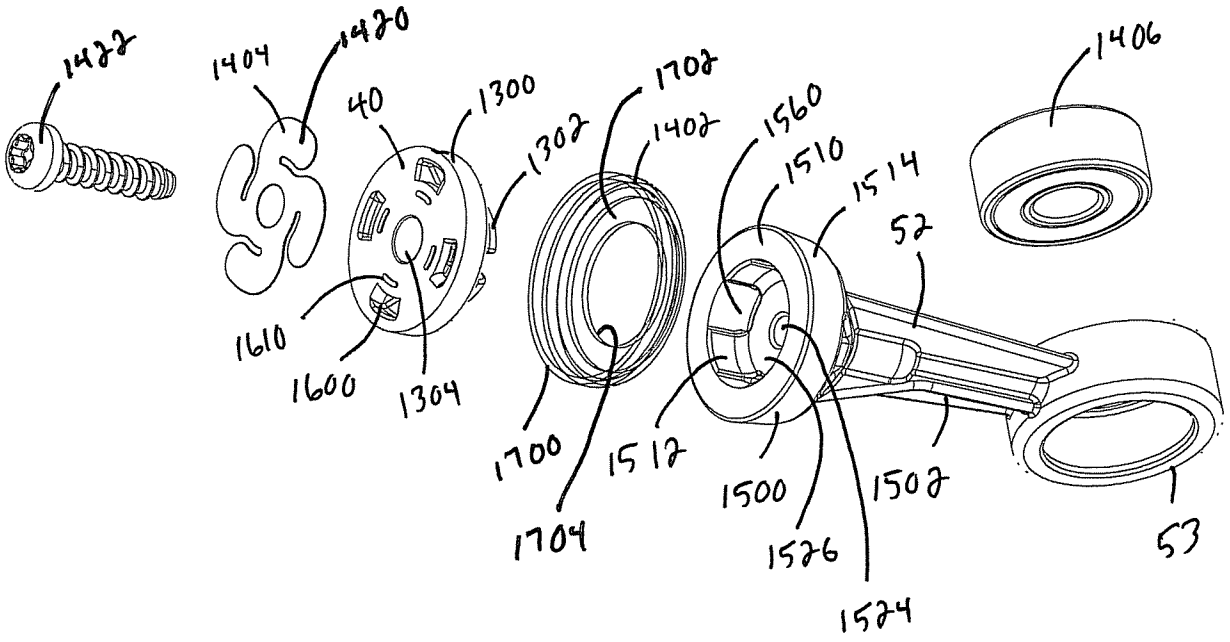
1424
1404
1420
40
1300
1302
1704
1702
1400
1510
1514
54
1508
1524
1526
1500
1512
1504
1506
1502
1600
1610
1604
1606
1608
1602
1610
1612
1614
1616
1618
1620
1622
1624
1626
1628
1630
1632
1634
1636
1638
1640
1642
1644
1646
1648
1650
1652
1654
1656
1658
1660
1662
1664
1666
1668
1670
1672
1674
1676
1678
1680
1682
1684
1686
1688

PUMPING DEVICE

CROSS-REFERENCE TO RELATED APPLICATION

This application claims the benefit of U.S. Provisional Patent Application Ser. No. 61/594,746, entitled PUMPING DEVICE and filed Feb. 3, 2012, the entire disclosure of which is incorporated herein by reference, to the extent that it is not conflicting with the present application.

FIELD OF THE INVENTION

The present application relates to the field of pumping devices, such as gas compressors and gas vacuums.

BACKGROUND

Oxygen has many important medical uses including, for example, assisting patients that have congestive heart failure or other diseases. Supplemental oxygen allows patients to receive more oxygen than is present in the ambient atmosphere. An oxygen concentrator separates nitrogen from atmospheric air to provide a highly concentrated source of oxygen. Some existing oxygen concentrators have two cylindrical containers filled with zeolite materials that selectively adsorb the nitrogen in the air. A compressor is used to force air through one of the cylindrical containers at a pressure at which the nitrogen molecules are captured by the zeolite. While air is forced through the first cylindrical container, the contents of the other cylindrical container are vented away to dissipate the captured nitrogen.

Several existing product gas or oxygen concentrators, for example, are disclosed in U.S. Pat. Nos. 4,449,990, 5,906,672, 5,917,135, and 5,988,165 which are commonly assigned to Invacare Corporation of Elyria, Ohio and fully incorporated herein by reference.

SUMMARY OF THE INVENTION

The present application discloses embodiments of a pumping device. A pumping device compresses fluid, provides a vacuum, or both compresses fluid and provides a vacuum. A pumping device may be used to force gas through a sieve bed, draw gas out of a sieve bed, or both force gas through a sieve bed and drawing gas out of a sieve bed. However, the pumping device may be used in a wide variety of different applications. When the pumping device is used with a sieve bed, the sieve bed may be a container with an oxygen enriching material, such as zeolite. However, other oxygen enriching materials can be used. A pumping device may be operated at high speed to provide a high fluid flow rate with a small pumping device.

BRIEF DESCRIPTION OF THE DRAWINGS

Further features and advantages of the present invention will become apparent to those of ordinary skill in the art to which the invention pertains from a reading of the following description together with the accompanying drawings, in which:

FIG. 2B is a second exploded perspective view of the pumping device shown in FIG. 1A;

FIG. 14C is an exploded perspective view of the piston assembly illustrated by FIG. 14A;

DETAILED DESCRIPTION OF PREFERRED EMBODIMENTS

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members or elements.

FIG. 1 illustrates an exemplary embodiment of a pumping device 10. In several of the illustrated embodiments, the pumping device 10 is configured as a compressor. However, as will be described in more detail below, the pumping device 10 can be configured to provide a vacuum (see FIGS. 18A and 18B) or to provide both compressed gas and draw a vacuum by changing the valve configuration of the pumping device. The pumping device 10 includes a cylinder assembly 12 and first and second cylinder head assemblies 110A, 110B.

The cylinder assembly 12 can take a wide variety of different forms. In the example illustrated by FIG. 1, the cylinder assembly includes a housing 13, a first sleeve 14A, a second sleeve 14B, a third sleeve 14C, and a fourth sleeve 14D. The illustrated sleeves 14A-14D include optional fins 15. The fins 15 increase the surface area of the cylinders to help dissipate heat. The sleeves may take a wide variety of different forms. Any configuration that provides the cylinders can be used. For example, the first and second sleeves and/or the third and fourth sleeves may be formed from a single piece or block. The sleeves 14A-14D may be made from a wide variety of different materials including, but not limited to, metals, plastics, ceramics, carbon fiber materials, any combination of these materials and the like. In one exemplary embodiment, the sleeves 14A-14D are made from aluminum.

Figure 5A:
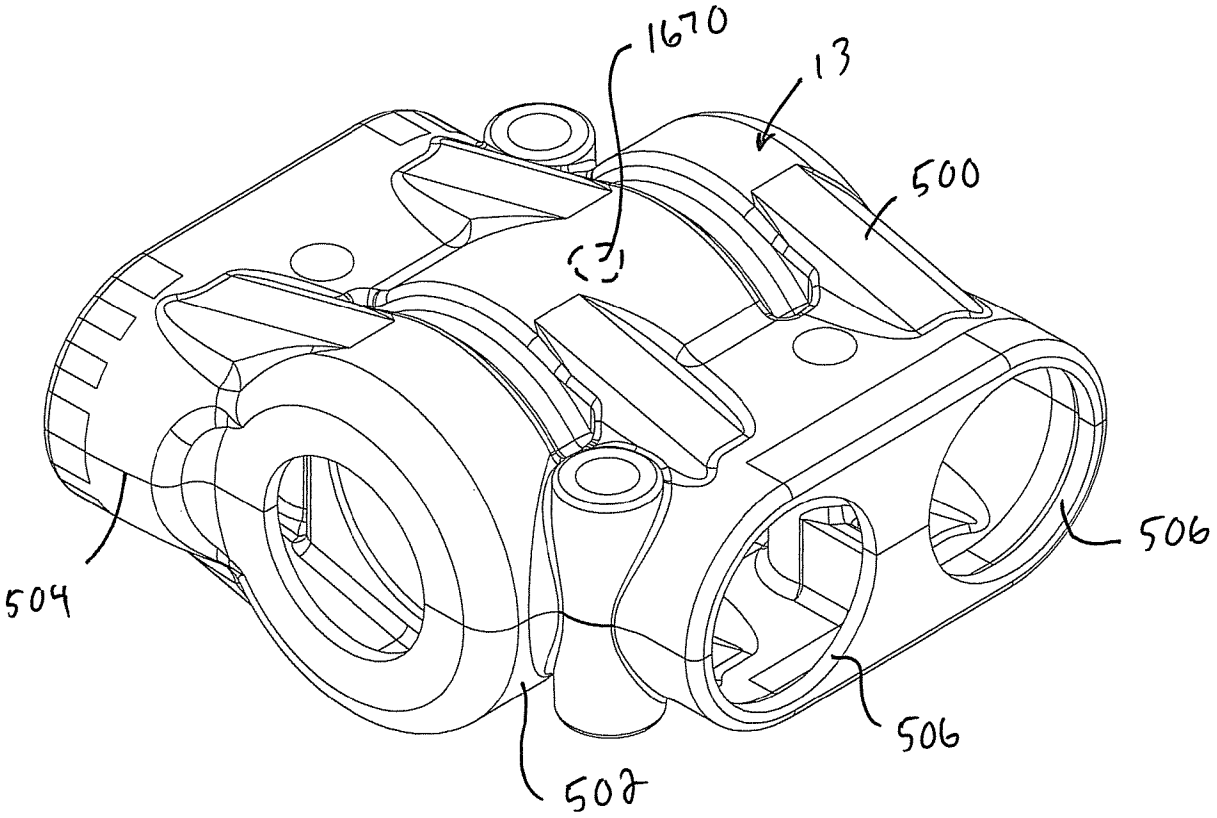
FIG. 5A is a perspective view of an exemplary embodiment of a housing for a pumping device.
Figure 5B:
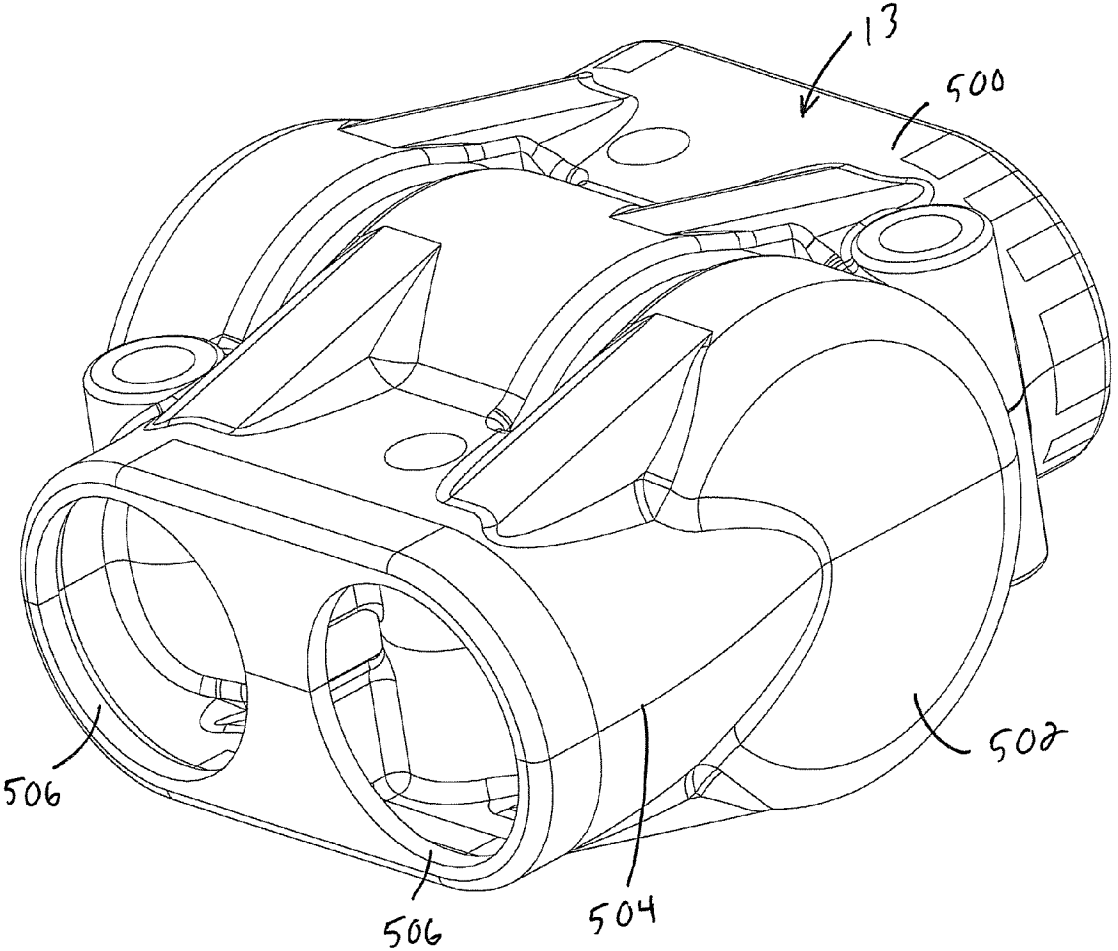
FIG. 5B is a second perspective view of an exemplary embodiment of a housing for a pumping device.
Figure 6A:
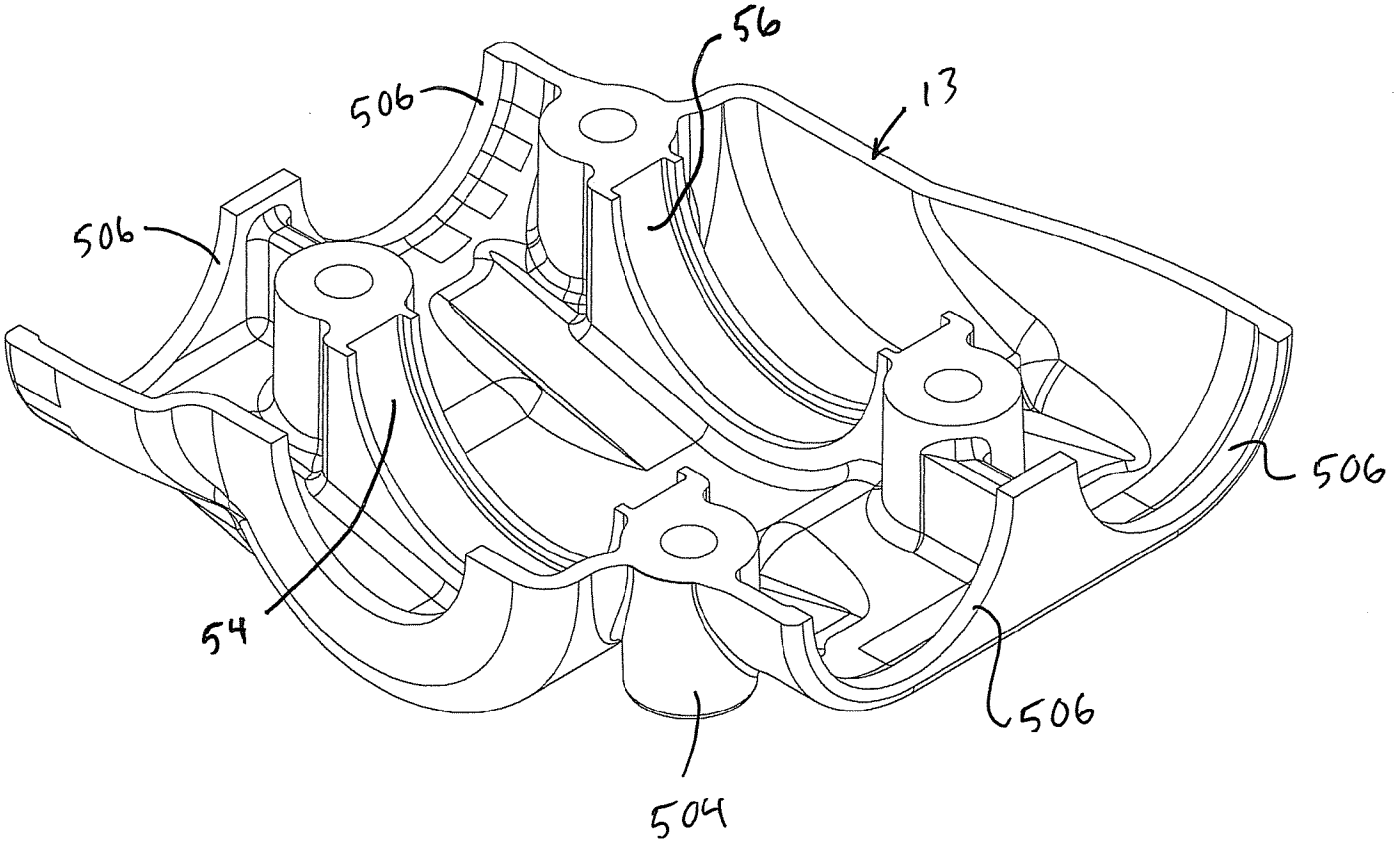
FIG. 6A is a perspective view illustrating a bottom portion of the housing illustrated by FIG. 5A.
Figure 6B:
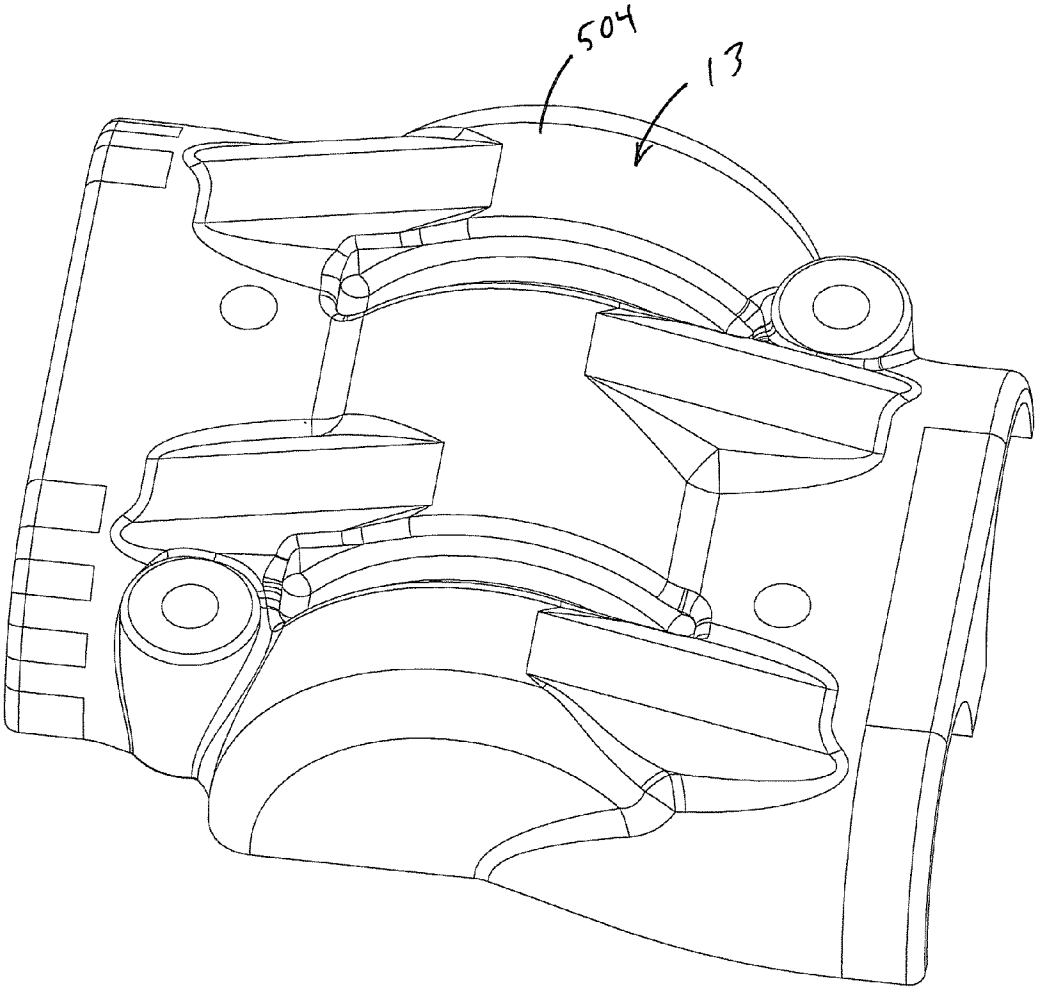
FIG. 6B is a second perspective view illustrating the bottom portion of the housing illustrated by FIG. 5A.
Figure 7A:
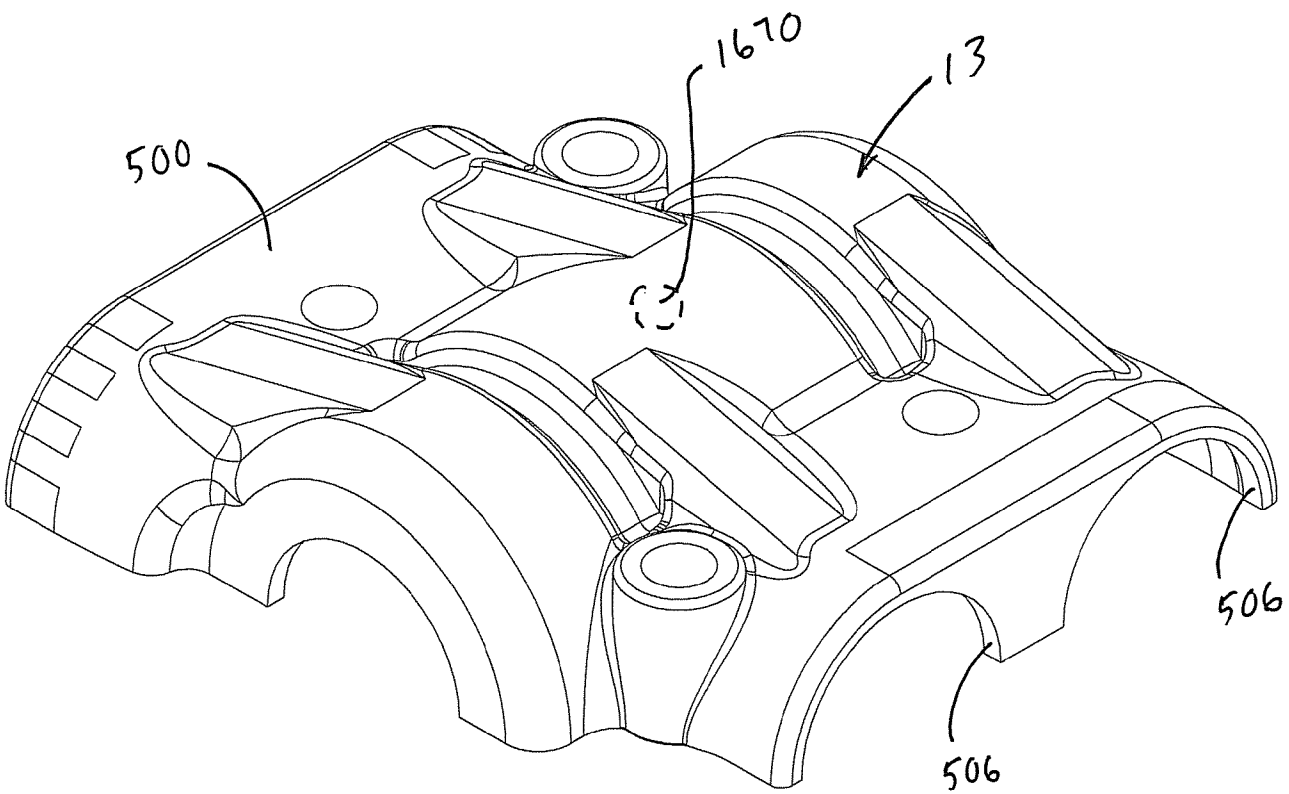
FIG. 7A is a perspective view illustrating a top portion of the housing illustrated by FIG. 5A.
Figure 7B:
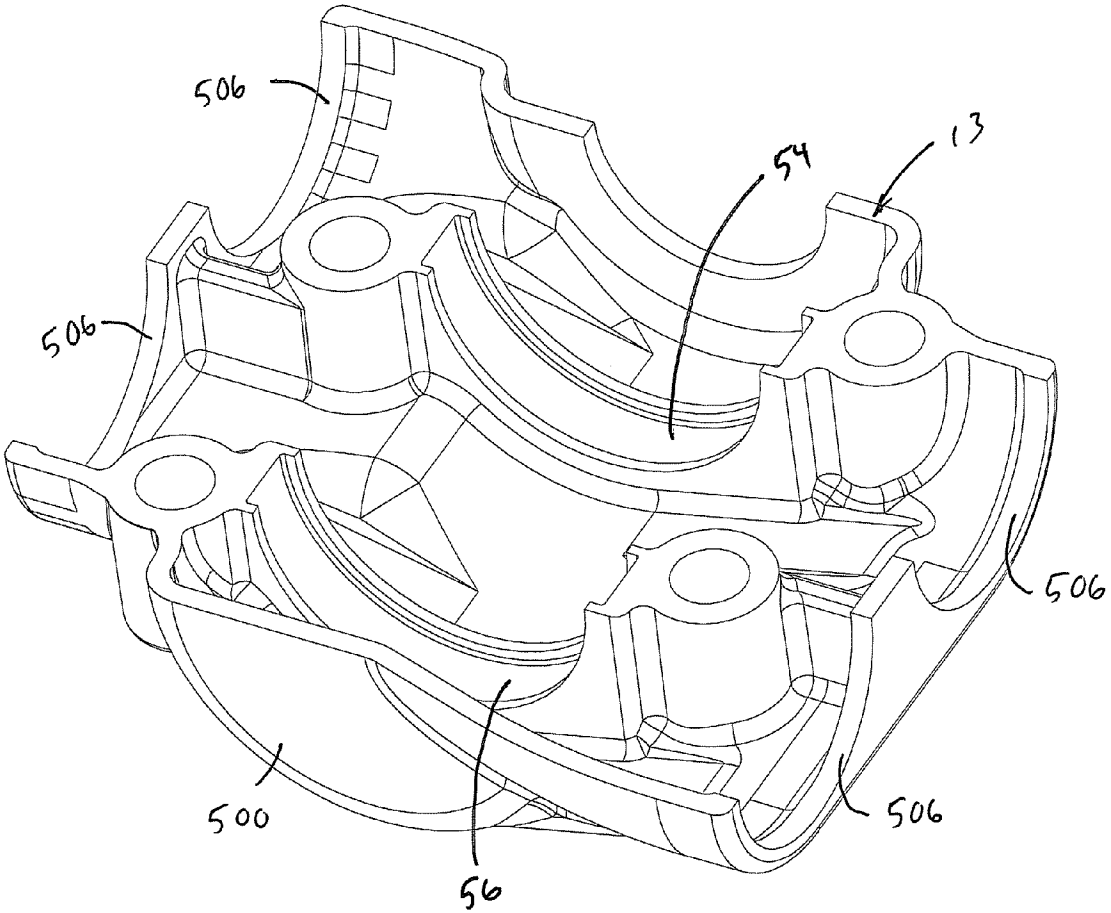
FIG. 7B is a second perspective view illustrating the top portion of the housing illustrated by FIG. 5A.
Figure 8:
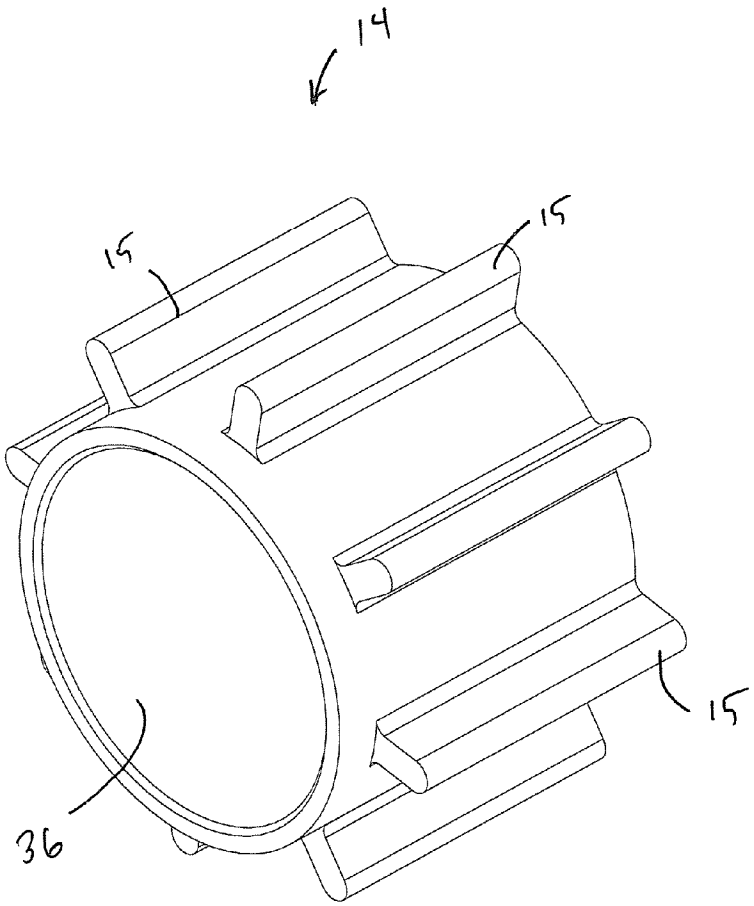
FIG. 8 is a perspective view of an exemplary embodiment of a cylinder for a pumping device.
Figure 8A:
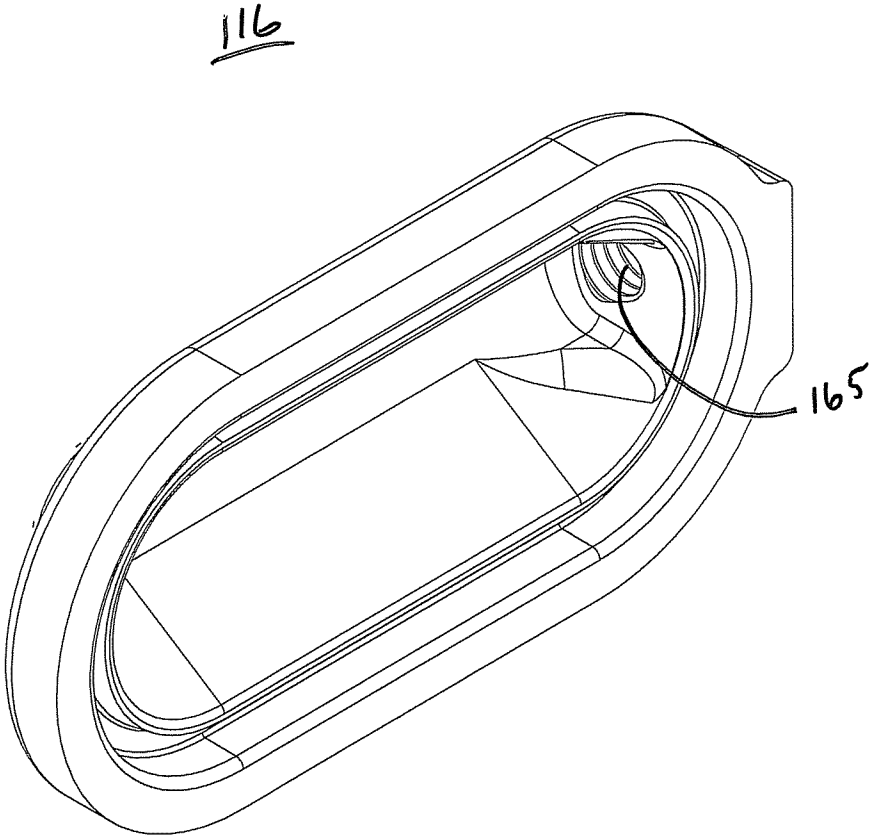
FIG. 8A is a perspective view of an exemplary embodiment of a head cover for a pumping device.
Figure 8B:
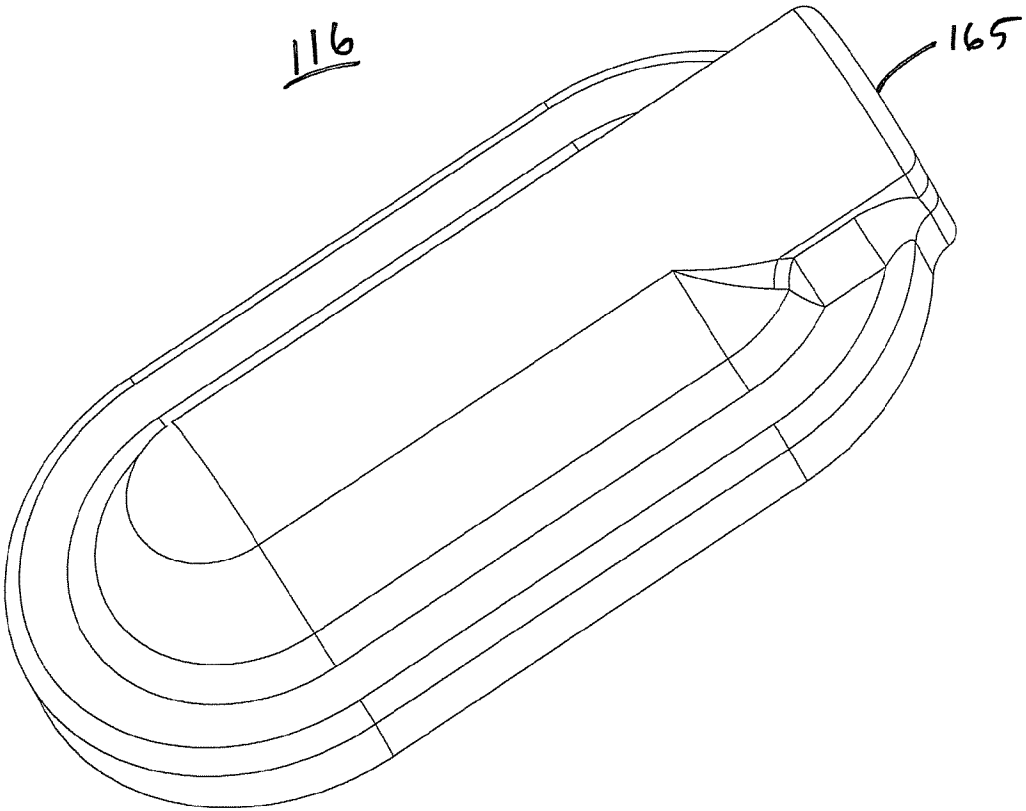
FIG. 8B is a second perspective view of the head cover illustrated by FIG. 8A.

The housing 13 can take a wide variety of different forms. Referring to FIGS. 5, 5A and 5B, the housing 13 includes openings 506. The cylinders 14A-14D are secured to the housing 13 in the openings 506. The illustrated housing 13 includes a first half 500 and a second half 502 that meet at a joint line 504. In the illustrated embodiment, the joint line 504 intersects the openings 506 for the cylinders 14A-14D. In another embodiment, the joint line 504 does not intersect the openings 506. For example, the joint line may be positioned as indicated by dashed line 504 in FIGS. 1B and 1D. The housing 13 may be made from a wide variety of different materials including, but not limited to, metals, plastics, ceramics, carbon fiber materials, any combination of these materials and the like. In one exemplary embodiment, the housing 13 is made from plastic.

Figure 1A:
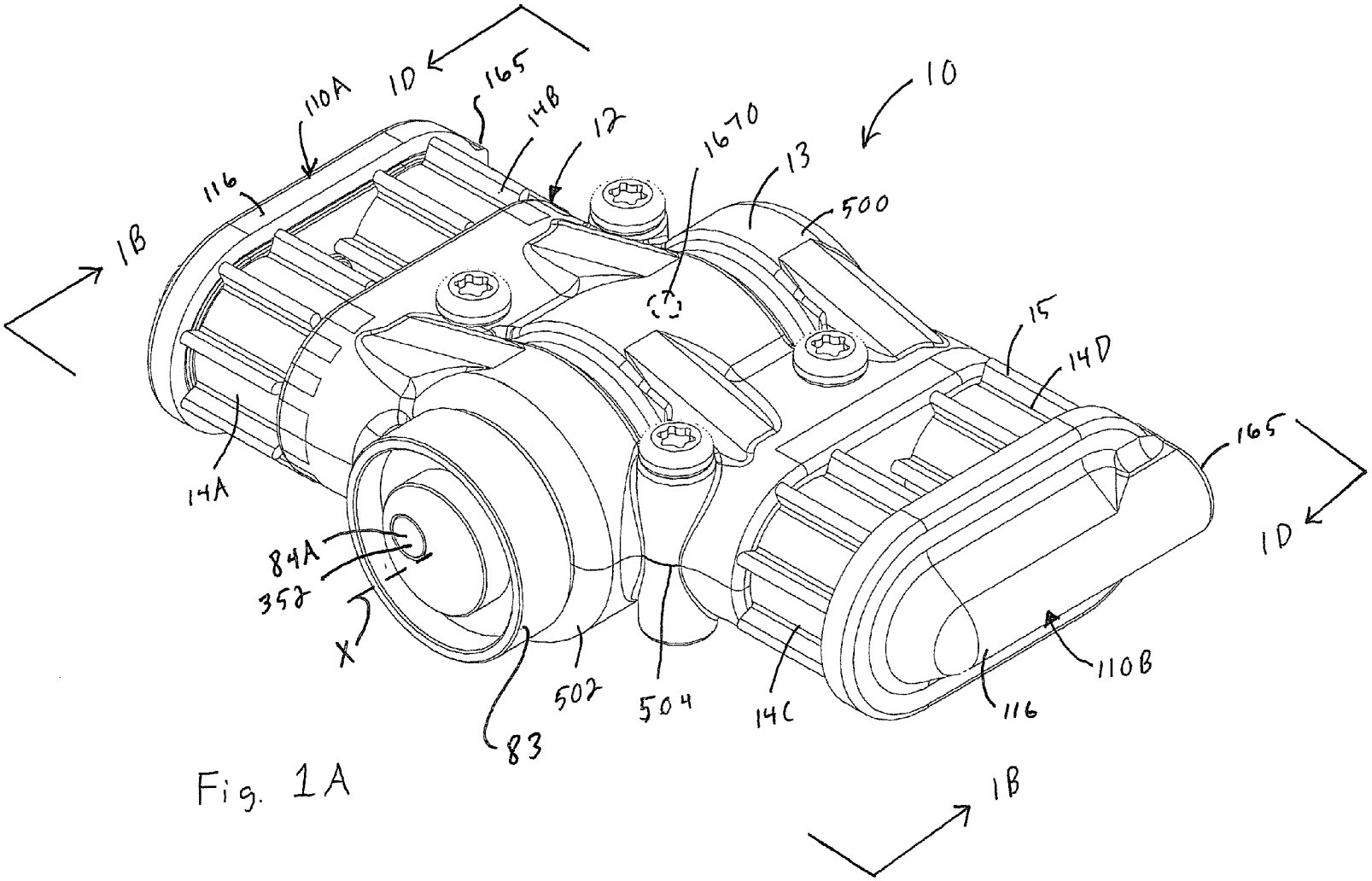
FIG. 1A is a perspective view of a pumping device in accordance with an exemplary embodiment.
Figure 1B:
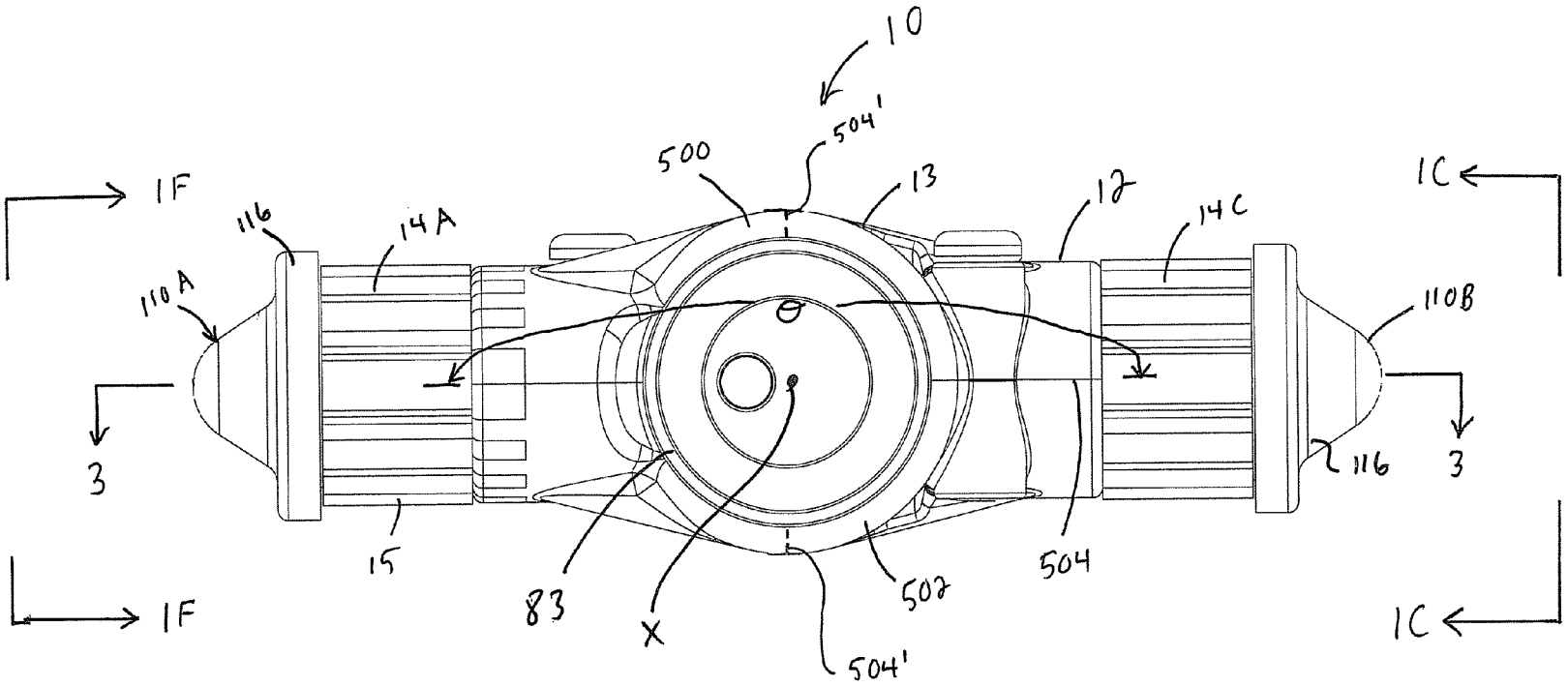
FIG. 1B is a view taken along lines 1B-1B in FIG. 1A.
Figure 1C:
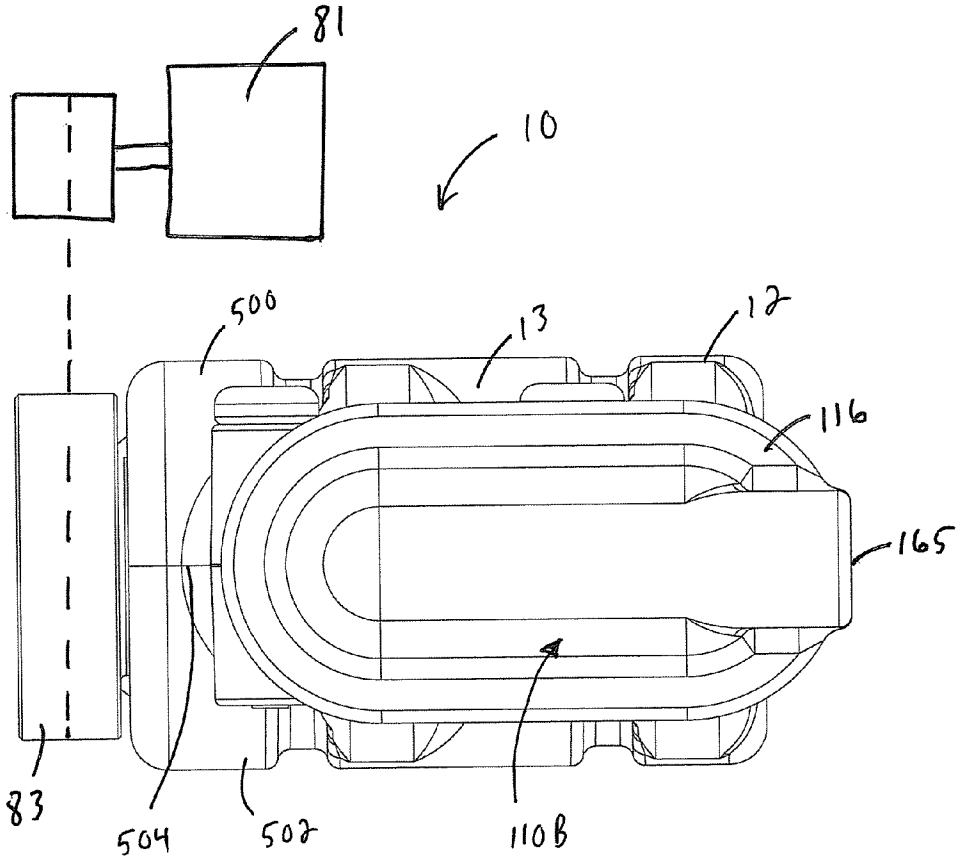
FIG. 1C is a view taken along lines 1C-1C in FIG. 1B.
Figure 1D:
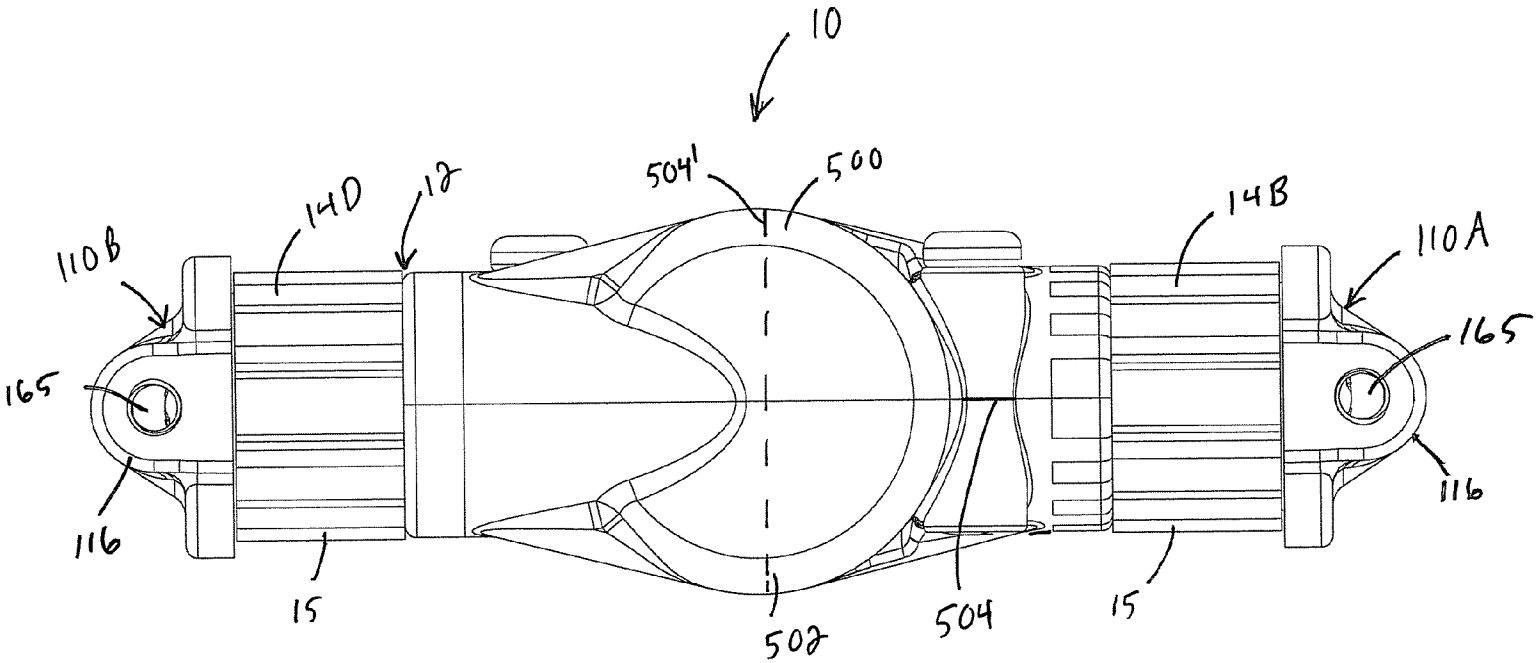
FIG. 1D is a view taken along lines 1D-1D in FIG. 1A.
Figure 1E:
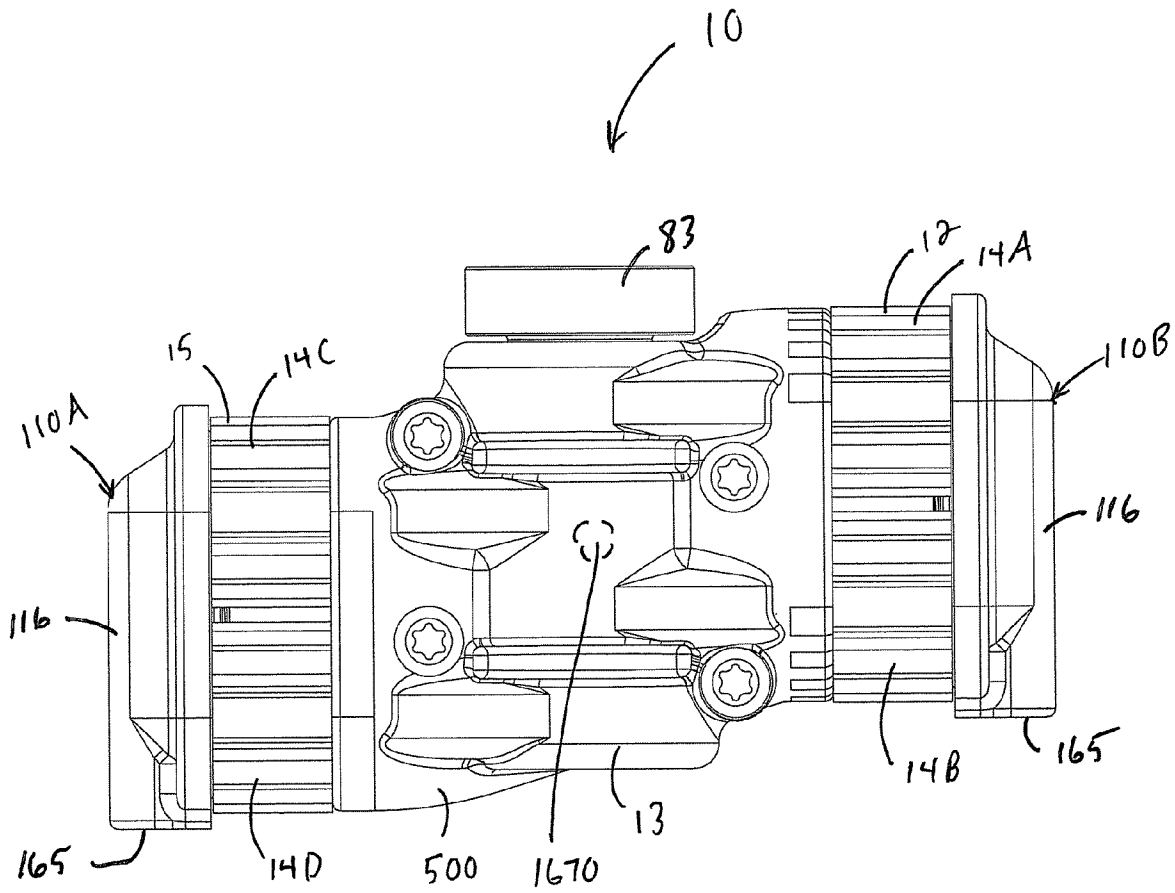
FIG. 1E is a top view of the pumping device illustrated in FIG. 1A.
Figure 1F:
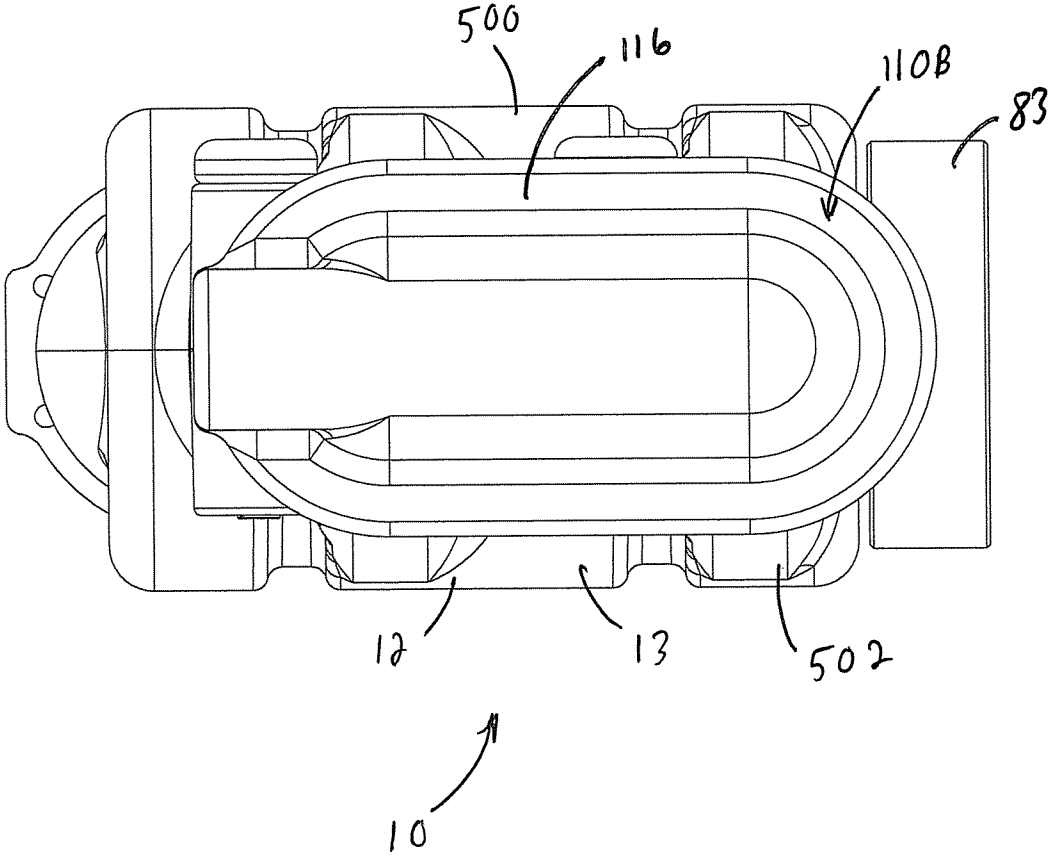
FIG. 1F is a view taken along lines 1F-1F in FIG. 1B.
Figure 1G:
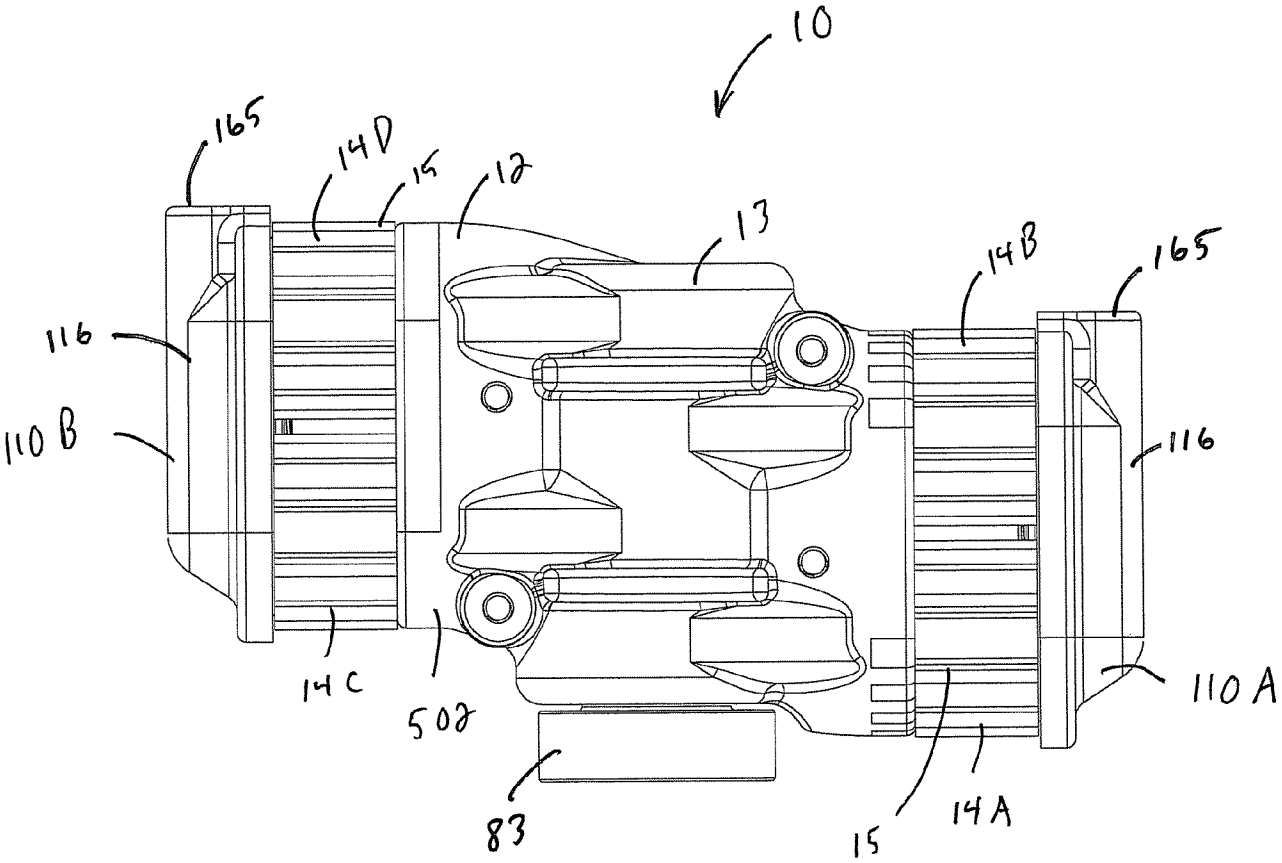
FIG. 1G is a bottom view of the pumping device illustrated in FIG. 1A.
Figure 3A:
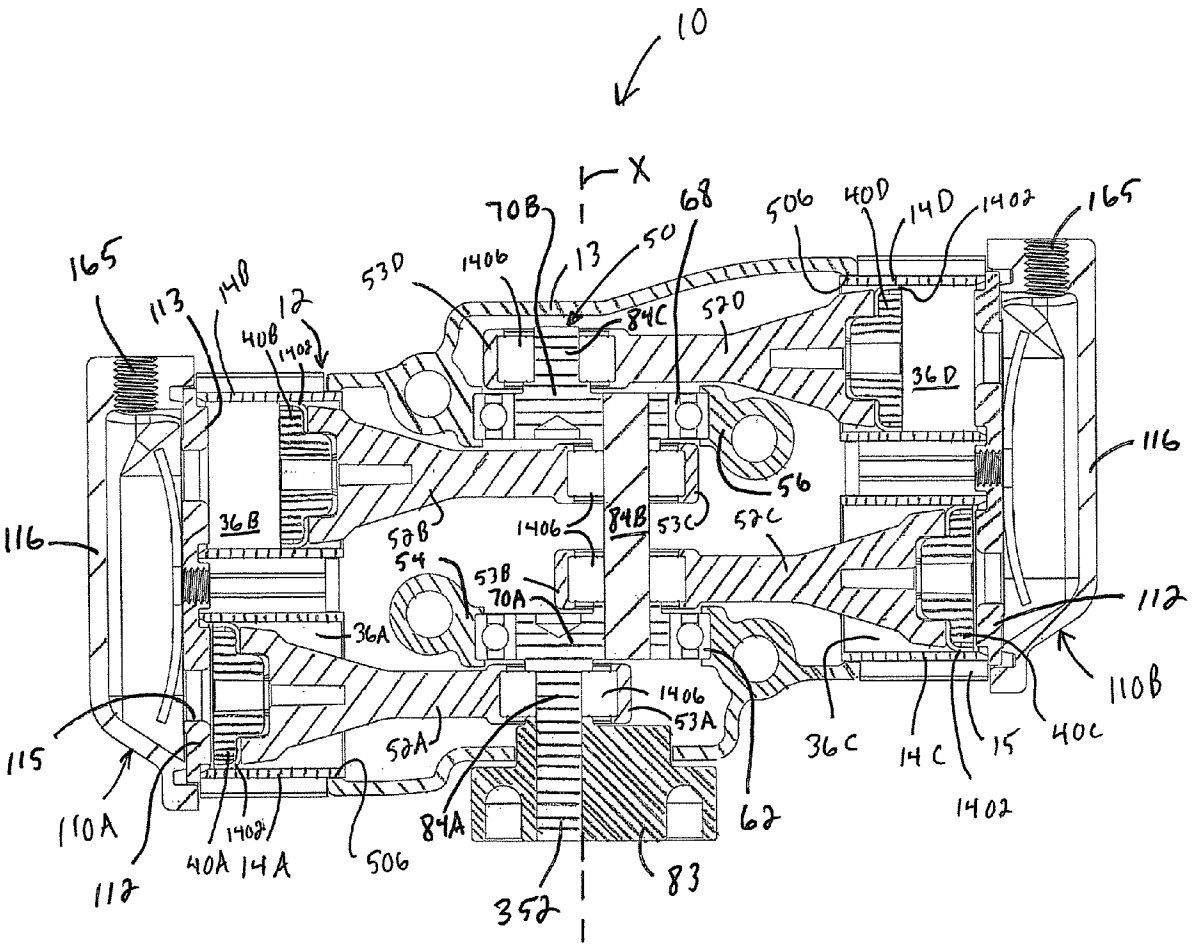
FIG. 3A is a sectional view taken along the plane indicated by lines 3-3 in FIG. 1B.
Figure 3B:
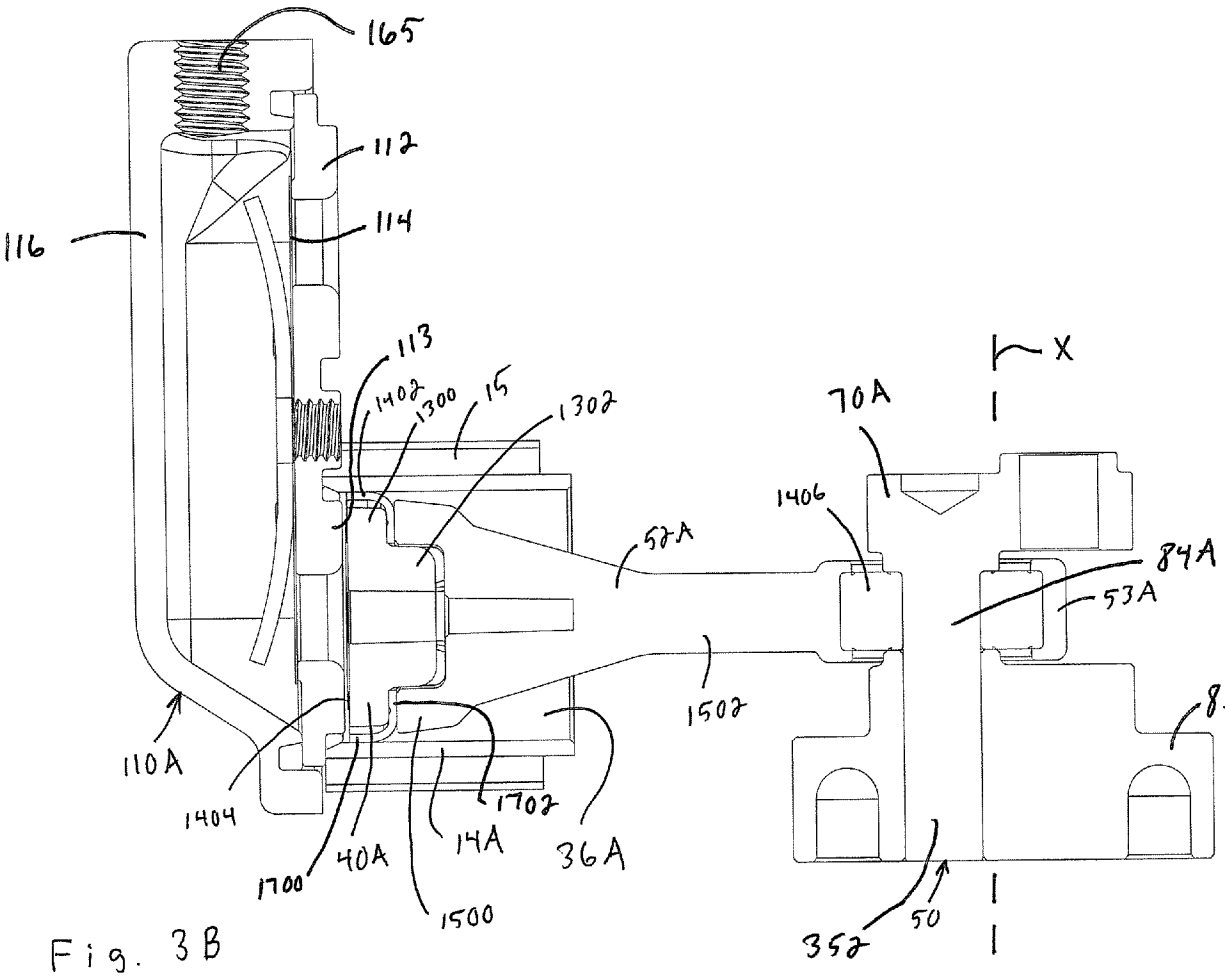
FIG. 3B is a view showing some of the components shown in FIG. 3A on a larger scale.

Referring to FIG. 3A, the sleeves 14A-14D define cylinders 36A-36D. The cylinders 36A-36D may take a variety of different forms. In the illustrated example, the cylinder 36A is adjacent and inline with the cylinder 36B and the cylinder 36C is adjacent and inline with the cylinder 36D. Referring to FIG. 1B, the cylinders 36A, 36B are opposed to the cylinders 36C, 36D. That is, an angle θ between the cylinders 36A, 36B and the cylinders 36C, 36D is approximately 180 degrees in the exemplary embodiment. As such, the illustrated cylinders 36A-36D are in a substantially "dual boxer" configuration. However, in other embodiments, the angle θ may be different. For example, the angle θ may be any angle between 90 and 180 degrees. As can be seen in FIGS. 1A, and 3A, the cylinders 36A-36D are each axially offset from one another in the illustrated embodiment.

Figure 2A:
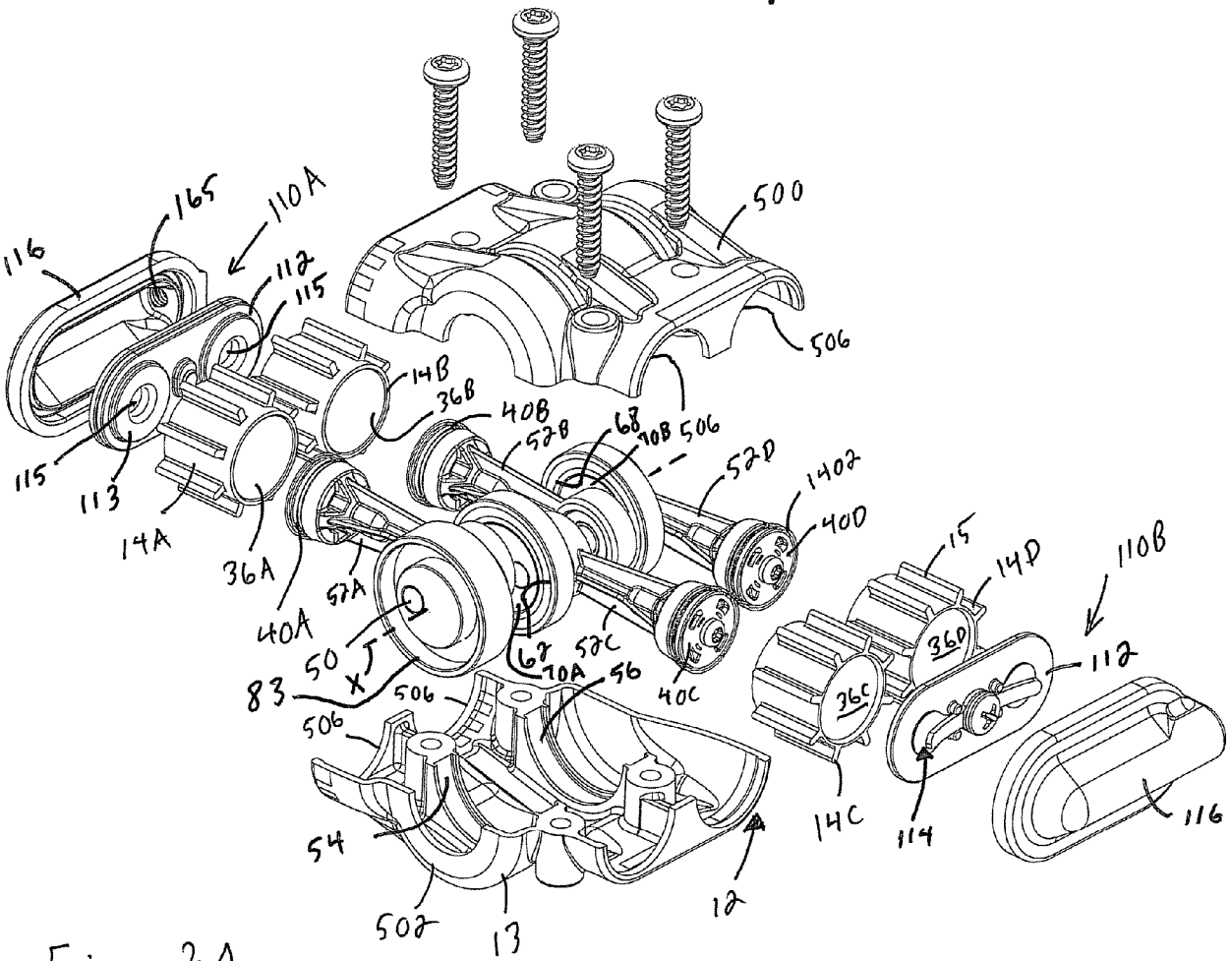
FIG. 2A is an exploded perspective view of the pumping device shown in FIG. 1A.

Referring to FIGS. 2A and 3A, the pumping device 10 includes a plurality of pistons 40A-40D that are associated in a one to one relationship with the cylinders 36A-36D. A first piston 40A is located in the first cylinder 36A and is supported for reciprocating movement in the first cylinder. A second piston 40B is located in the second cylinder 36B and is supported for reciprocating movement in the second cylinder. A third piston 40C is located in the third cylinder 36C and is supported for reciprocating movement in the third cylinder. A fourth piston 40D is located in the fourth cylinder 36D and is supported for reciprocating movement in the fourth cylinder.

The pistons 40A-40D can take a wide variety of different forms. FIGS. 14A-14D illustrate an exemplary embodiment of a piston assembly 1400 that may be used in each of the cylinders 36A-36D. The illustrated piston assembly includes a piston 40, a drive or connecting rod 52, a seal or ring 1402, an intake valve 1404, and a bearing 1406. In the illustrated embodiment, the pistons 40A-40D are fixed for movement with the corresponding drive or connecting rod 52A-52D. This arrangement is referred to as a "wobble piston," because fixing the pistons 40A-40D to the connecting rods 52A-52D causes some amount of canting or wobbling as the pistons 40A-40D move in the cylinders 36A-36D. Alternatively, one or more of the pistons 40 could be pivotally connected to the connecting rod 52 in a conventional manner. In this embodiment, the pistons 40A-40D will slide in the cylinders 36A-36D without significant canting or wobbling.

In the illustrated exemplary embodiment, the cylinders 36A-36D and corresponding pistons 40A-40D each have the same diameter and stroke. As a result, the stroke of each piston 40A-40D in its respective cylinder results in the same displacement of gas. In other embodiments, the pistons may have different sizes and/or strokes and the pumping device may have more than four cylinders or fewer than four cylinders.

In the illustrated exemplary embodiment, the gas inlet (when the pumping device is configured as a compressor) or the gas exhaust (when the pumping device is configured as a vacuum) is through the piston 40. However, in other embodiments, the gas inlet (when the pumping device is configured as a compressor) or the gas exhaust (when the pumping device is configured as a vacuum) is defined by a head assembly 110A, 110B, or in the cylinder 36.

Figure 16A:
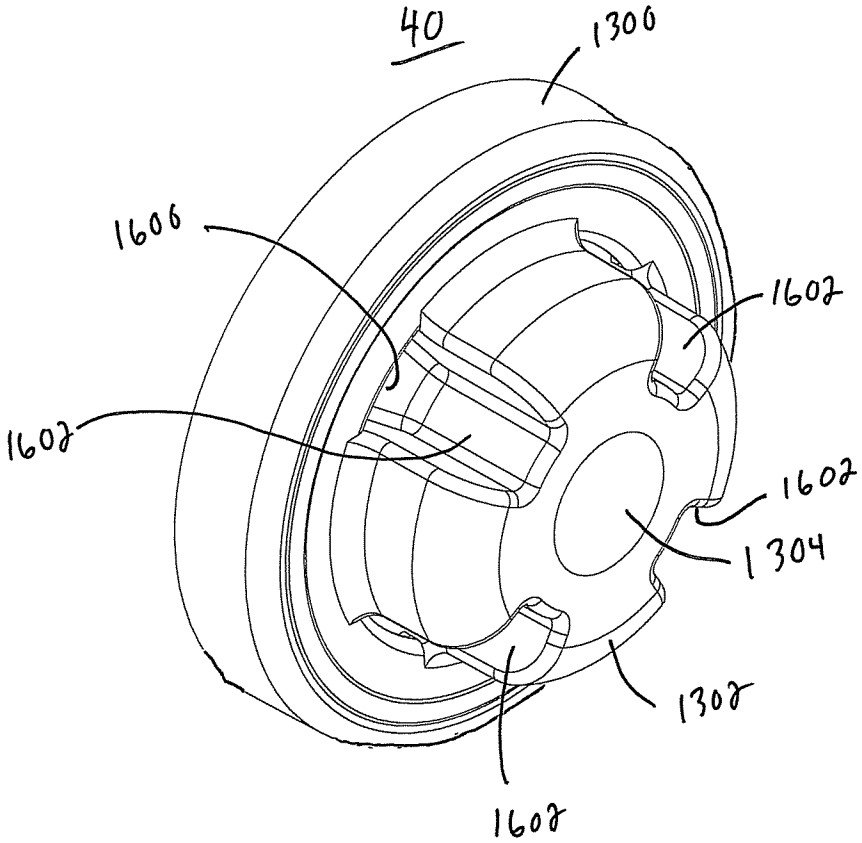
FIG. 16A is a perspective view of an exemplary embodiment of a piston.
Figure 16B:
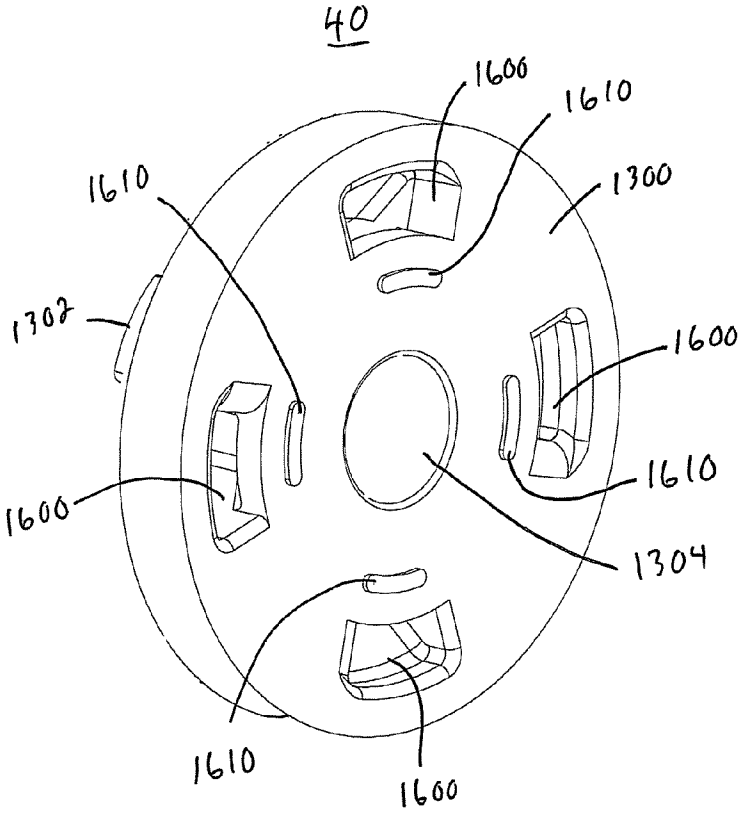
FIG. 16B is another perspective view of the piston illustrated by FIG. 16A.
Figure 16C:
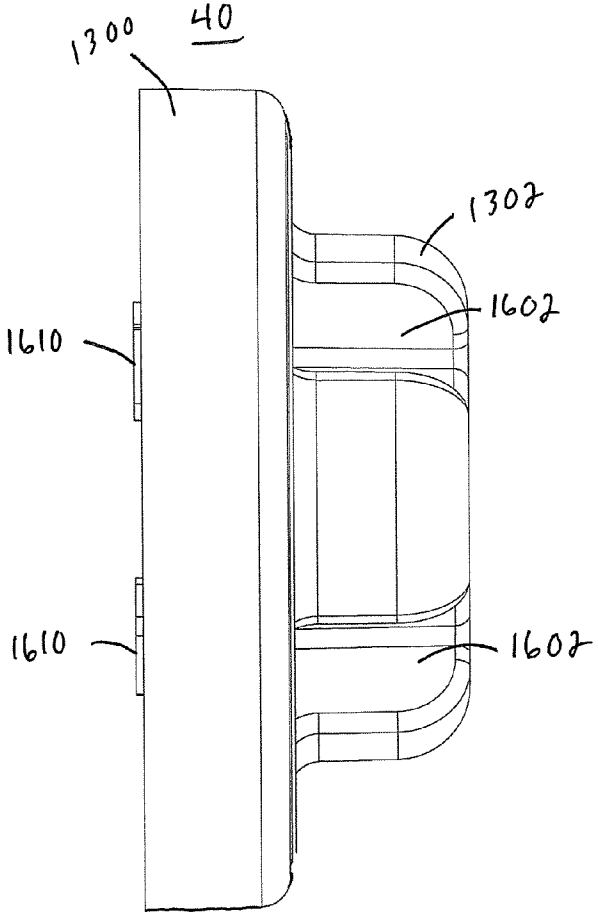
FIG. 16C is a side view of the piston illustrated by FIG. 16A.
Figure 16D:
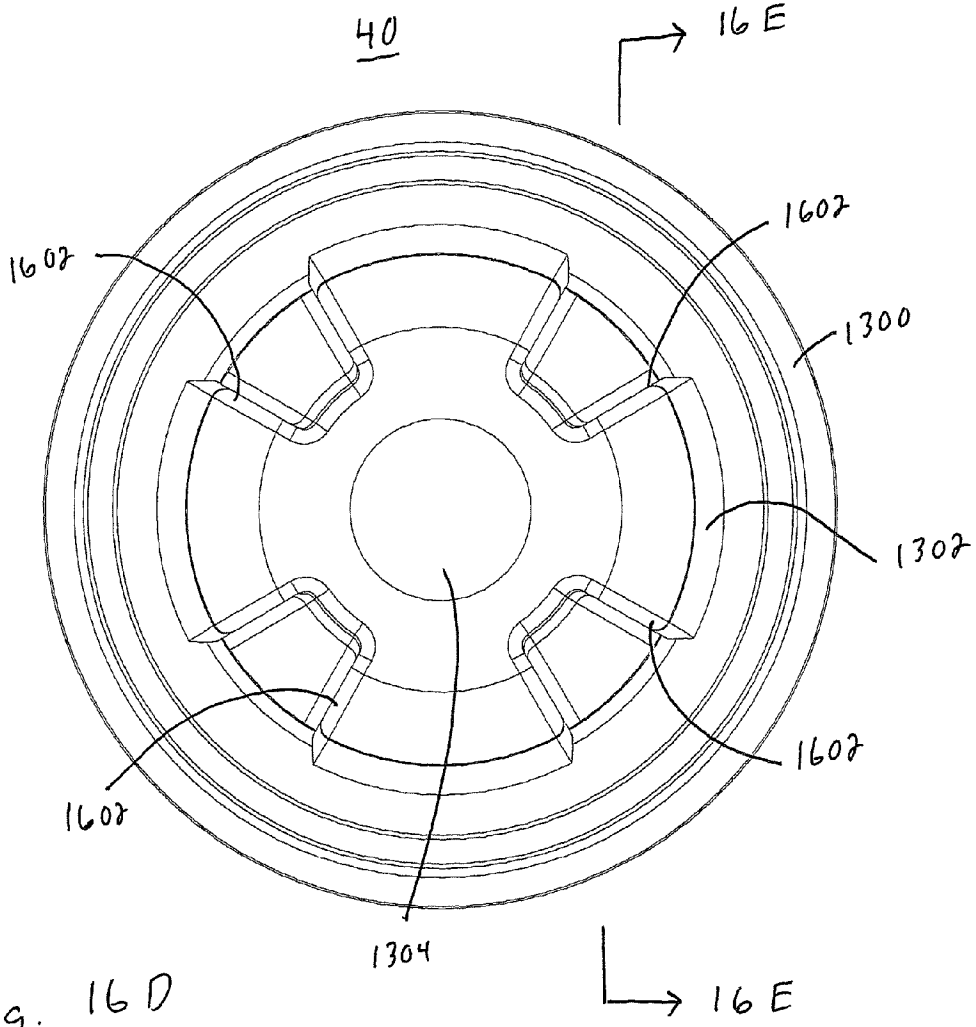
FIG. 16D is a bottom view of the piston illustrated by FIG. 16A.
Figure 16E:
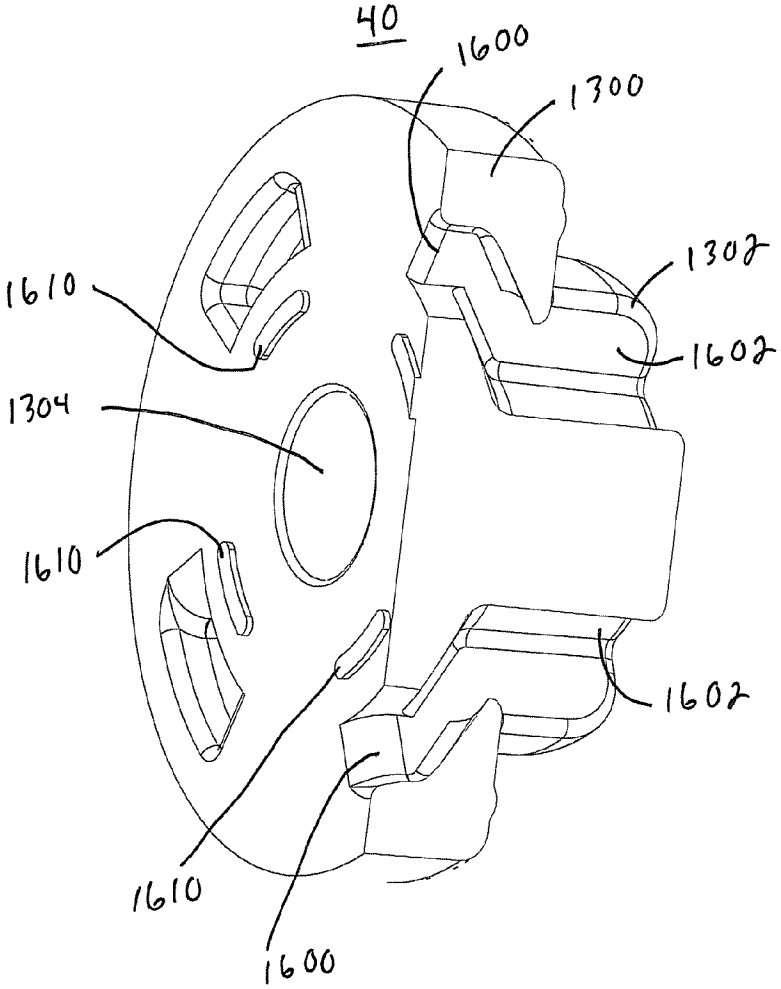
FIG. 16E is a sectioned perspective view taken along the plane indicated by lines 16E-16E in FIG. 16D.
Figure 16F:
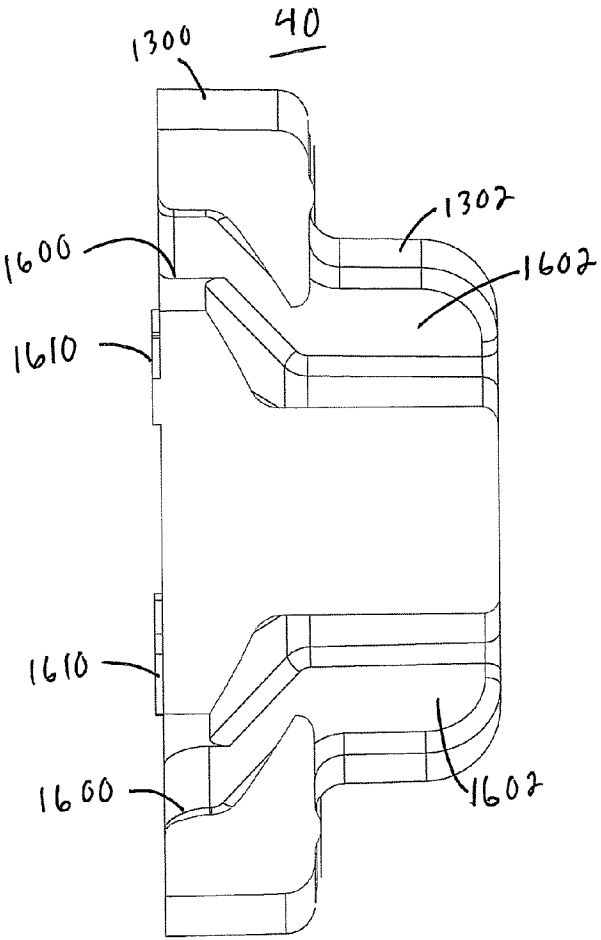
FIG. 16F is a sectional view taken along the plane indicated by lines 16E-16E in FIG. 16D.
Figure 17A:
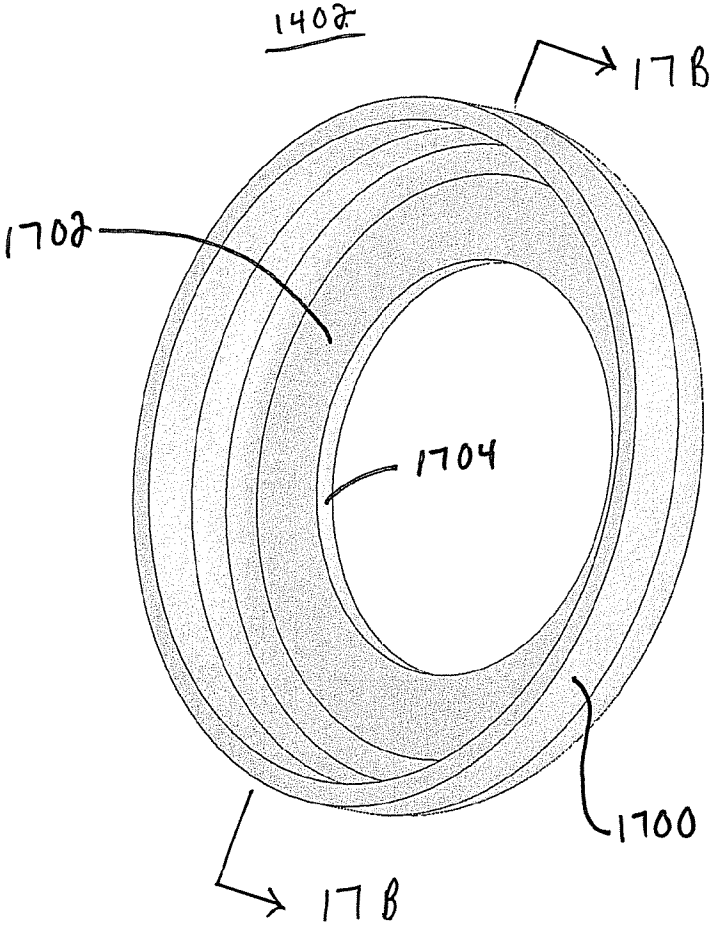
FIG. 17A is a perspective view of an exemplary embodiment of a piston seal.
Figure 17B:
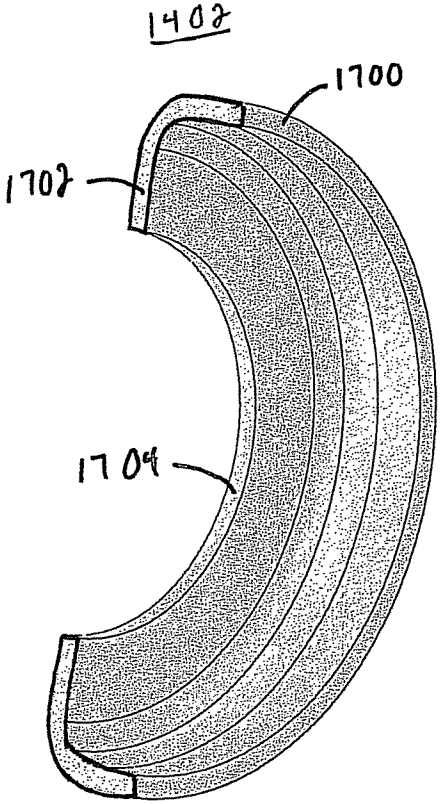
FIG. 17B is a sectioned perspective view taken along the plane indicated by lines 17B-17B in FIG. 17A.

Referring to FIGS. 16A-16F, the illustrated piston 40 includes a disk shaped portion 1300 and a base or mounting portion 1302 having a diameter that is smaller than the diameter of the cylindrical portion 1300. A mounting hole 1304 extends through the piston 40. The mounting hole 1304 allows the valve 1404 to be secured to the piston 40 and allows the piston 40 to be connected to the connecting rod 52. Referring to FIGS. 16E and 16F, a plurality of passages 1600 extend through the disk shaped portion 1300 to channels 1602 in the side of the mounting portion 1302. These passages 1600 and channels 1602 act as the gas inlet (when the pumping device is configured as a compressor) or the gas exhaust (when the pumping device is configured as a vacuum). Four passages 1600 and channels 1602 are illustrated. However, any number of passages 1600 and/or channels 1602 can be included and can have any configuration. A plurality of valve locating projections 1610 are disposed on the disk shaped portion 1300. The valve locating projections 1610 align the intake valve 1404 with the passages 1600.

Referring to FIGS. 15A-15D, the illustrated connecting rod 52 includes a piston support portion 1500, an elongated rod portion 1502 and a ring portion 53. The illustrated piston support portion 1500 is cup shaped with a flat end 1510, an annular inner surface 1512, and an annular outer surface 1514. The annular inner surface 1512 is shaped to accept the base or mounting portion 1302 of the piston 40. A mounting hole 1524 extends into the elongated rod portion 1502 from a bottom interior surface 1526 of the piston support portion 1500. The mounting hole 1524 is in alignment with the mounting hole 1304 of the piston to facilitate connection of the piston 40 to the connecting rod 52. Referring to FIGS. 15A-15D, a plurality of passages 1560 extend through the piston support portion 1500. These passages 1560 allow gas to flow through the piston support portion 1500 to the passages 1600 and channels 1602 of the piston 40. Four passages 1560 are illustrated. However, any number of passages 1560 can be included and can have any configuration. An opening or vent 1670 (See FIG. 1A) may be provided in the housing that acts as the gas inlet (when the pumping device is configured as a compressor) and/or the gas exhaust (when the pumping device is configured as a vacuum).

The illustrated pistons 40A-40D are driven by a crankshaft 50 and connecting rods 52A-52D, as described below. The ring portion 53 pivotally connects each connecting rod 52A-52D to the crankshaft 50. The elongated rod portion 1502 connects the ring portion 53 to the piston support portion 1500. In the exemplary embodiment, a bearing 1406 is disposed inside each ring portion 53, around the crankshaft 50.

The seal or ring 1402 provides a seal between each piston 40A-40D and each cylinder 36A-36D. The seal or ring 1402 can take a wide variety of different forms. The illustrated seal or ring 1402 is cup shaped with an annular wall 1700 that meets an end wall 1702. An opening 1704 is disposed in the end wall 1702. The annular wall 1700 is sized to fit around the disk shaped portion 1300 of the piston 40. The opening 1704 is sized to fit around the mounting portion 1302 of the piston 40, with the end wall 1702 sandwiched between the disk shaped portion of the piston 40 and the piston support portion 1500 of the connecting rod 52.

The valve 1404 may take a wide variety of different forms. In the illustrated embodiment, where the pumping device 10 is configured as a compressor, the valve 1404 allows gas inside the housing 13 to flow through the support portion 1500 of the connecting rod 52 and the piston 40 into the cylinder 36, but prevents gas from flowing from the cylinder 36 back into the interior of the housing 13. In another embodiment, where the pumping device 10 is configured as a vacuum, the check valve 1404 would be configured to allow gas to flow from the cylinder, through the piston 40 and/or the support portion 1500 of the connecting rod 52, and into the housing 13, but prevent gas from flowing from the housing 13 into the cylinder 36 (See FIGS. 18A and 18B). In one exemplary embodiment, the check valve arrangements 1404 of the two pistons 40A, 40B are configured as a compressor (i.e. gas is drawn into the cylinders 36 from the housing for compression) and the check valve arrangement of the other two pistons are configured as a vacuum (i.e. force gas out of the cylinders into the housing).

Referring to FIG. 14C, the illustrated valve 1404 is a butterfly or flap valve. However, any type of check valve can be used. The illustrated valve includes a flap member 1420 and a fastener 1422. The fastener 1422 connects flap member 1420 to the piston 40. The flap member is disposed over the passages 1600 of the piston 40. When the pressure inside the housing 13 is higher than the pressure inside the cylinder 36 (i.e. during the charge stroke), flaps of the flap member 1420 flex away from the piston 40 to allow gas to flow from the housing, through the support portion 1500 of the connecting rod 52, through the piston 40, and into the cylinder 36. However, when the pressure inside the cylinder 36 is higher than the pressure inside the housing (i.e. during the compression stroke), the flap member 1420 seals against the piston 40 to prevent gas from flowing from the cylinder 36, through the piston 40, and into the housing 13. In an embodiment, where the pumping device 10 is configured as a vacuum, the valve 1404 may be positioned on the opposite side of the piston 40 or piston support portion 1500 to allow gas to flow from the cylinder, through the piston 40, and into the housing 13, but prevent gas from flowing from the housing 13 into the cylinder 40. In one exemplary embodiment, the valves 1404 of two pistons 40A, 40B are positioned on the illustrated side of the pistons, such that one side of the head plate assembly 100A is configured as a compressor (i.e. force gas out of the head plate assembly) and the valves 1404 of two pistons 40C, 40D are positioned on the opposite side of the pistons, such that the other head plate assembly 100B is configured as a vacuum (i.e. draw gas into the head plate assembly).

FIG. 14C illustrates assembly of the piston assembly 1400. The seal or ring 1402 is placed around the base or mounting portion 1302 of the piston 40. The base or mounting portion 1302 of the piston 40 is inserted into the support portion 1500 of the of the connecting rod 52, such that the seal 1402 is clamped between the piston 40 and the connecting rod 52. The valve 1404 is placed on the piston 40. The assembly is secured together with a fastener 1422. Bearings 1406 are installed in the ring portion 53 of the connecting rod 52 during installation on the crankshaft 50.

Figure 4:
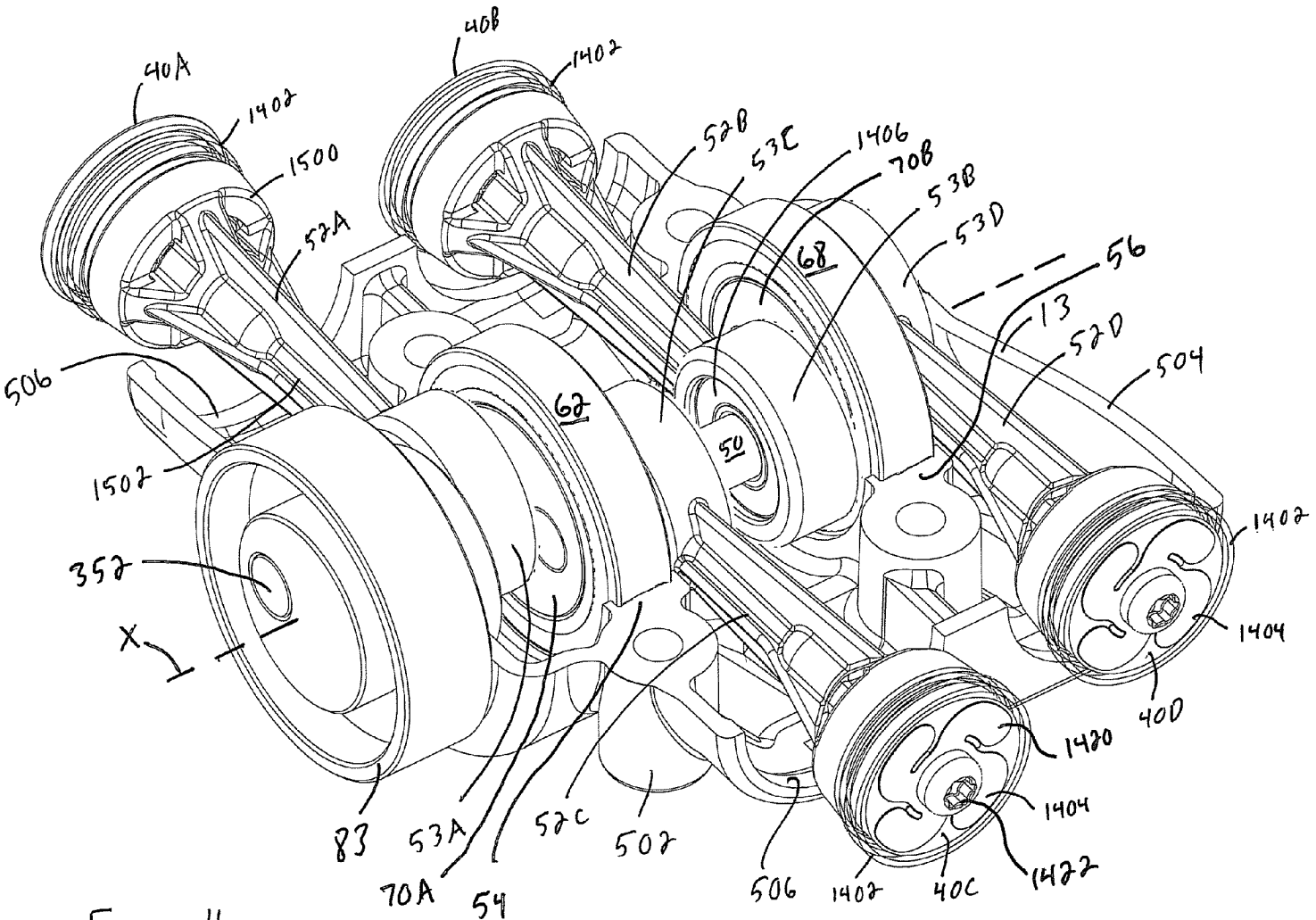
FIG. 4 is a perspective view of the pumping device illustrated by FIG. 1A with some components removed.

Referring to FIGS. 3A and 4, crankshaft 50 (described below in detail) is supported for rotation about a crank axis X in first and second bearings 62, 68. The first and second bearings 62, 68 are mounted to the housing 13 by first and second bearing supports 54 and 56. The illustrated bearing supports 54, 56 are molded as part of the housing 13. The illustrated supports 54, 56 and bearings 62, 68 are located between the ring portions 53A, 53C of the connecting rods 52A, 52C and between the ring portions 53B, 53D of the connecting rods 52B, 52D respectively. In another exemplary embodiment, the bearings 62, 68 are located outside the ring portions 53A of the connecting rod 52A and outside the ring portion 53D of the connecting rod 52D respectively, such that the bearings 62, 68 are positioned at either end of the housing 13.

Referring to FIG. 4, the crankshaft 50 forms part of a drive mechanism of the pumping device 10 for driving the pistons 40A-40D for movement in the cylinders 36A-36D. The drive mechanism includes a motor 81 (schematically illustrated by FIG. 1C) that drives the crankshaft 50, and the connecting rods 52A-52D. However, a wide variety of different drive mechanisms may be used. In other embodiments the crankshaft could be connected to the pistons or coupled to the pistons 40A-40D in other manners, for example with guides between the connecting rods 52A-52D and the pistons. The motor 81 may be coupled to the pulley 83 in a wide variety of different ways. For example, the motor 81 may be coupled to the pulley 83 by a belt or gears (the pulley 83 may be replaced with a gear). In the example illustrated by FIG. 1C, the motor 81 is coupled to the pulley 83 by a belt 85 and a drive pulley 87 attached to a motor output shaft. In another exemplary embodiment, an output shaft of the motor 81 may be directly connected to the crankshaft 50. For example, a motor housing may be fixed relative to the housing 13, the output shaft of the motor 81 may be aligned with and rotate about axis X, and the crank shaft portion 84A is connected to the output shaft of the motor.

In one exemplary embodiment, the drive pulley 87 is driven at a high speed. For example, the drive pulley 87 may be driven at 8,000 to 12,000 rpm, 9,000 to 11,000 rpm, or about 10,000 rpm. In the illustrated embodiment, the drive pulley 87 is much smaller than the pulley 83. This allows the crankshaft 50 to be driven with a much smaller motor 81. For example, the ratio of the diameter of the pulley 83 to the pulley 87 may be about 4:1, about 3:1, or about 2:1. The pulley 83 and crankshaft 50 may be driven at 2,000 to 4,000 rpm, 2,500 to 3,500 rpm, or about 3,000 rpm.

FIGS. 13A-13D illustrate an exemplary embodiment of a crankshaft 50. In the embodiments illustrated by FIGS. 13A-13D, the crankshaft 50 is made from multiple pieces that are assembled together and can optionally be disassembled. However, the crankshaft 50 can be made from a single piece (or welded together to form a single piece). The illustrated crankshaft 50 includes first and second support portions 70A, 70B that each have a generally cylindrical configuration defined by a cylindrical outer surface centered on a crank axis X of the pumping device 10. The crankshaft 50 rotates about the crank axis X during operation of the pumping device 10. In the illustrated embodiment, the support portions 70A, 70B are disposed in the bearings 62, 68.

Figure 11A:
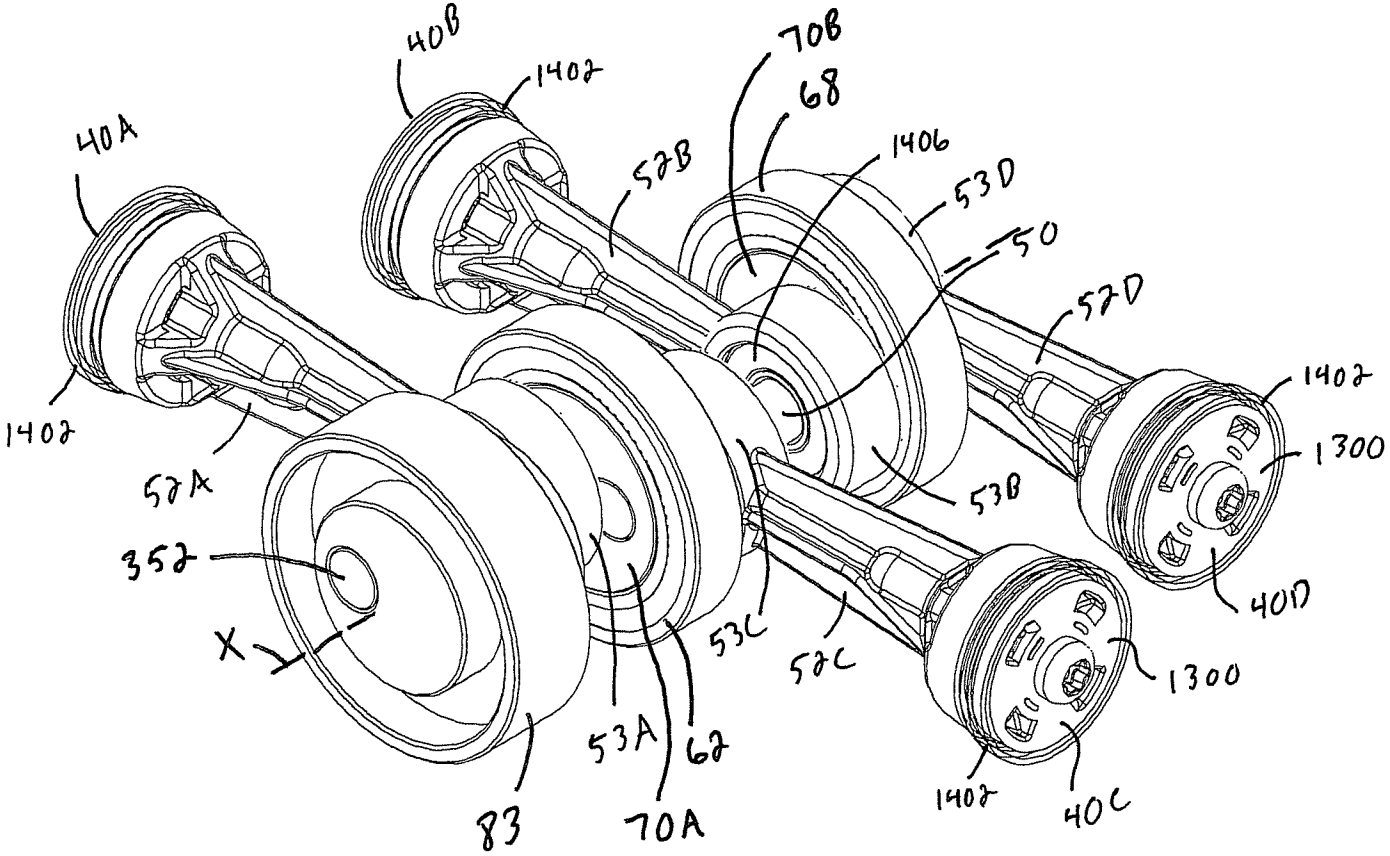
FIG. 11A is a perspective view of an exemplary embodiment of a crank and piston a assembly for a pumping device.
Figure 11B:
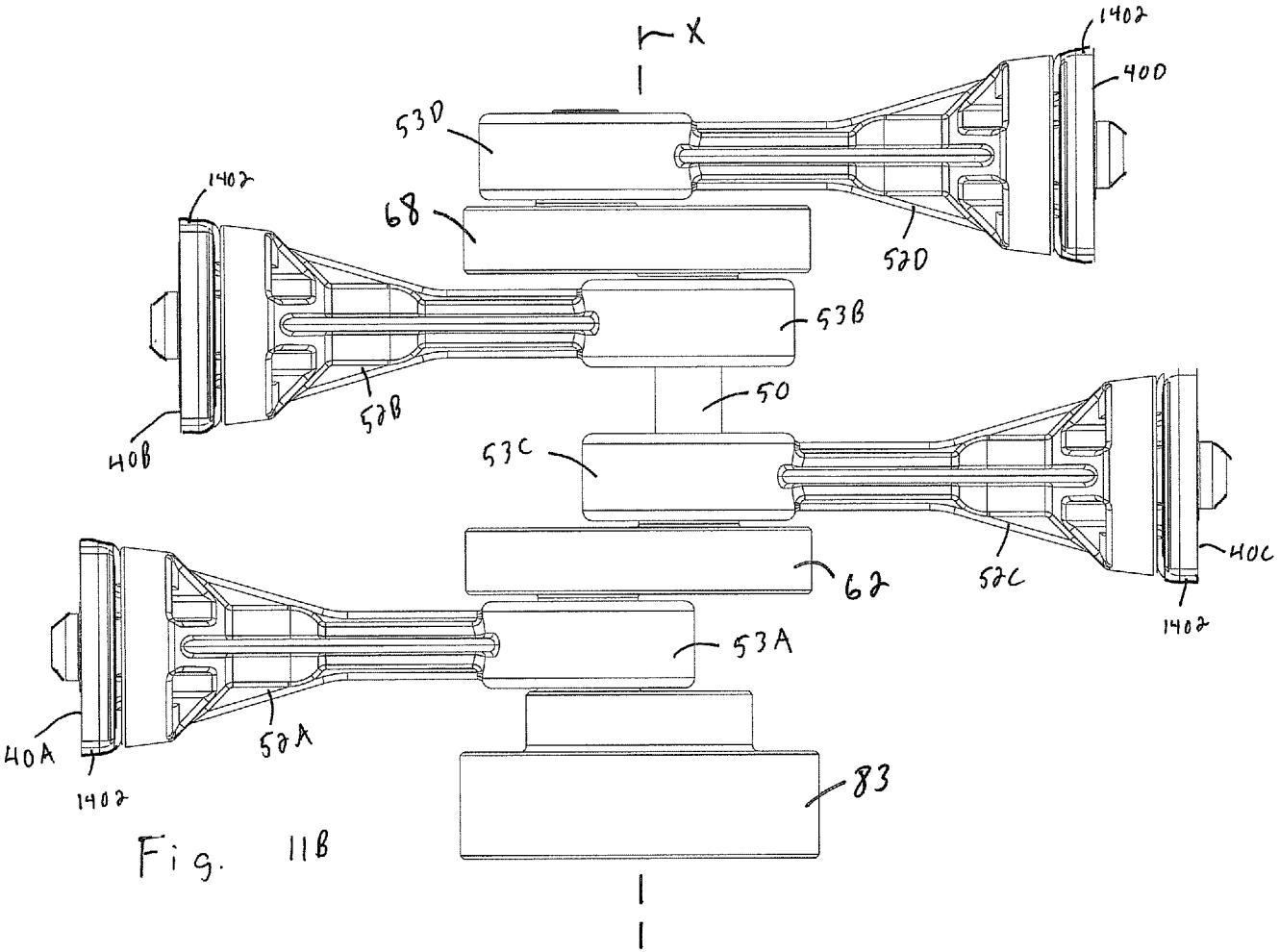
FIG. 11B is a top view of the crank and piston assembly illustrated by FIG. 11A.
Figure 11C:
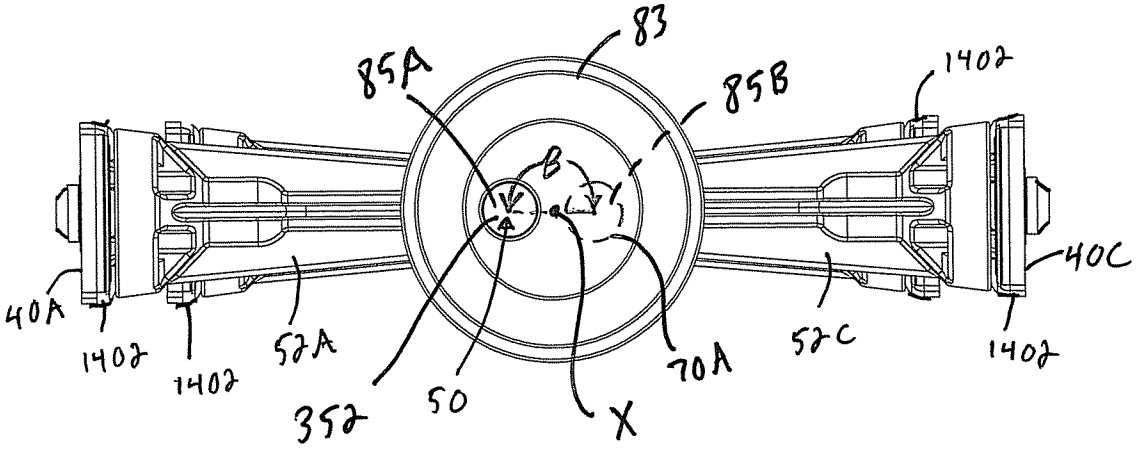
FIG. 11C is a front view of the piston and crank assembly illustrated by FIG. 11A.
Figure 11D:
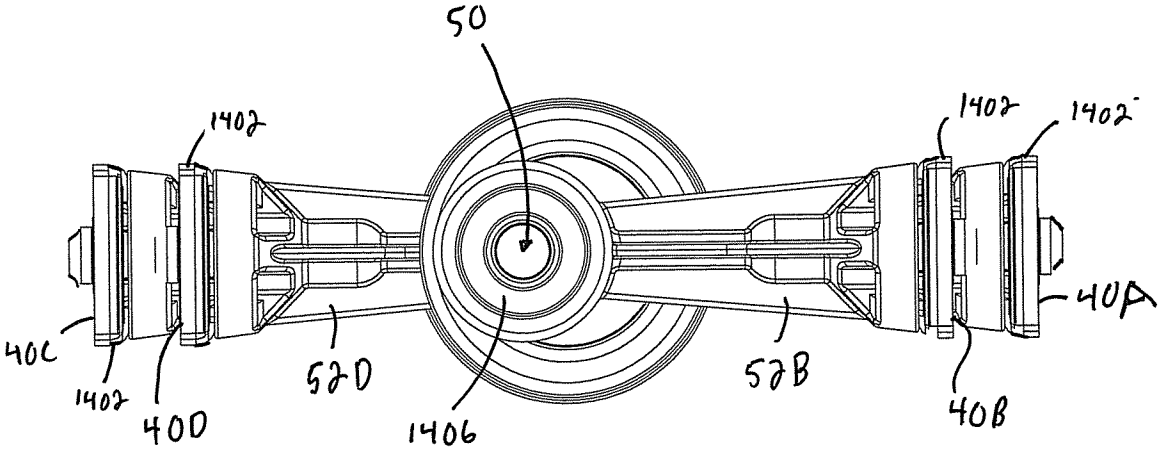
FIG. 11D is a rear view of the piston and crank assembly illustrated by FIG. 11A.
Figure 11E:
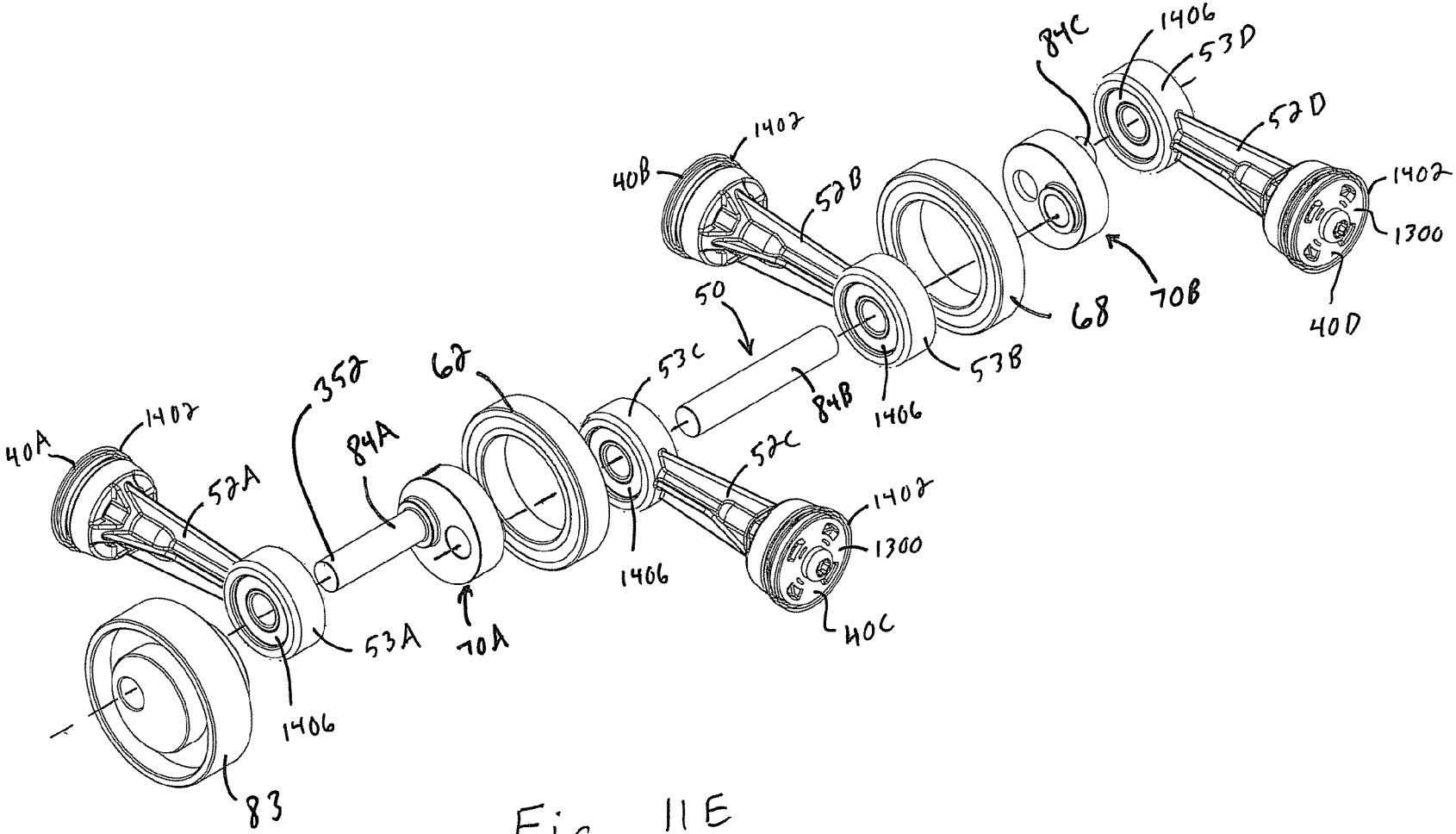
FIG. 11E is an exploded perspective view of the piston and crank assembly illustrated by FIG. 11A.
Figure 11F:
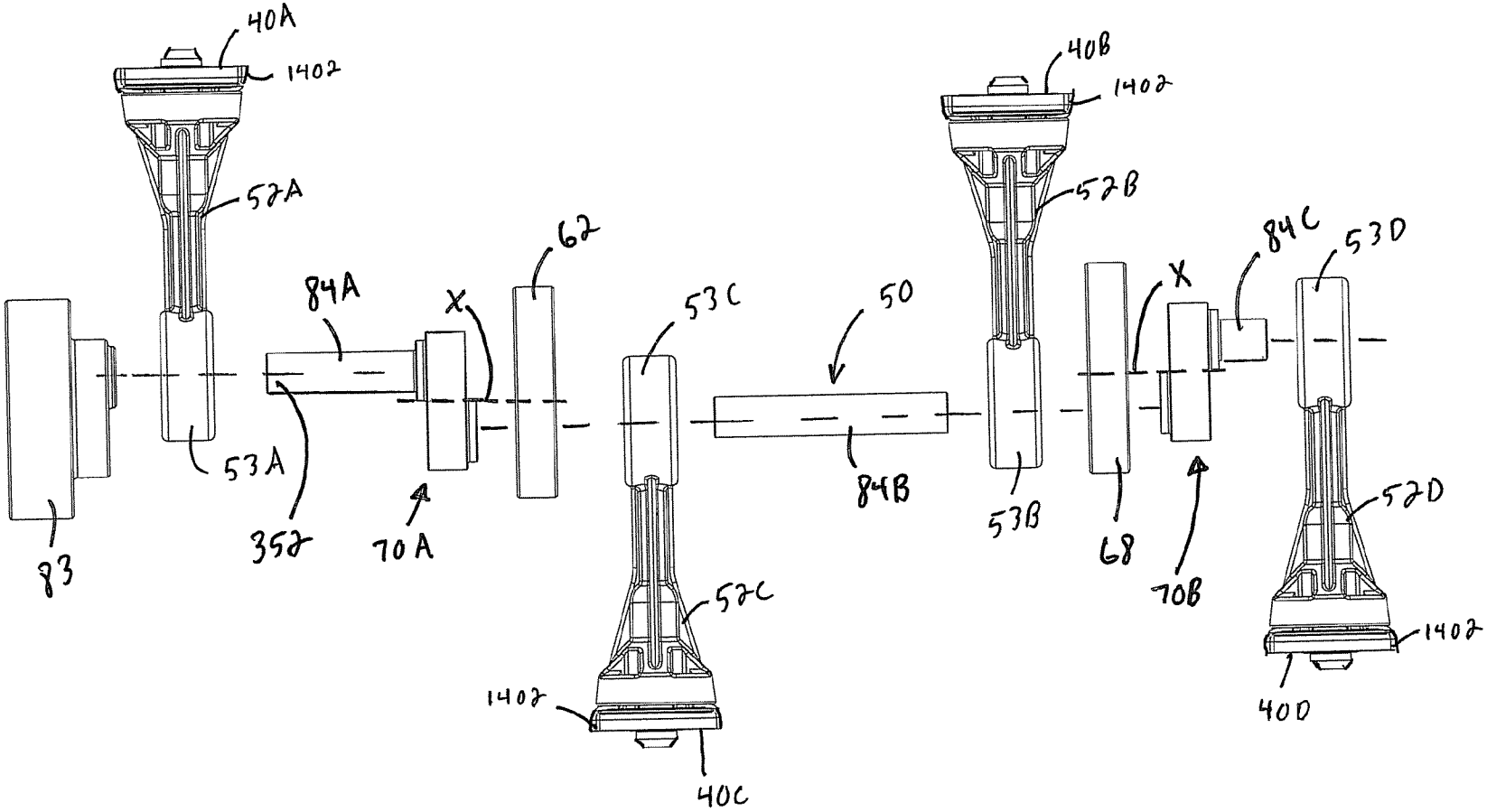
FIG. 11F is a top view of the exploded piston and crank assembly illustrated by FIG. 11E.
Figure 12:
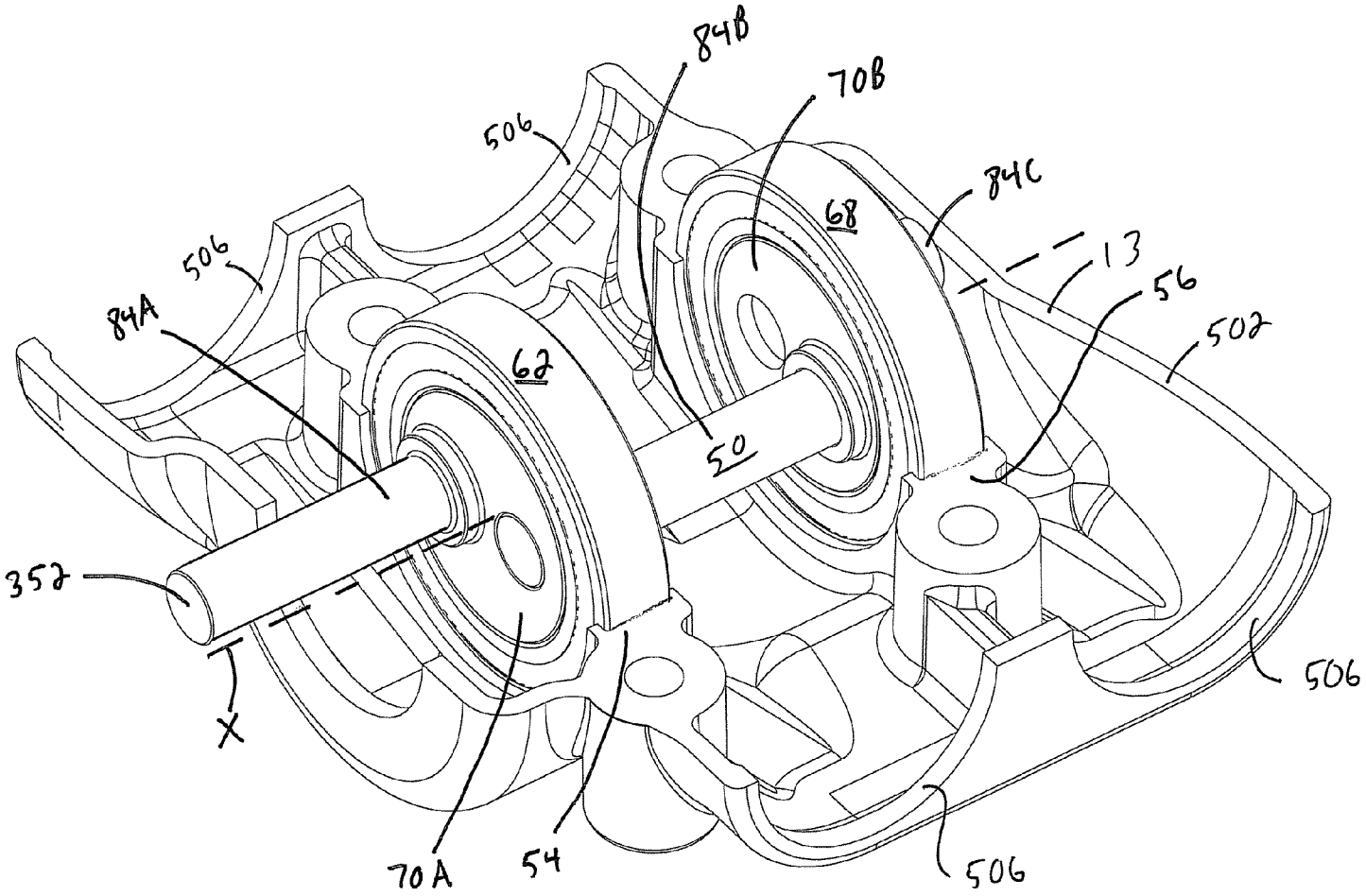
FIG. 12 is a perspective view of a crankshaft in a portion of a housing.
Figure 13A:
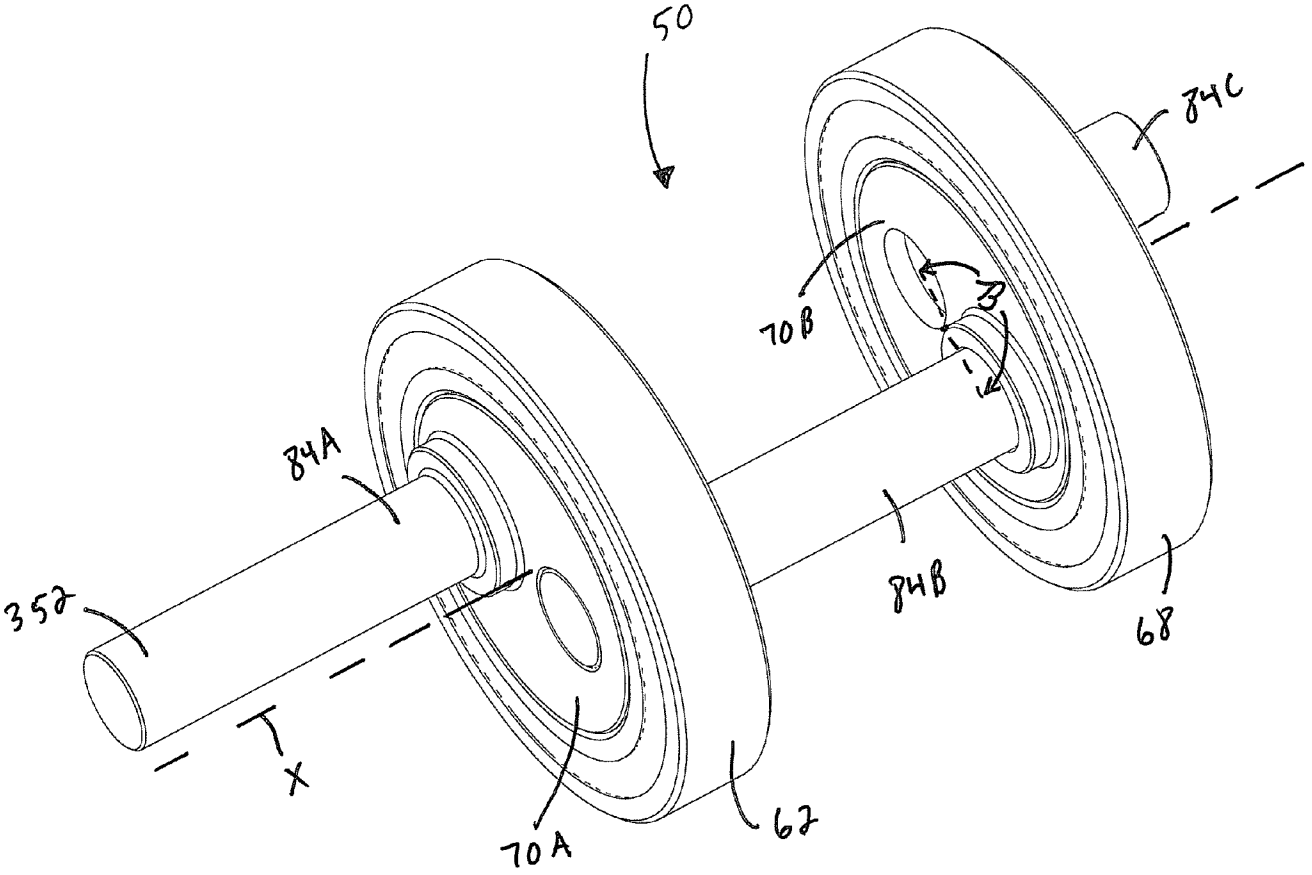
FIG. 13A is a perspective view of a crankshaft assembly
Figure 13B:
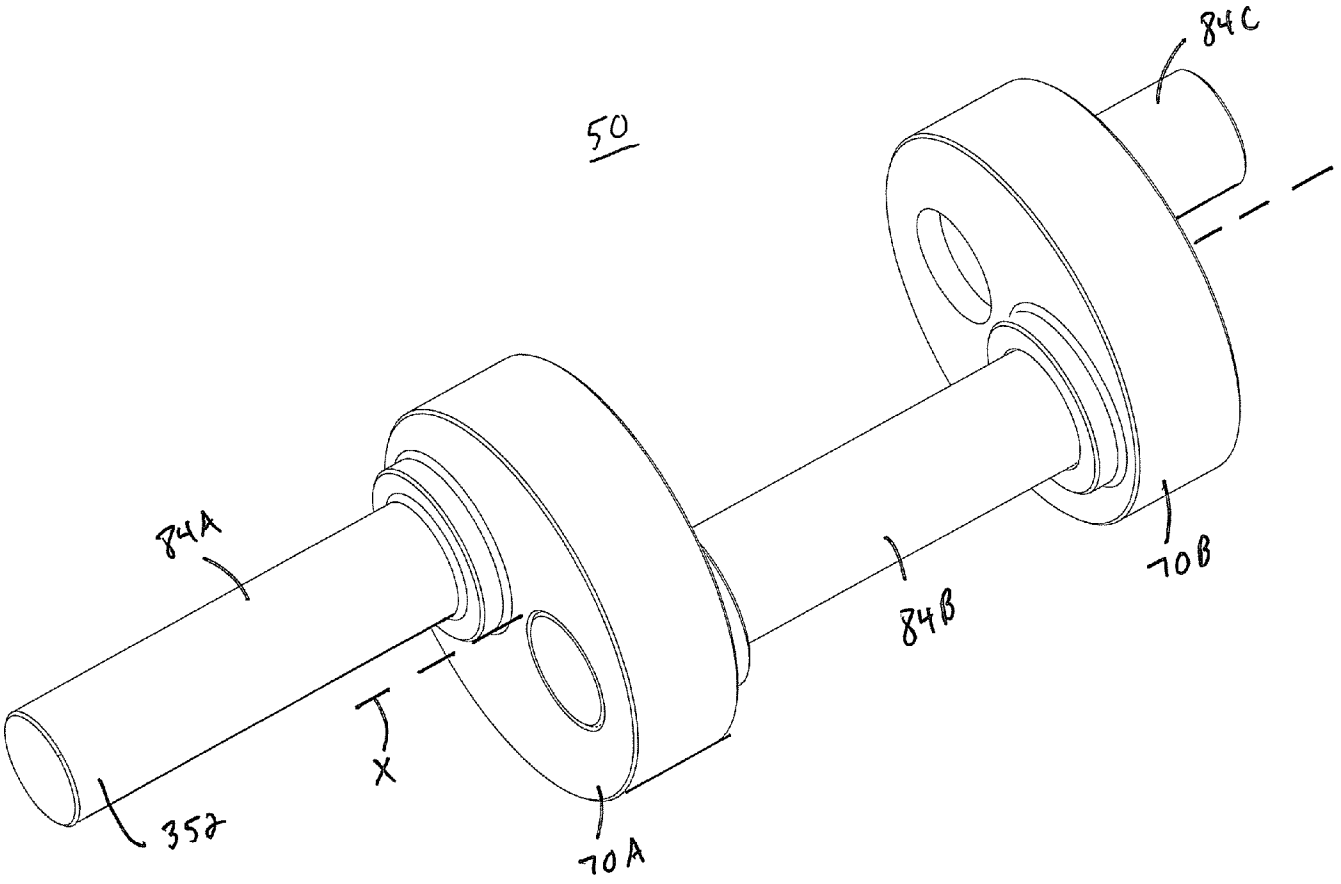
FIG. 13B is a perspective view similar to FIG. 13A with bearings removed from the crankshaft.
Figure 13C:
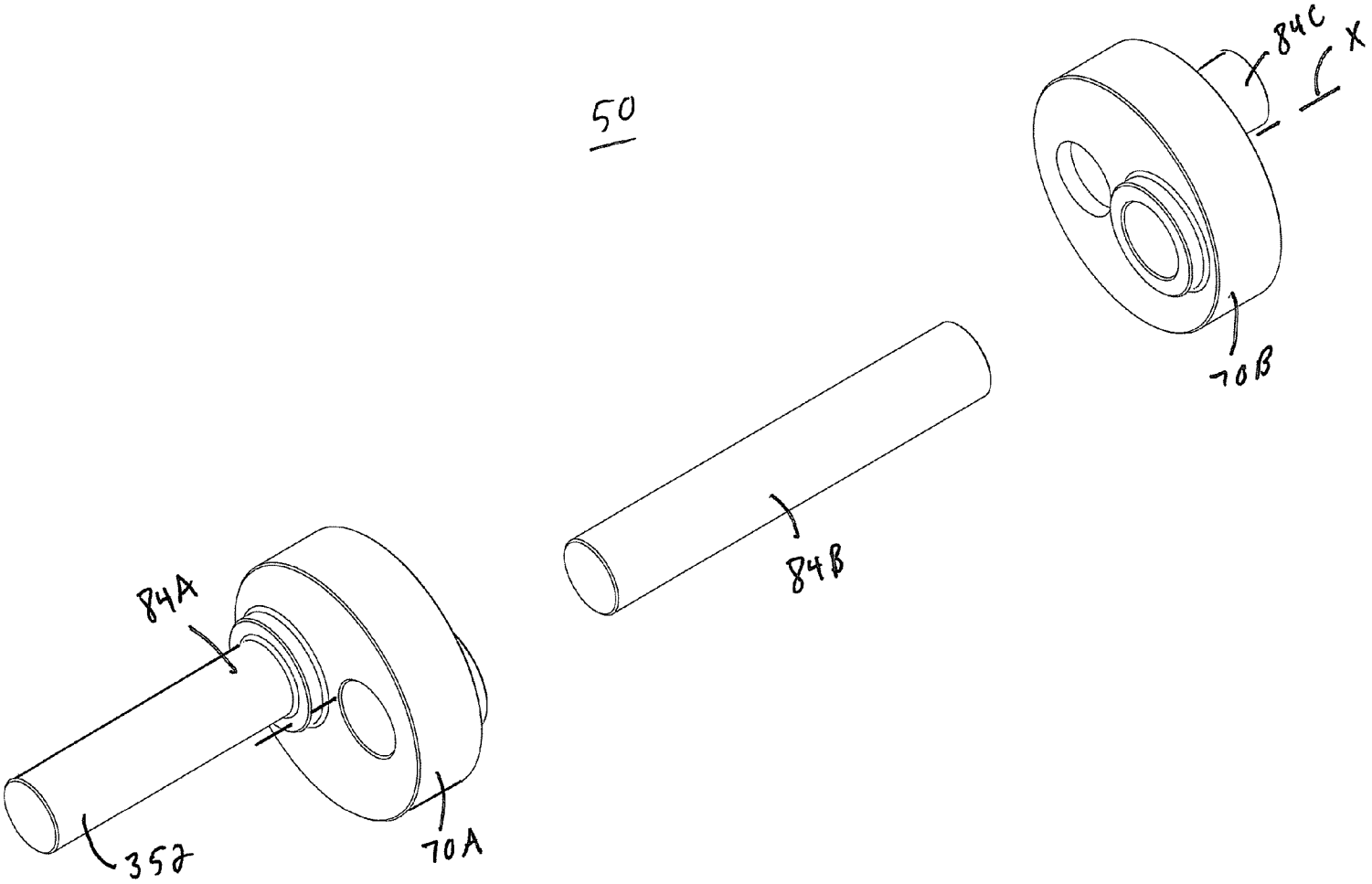
FIG. 13C is an exploded perspective view of the crankshaft illustrated by FIG. 13B.
Figure 13D:
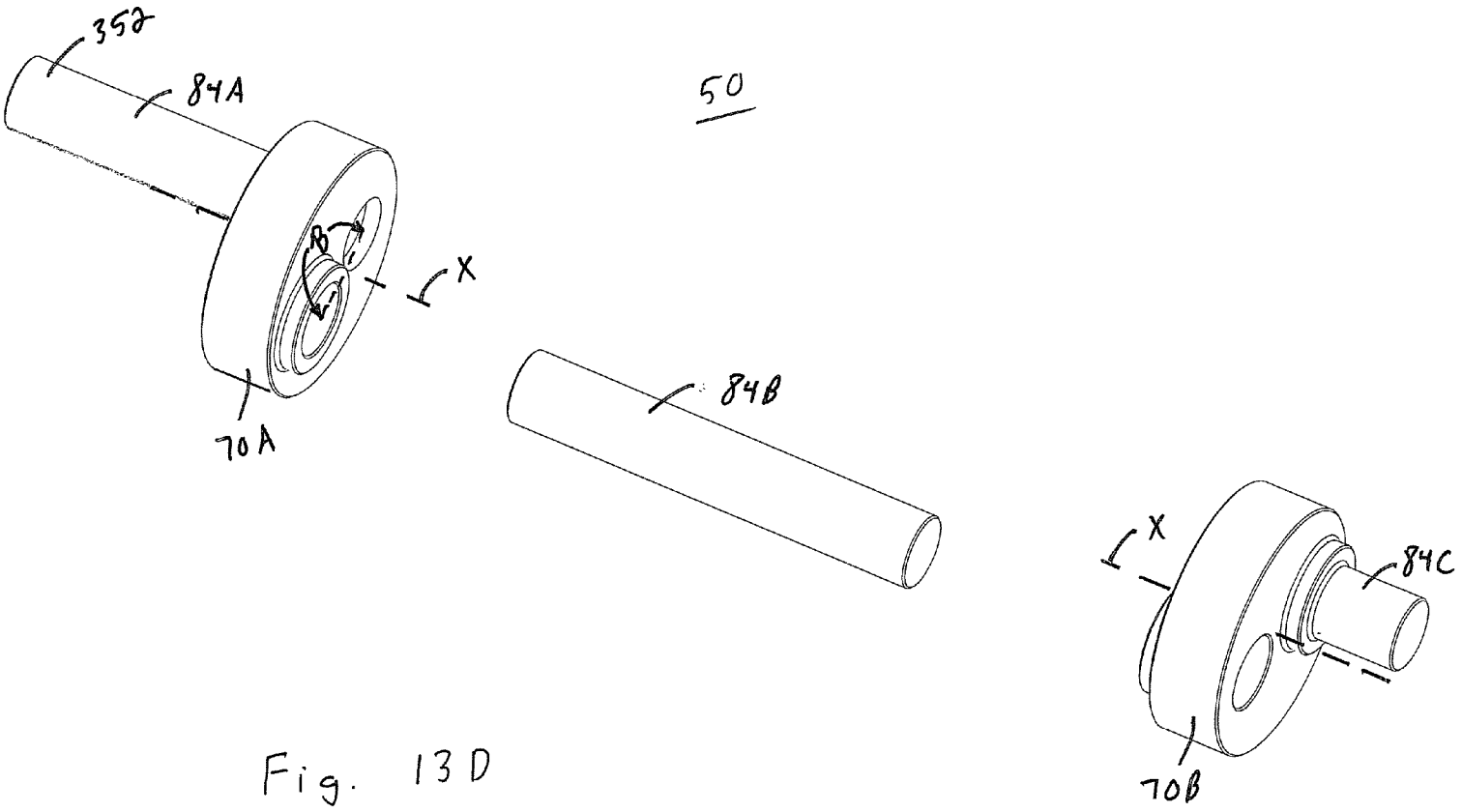
FIG. 13D is another exploded perspective view of the crankshaft illustrated by FIG. 13B.
Figure 14A:
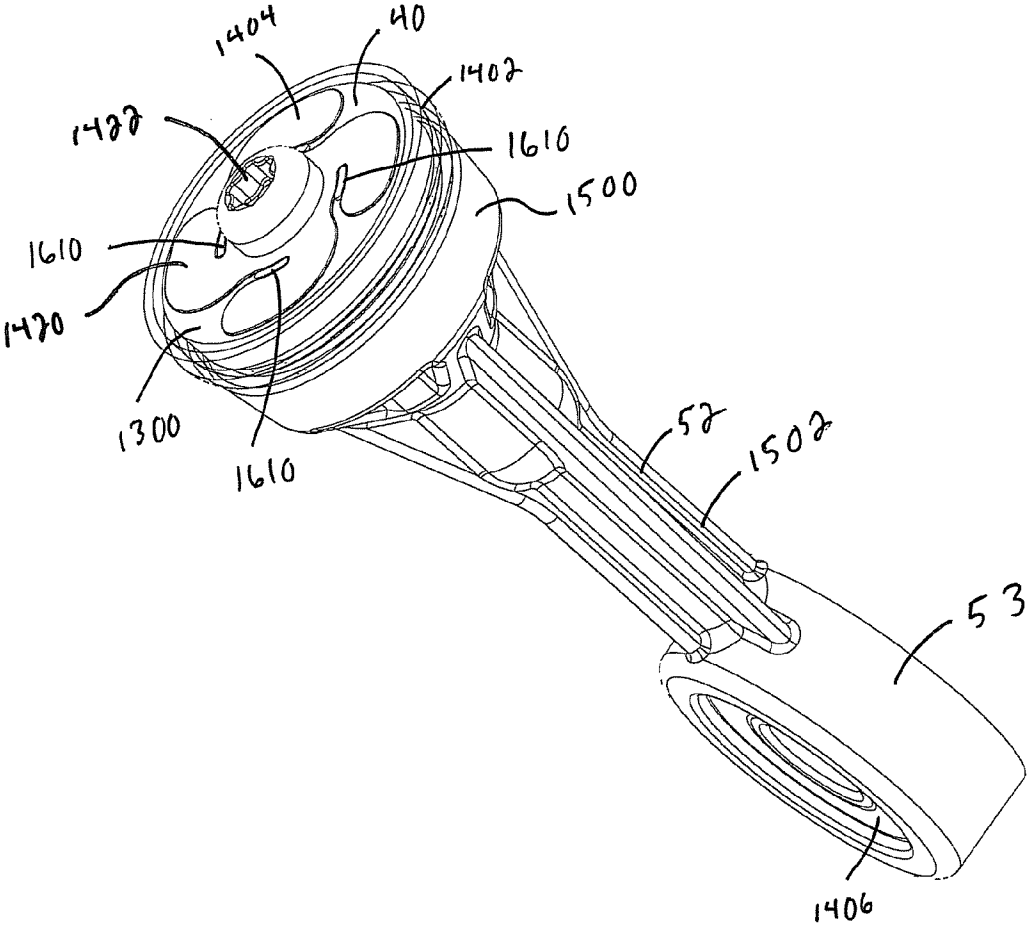
FIG. 14A is a perspective view of an exemplary embodiment of a piston assembly.
Figure 14B:
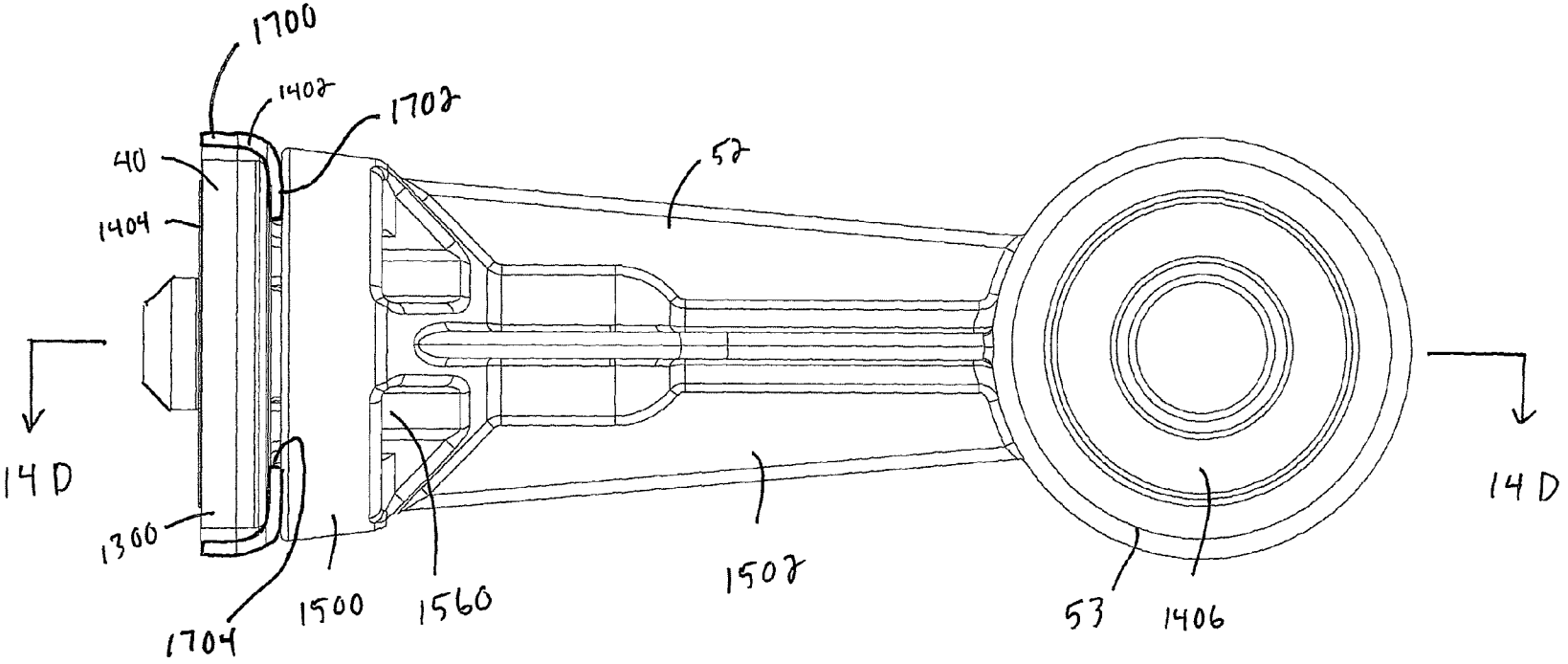
FIG. 14B is a side view of the piston assembly illustrated by FIG. 14A.
Figure 14D:
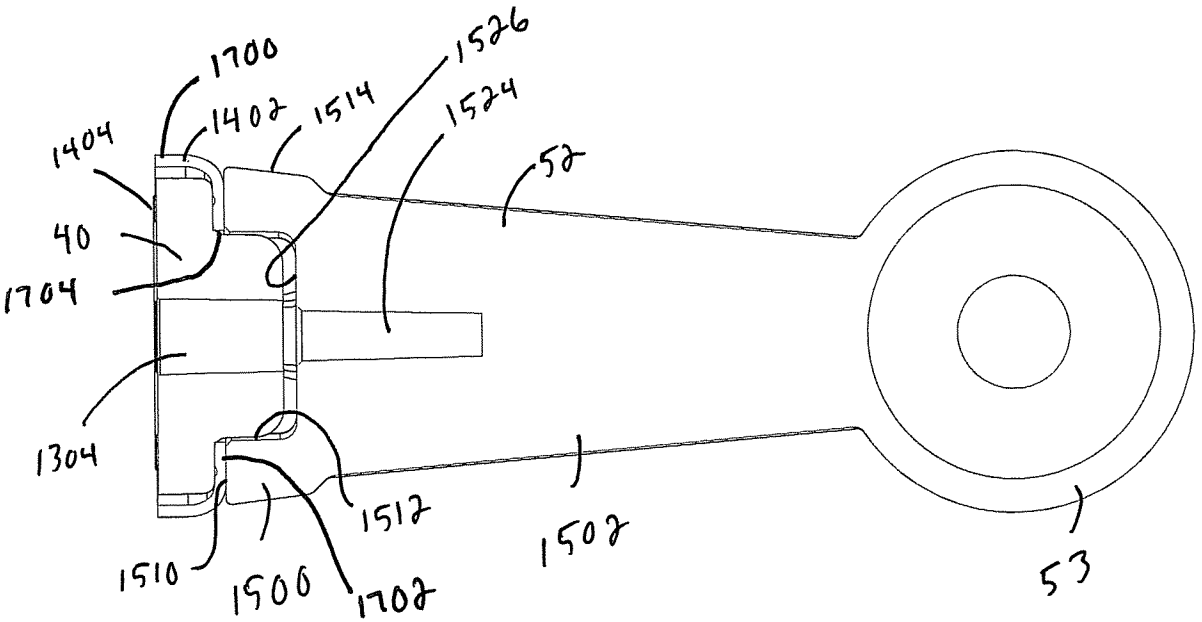
FIG. 14D is a sectional view taken along the plane indicated by lines 14D-14D in FIG. 14B.
Figure 15A:
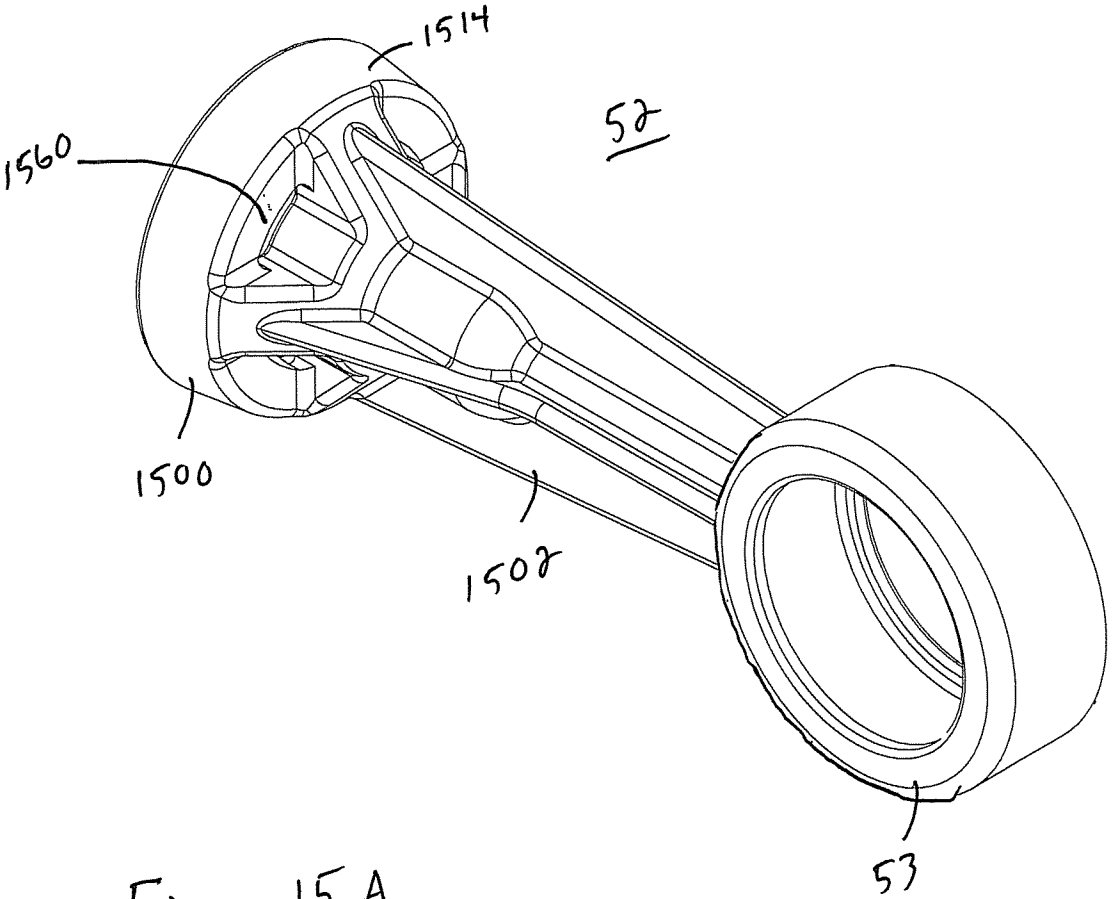
FIG. 15A is a perspective view of an exemplary embodiment of a piston rod.
Figure 15B:
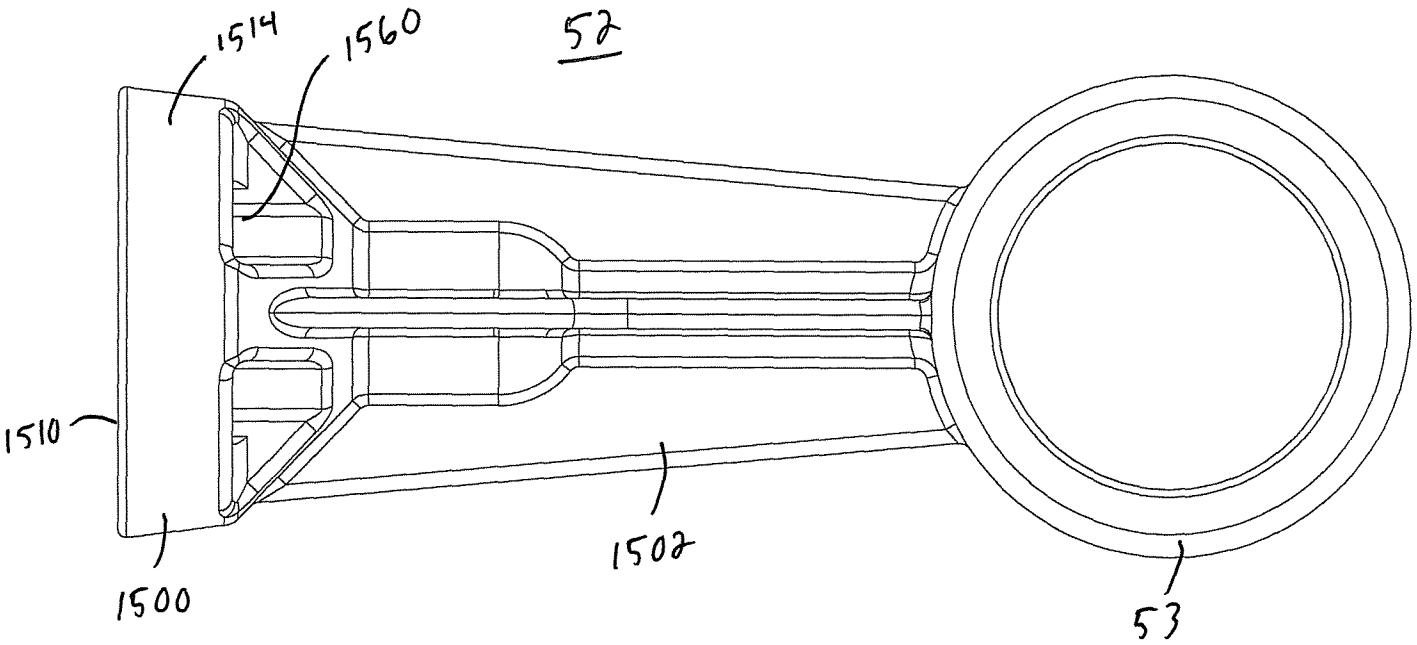
FIG. 15B is a side view of the piston rod illustrated by FIG. 15A.
Figure 15C:
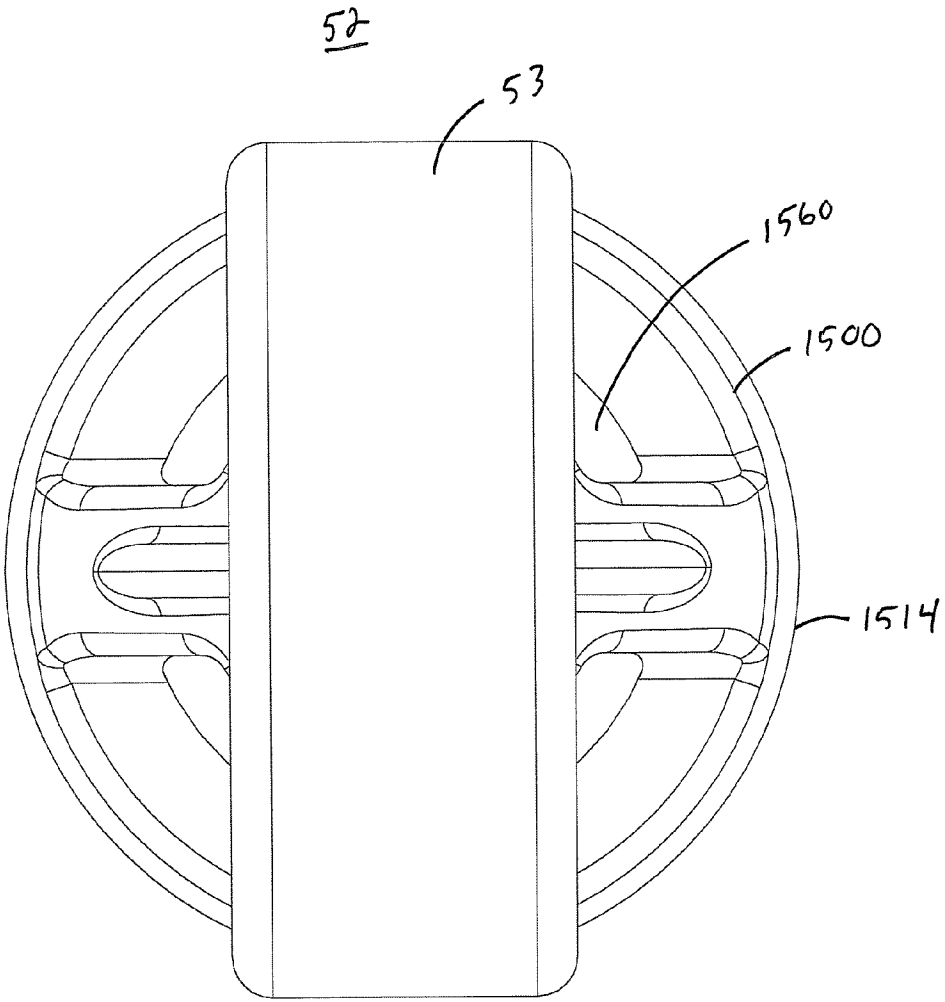
FIG. 15C is a bottom view of the piston rod illustrated by FIG. 15A.
Figure 15D:
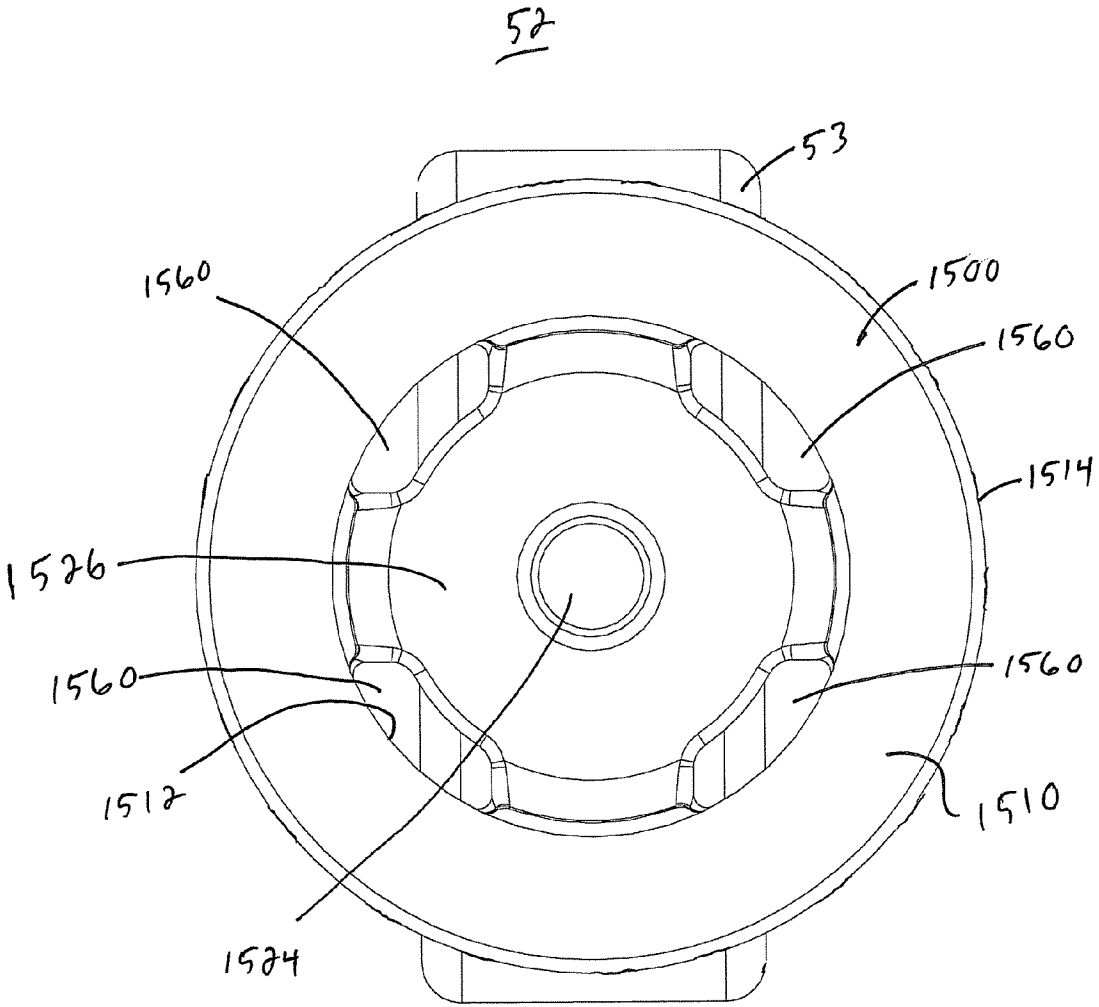
FIG. 15D is a top view of the piston rod illustrated by FIG. 15A.

Referring to FIGS. 13A-13D, in the illustrated embodiments, the crankshaft 50 also includes first, second, and third connecting rod driving shaft portions 84A, 84B, 84C that extend axially from and are eccentric to the crank axis X. Each of the eccentric shaft portions 84A, 84B, 84C has a cylindrical configuration with each cylinder having a central axis that is parallel to, but spaced apart from the crank axis X. In the illustrated embodiments, the central axis of the shaft portions 84A, 84B, 84C are positioned away from the crank axis X by the same distance. In the illustrated embodiment, the axis 85A is aligned with the axis 85C and an angle β of approximately 180 degrees (See FIG. 11C) is formed between the central axes 85A/85C, the crank axis X, and the central axis 85B. However, the shaft portions 84A, 84B, 84C can be positioned with respect to the crank axis in any manner to achieve desired motions of the piston rods 52A-52D that are coupled to the shaft portions. In the illustrated embodiment, the support portions 70A, 70B that are mounted in the bearings 62, 68 have a diameter that is greater than a diameter of the cylindrical connecting rod driving shaft portions 84A, 84B, 84C.

Referring to FIG. 4, in an exemplary embodiment the first, second, and third cylindrical connecting rod driving shaft portions 84A, 84B, 84C are the only connecting rod driving bodies of the crankshaft. In this embodiment, the shaft portions 84A, 84C each drive a single connecting rod 54A, 54D, while the shaft portion 84B drives two connecting rods 54B, 54C. However, any number of connecting rod driving bodies can be included. For example, one connecting rod driving shaft portion may be included for each connecting rod.

The connecting rod driving shaft portions 84A, 84B, 84C may take a wide variety of different forms. In the embodiment illustrated by FIGS. 13A-13D, the connecting rod driving shaft portions 84A, 84C are each integrally formed with one of the support portions 70A, 70B and the shaft portion 84B is a separate shaft that is assembled with the support portions (See FIGS. 13C and 13D). However, the crankshaft 50 may be constructed in a wide variety of different ways. For example, the entire crankshaft can be integrally formed, for example, by casting or machining. In another example, the support portions 70A, 70B and the shaft portions 84A, 84B, and 84C can all be discrete parts that are assembled together.

In the embodiment illustrated by FIGS. 13A-13D, the connecting rod driving shaft portion 84A extends from the support portion 70A, the connecting rod driving shaft portion 84C extends from the support portion 70B, and the connecting rod driving shaft portion 84B extends between the support portion 70A and the support portion 70B.

Referring to FIGS. 11A-11F, a connecting rod 52A is connected between the piston 40A and the first eccentric shaft portion 84A. Connecting rods 52B, 52C are connected between the pistons 40B, 40C and the second eccentric shaft portion 84B. A connecting rod 52D is connected between the piston 40D and the third eccentric shaft portion 84C. In the illustrated embodiment, the ring 53A is disposed around the shaft portion 84A to rotatably connect the rod 52A to the shaft portion 84A. A bearing 1406 may be disposed between the ring 53A and the shaft 84A. The rings 53B, 53C are disposed around the shaft portion 84B to rotatably connect the rods 52B, 52C to the shaft portion 84B. Bearings 1406 may be disposed between the rings 53B, 53C and the shaft portion 84B. In the illustrated embodiment, the ring 53D is disposed around the shaft portion 84D to rotatably connect the rod 52D to the shaft portion 84C. A bearing 1406 may be disposed between the ring 53D and the shaft 84D.

Referring to FIGS. 3A and 4, the aligned shaft portions 84A, 84C drive the first and fourth pistons 40A, 40D. Due to the opposed or "boxer" configuration of the pistons, the motion of the fourth piston 40D follows or lags the motion of the first piston 40A by rotation of the crankshaft by 180 degrees in the illustrated embodiment. The shaft portion 84B drives both the second and third pistons 40B, 40C. Due to the angular spacing β of the second shaft portion 84B with respect the first and third shaft portions 84A, 84C about the crank axis X, the motion of the second piston 40B follows or lags the motion of the first piston 40A by rotation of the crankshaft by the angle of the angular spacing β (approximately 180 degrees in the illustrated embodiment). Due to the opposed or "boxer" configuration, the motion of the third piston 40C follows or lags the motion of the second piston 40B by rotation of the crankshaft by 180 degrees in the illustrated embodiment. As such, the first piston 40A is in phase with the third piston 40C and the second piston 40B is in phase with the fourth piston 40D, with the second and fourth pistons lagging the first and third pistons by 180 degrees. As such, when the first and third pistons 40A, 40C are closest to their respective head assemblies 110A, the second and fourth pistons 40B, 40D, are at their maximum distance from their respective head assemblies 110B (See FIG. 3A).

Figure 3C:
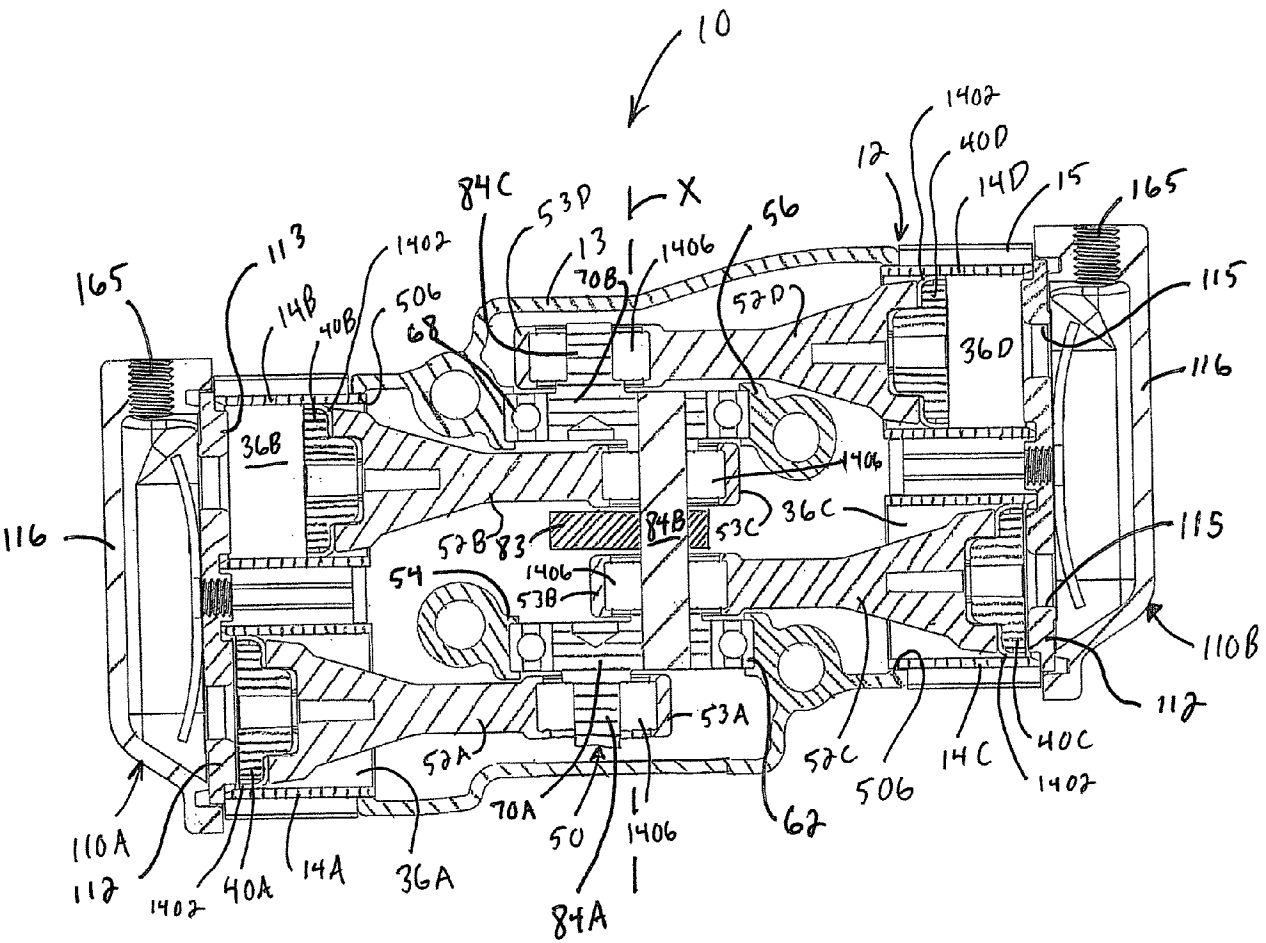
FIG. 3C is a view similar to FIG. 3A, illustrating an embodiment where a drive pulley of the pumping device is positioned inside a housing of the pumping device.

Rotation of the crankshaft 50 about the crank axis X results in reciprocating movement of pistons 40A-40D in the cylinders 36A-36D. Referring to FIG. 3A, in an exemplary embodiment the drive pulley 83 is connected to the crankshaft 50 to facilitate the application of a drive torque to reciprocate the pistons 40A-40D. The drive pulley 83 may be connected to the crankshaft 50 in a variety of different ways. The illustrated drive pulley is concentric with the support portions 70A, 70B. In the example illustrated by FIG. 3A, the drive pulley 83 is connected to an extended portion 352 of the shaft portion 84A. In this example, the pulley 83 is disposed outside the housing 13. In another embodiment, the pulley 83 may be disposed inside the housing. For example, in the example illustrated by FIG. 3C, the drive pulley 83 is connected to the shaft portion 84B. The drive pulley 83 illustrated by FIG. 3C is concentric with the axis X of the support portions 70A, 70B. With either illustrated pulley 83, rotation of the pulley 83 causes rotation of the crankshaft. In the example illustrated by FIG. 3C, a slot may be cut in the housing 13 to allow the pulley to be driven by a motor positioned outside the housing.

As shown in FIG. 1A, the pumping device 10 includes a pair of cylinder head assemblies 100A, 100B that are attached to the cylinder assembly 12. In the example illustrated by FIGS. 10A and 10B, each cylinder head assembly 100A, 100B includes a cylinder head plate 112, a check valve arrangement 114, and a sealed cover 116. The illustrated cylinder head plate 112 is configured to sealingly cover a pair of the cylinder sleeves 14A and 14B or 14C and 14D. In the illustrated embodiment, the cylinder head plate 112 includes a pair of circular projections 113 that fit within a corresponding pair of cylinder sleeves 14 (see FIG. 10B). A seal member, such as and o-ring or a gasket, may be used to provide a seal between each circular projection 113 and sleeve. A passage 115 is disposed through each projection, so that gas may selectively pass from each cylinder 36 through each head plate 112.

The illustrated cylinder head plate 112 is configured to sealingly cover a pair of the cylinder sleeves 14A and 14B or 14C and 14D. In the illustrated embodiment, the cylinder head plate 112 includes a pair of circular projections 113 that fit within a corresponding pair of cylinder sleeves. A seal member, such as and o-ring or a gasket, may be used to provide a seal between each circular projection 113 and sleeve. A passage 115 is disposed through each projection, so that gas may selectively pass from each cylinder through each head plate.

The check valve arrangement 114 may take a wide variety of different forms. In the illustrated embodiment, where the pumping device 10 is configured as a compressor, the check valve arrangement 114 allows gas to flow from each cylinder, through the head plate 112, and into an interior of the head plate assembly, but prevents gas from flowing from the head assembly 100A into the cylinders. In another embodiment, where the pumping device 10 is configured as a vacuum, the check valve arrangement 114 would be configured to allow gas to flow from the interior of the head assembly, through the head plate 112, and into the cylinders, but prevent gas from flowing from the cylinders into the head assembly 100A (see FIGS. 18A and 18B). In one exemplary embodiment, the check valve arrangement 114 of one head assembly 100A is configured as a compressor (i.e. force gas out of the head plate assembly) and the check valve arrangement of the other head assembly 100B is configured as a vacuum (i.e. draw gas into the head plate assembly).

Figure 10A:
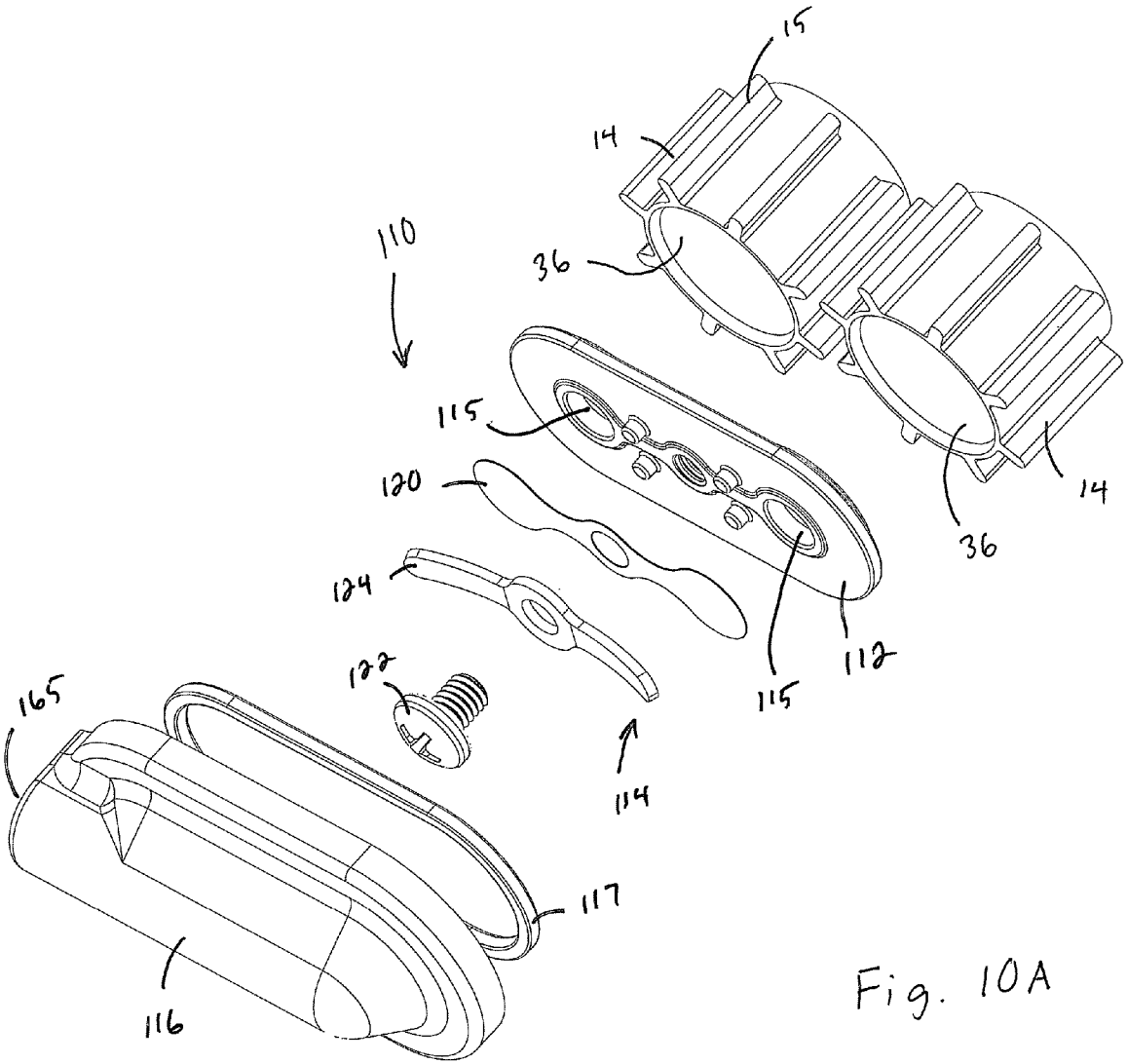
FIG. 10A is an exploded perspective view of an exemplary embodiment of a head and cylinder assembly for a pumping device.
Figure 10B:
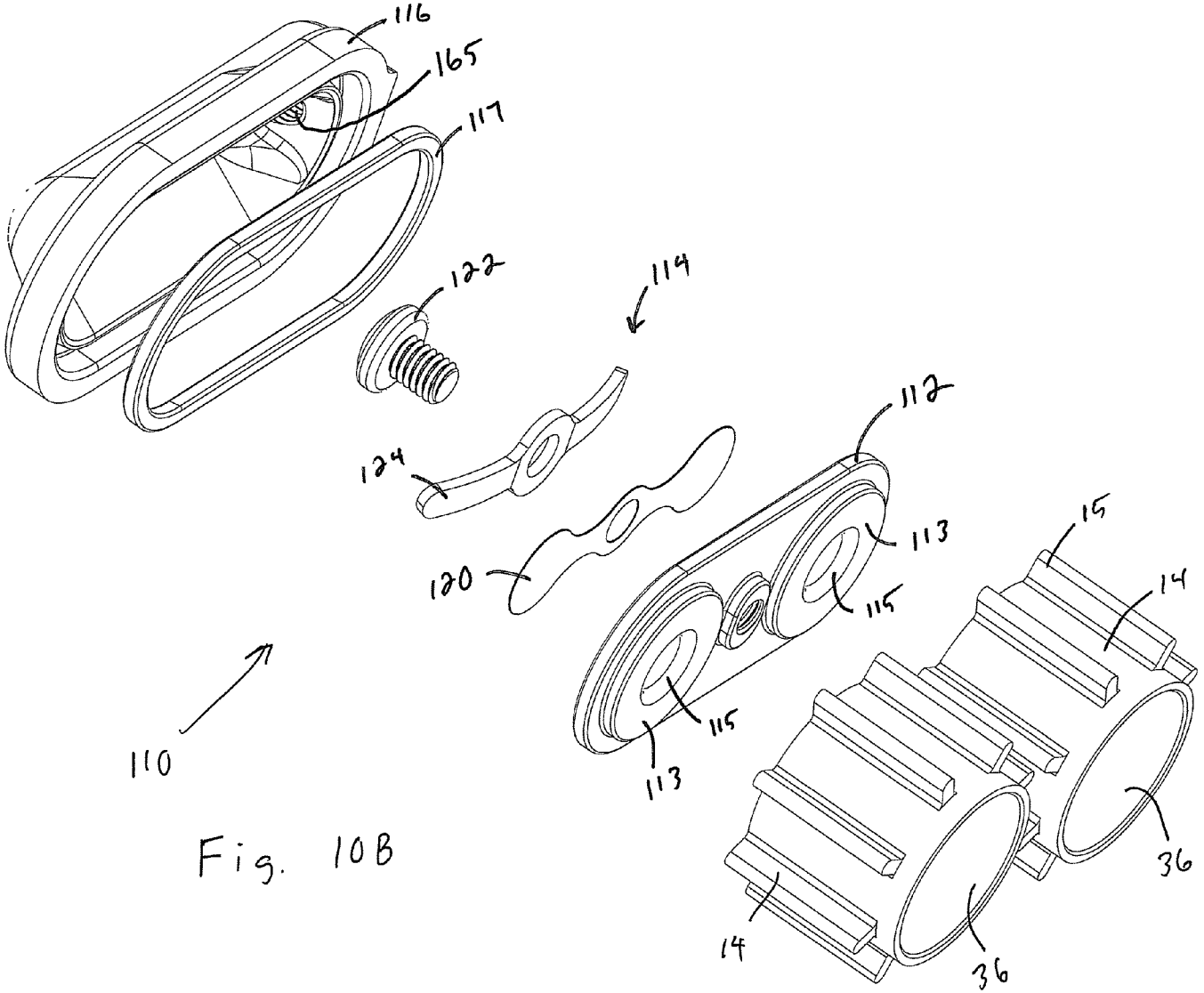
FIG. 10B is a second exploded perspective view of the head and cylinder assembly illustrated by FIG. 10A.

Referring to FIGS. 10A and 10B, the illustrated check valve arrangement 114 is a butterfly or flap valve. However, any type of check valve can be used. The illustrated check valve arrangement includes a flap member 120, a fastener 122, and a retainer 124. The fastener 122 connects the retainer 124 and the flap member 120 to the head plate. The retainer 124 positions the flap member and limits the amount of movement of flaps of the flap member 120. The flaps of the flap member 120 are disposed over the passages 115 of the head plate. When the pressure inside a cylinder is higher than the pressure inside the head assembly, the flap member 120 flexes away from the head plate 112 to allow gas to flow from the cylinder 36, through the head plate 112, and into an interior of the head plate assembly. However, when the pressure inside the head plate assembly is higher than the pressure inside the cylinder, the flap member 120 seals against the head plate 112 to prevent gas from flowing from the head assembly 110A into the cylinder 36.

In an embodiment where the pumping device 10 is configured as a vacuum, the check valve arrangement 114 may be positioned on the opposite side of the head plate 112 to allow gas to flow from the interior of the head assembly, through the head plate 112, and into the cylinders 36, but prevent gas from flowing from the cylinders into the head assembly 100A. In one exemplary embodiment, the check valve arrangement 114 of one head assembly 100A is positioned on the illustrated side of the head plate, such that one head assembly 100A of the pumping device 10 is configured as a compressor (i.e. force gas out of the head assembly through port 165) and the check valve arrangement is positioned on the opposite side of the head plate, such that the other head plate assembly 100B is configured as a vacuum (i.e. draw gas into the head plate assembly through port 165).

Figure 9:
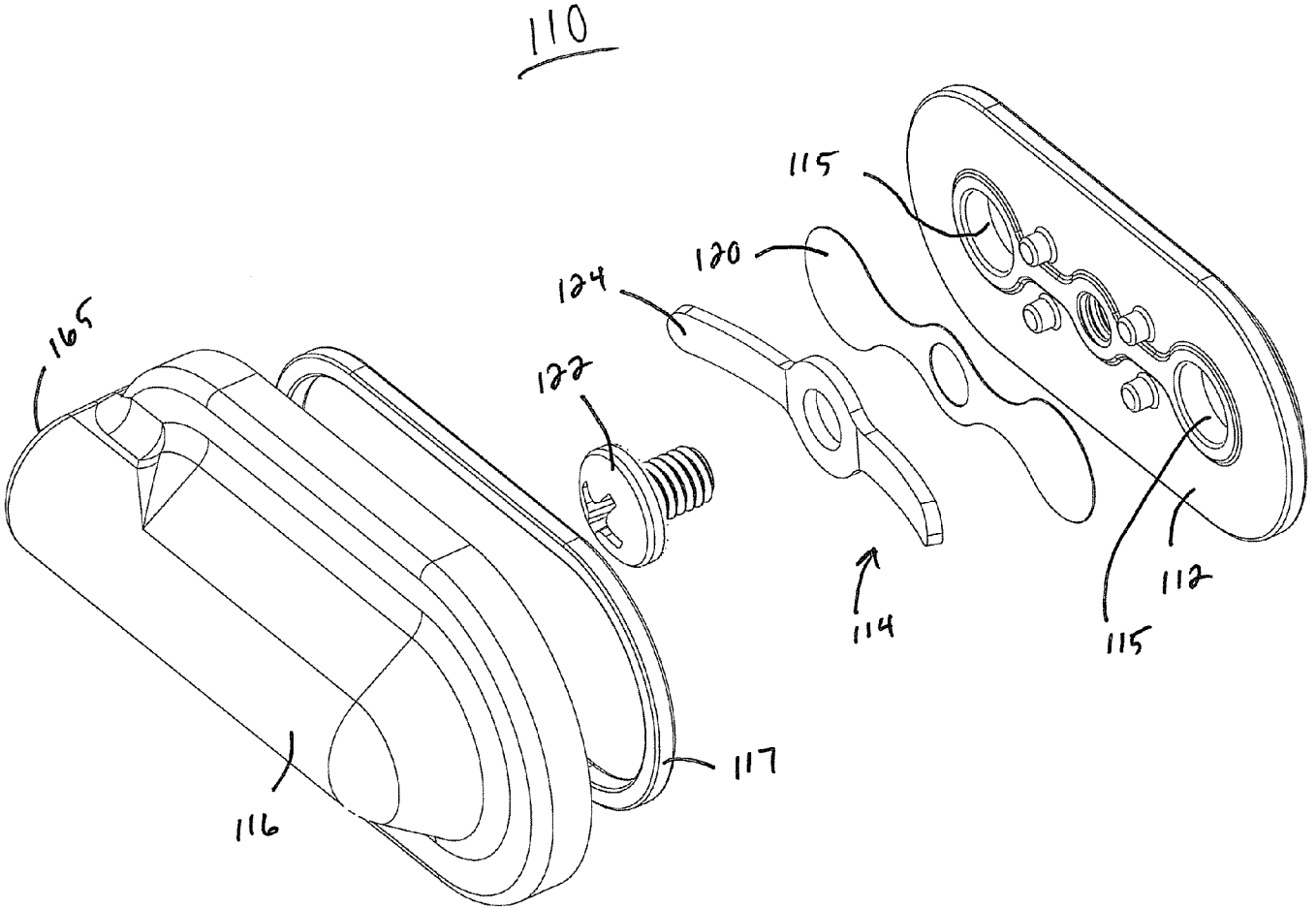
FIG. 9 is an exploded perspective view of an exemplary embodiment of a head assembly for a pumping device.

The cover 116 can take a wide variety of different forms. Referring to FIG. 9, the illustrated cover 116 is configured to sealingly cover the cylinder head plate 112. In the illustrated embodiment, cover 116 has a shape that matches the shape of the cylinder head plate 112. A seal member 117, such as and o-ring or a gasket, may be used to provide a seal between the cover 116 and the cylinder head plate 112 (see FIG. 9). A port 165 is disposed through the cover 116, so that gas may exit the cylinder head assembly 100A, 100B when the cylinder head assembly is configured for gas compression or so that gas may enter the cylinder head assembly 100A, 100B when the cylinder head assembly is configured to provide a vacuum.

Referring to FIG. 3A, when the first and third pistons 40A, 40B are in the compression stage, the second and fourth pistons 40C, 40D are in the intake stage. In the illustrated embodiment, the cylinders 36A-36D are not staged. That is, the output gas from one cylinder does not feed another cylinder that further compresses the gas. In the illustrated embodiment, the output of the first and second cylinders 36A, 36B is provided through the port 165 of the head assembly 110A and the output of the third and fourth cylinders 36C, 36D is provided through the port 165 of the head assembly 110B.

In the illustrated exemplary embodiment, each of the pistons 40A-40D operate in the cylinders 40A-40D in the same manner. Referring to FIG. 3A, when piston 40 is on the intake phase (for example, as the piston 40B moves to the illustrated position), the pressure in the cylinder 36 is lower than the intake pressure in the housing. As a result, intake gas flows through the inlet check valve 1404 (see FIGS. 14A and 14C) and into the cylinder 36. When the piston 40 thereafter is compressing the gas in the cylinder 36 (for example, as the piston 40A moves to the position illustrated by FIG. 3A), the pressure in the cylinder becomes higher than the intake pressure. As a result, intake gas can not flow through the check valve 1404 back into the housing 13. Also, the pressure in the cylinder 36 becomes higher than the pressure in the cylinder head assembly 100 during the compression stroke. As a result, compressed gas flows through the check valve arrangement 114, into the cylinder head assembly, and out the port 165. This cycle is repeated as the piston 40 reciprocates.

Figure 18B:
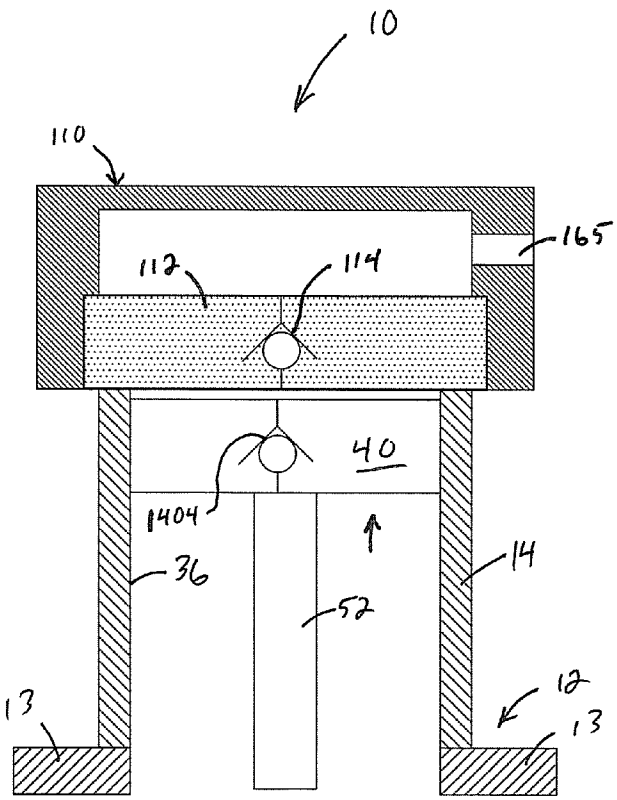
FIG. 18B is a schematic illustration of the pumping device illustrated by FIG. 18A in a second state.
Figure 18A:
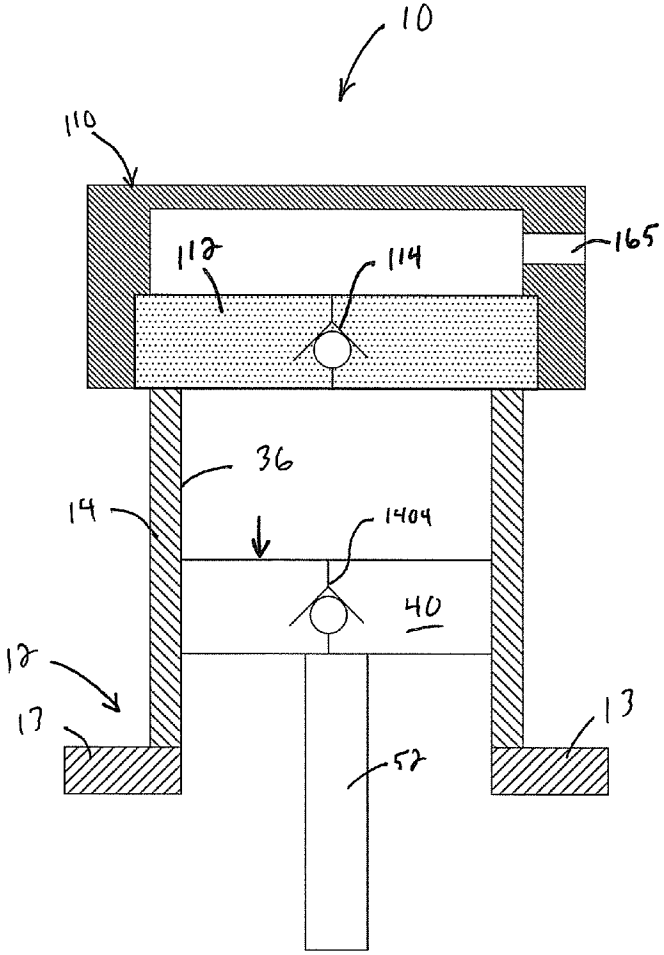
FIG. 18A is a schematic illustration of a pumping device configured to provide a vacuum in a first state.

FIGS. 18A and 18B schematically illustrate an embodiment where a piston 40 is operated to create a vacuum. One or more of the pistons 40 may be operated in the manner illustrated by FIGS. 18A and 18B (the head 100A would be partitioned if only one piston were used to create a vacuum). In this embodiment, when piston 40 is on a vacuum phase (see FIG. 18A) where the piston is moving toward the housing 13, the pressure in the cylinder 36 is lower than the pressure in the head assembly 100. As a result, gas is drawn by the piston 40 through the check valve 114 and into the cylinder 36. Referring to FIG. 18B, when the piston 40 thereafter is moving toward the head assembly 110, the pressure in the cylinder becomes greater than the pressure in the head assembly 110. As a result, gas cannot flow through the check valve 114 back into the head assembly 114. Also, the pressure in the cylinder 36 becomes higher than the pressure in the housing 13 during the stroke toward the housing. As a result, gas flows through the check valve 1404 and into the housing 13. This cycle is repeated as the piston 40 reciprocates.

The pumping device 10 described herein can be used in a wide variety of different applications. In one exemplary embodiment, the pumping device 10 is used to provide compressed air and/or vacuum to sieve beds of an oxygen concentrator. For example, the pumping device 10 can be used in any of the oxygen concentrators described by U.S. Pat. No. 4,449,990; 5,906,672; or 5,917,135. However, the pumping device 10 can be used in any type of oxygen concentrator. U.S. Pat. Nos. 4,449,990; 5,906,672; and 5,917,135 are incorporated herein by reference in their entirety.

Figure 19:
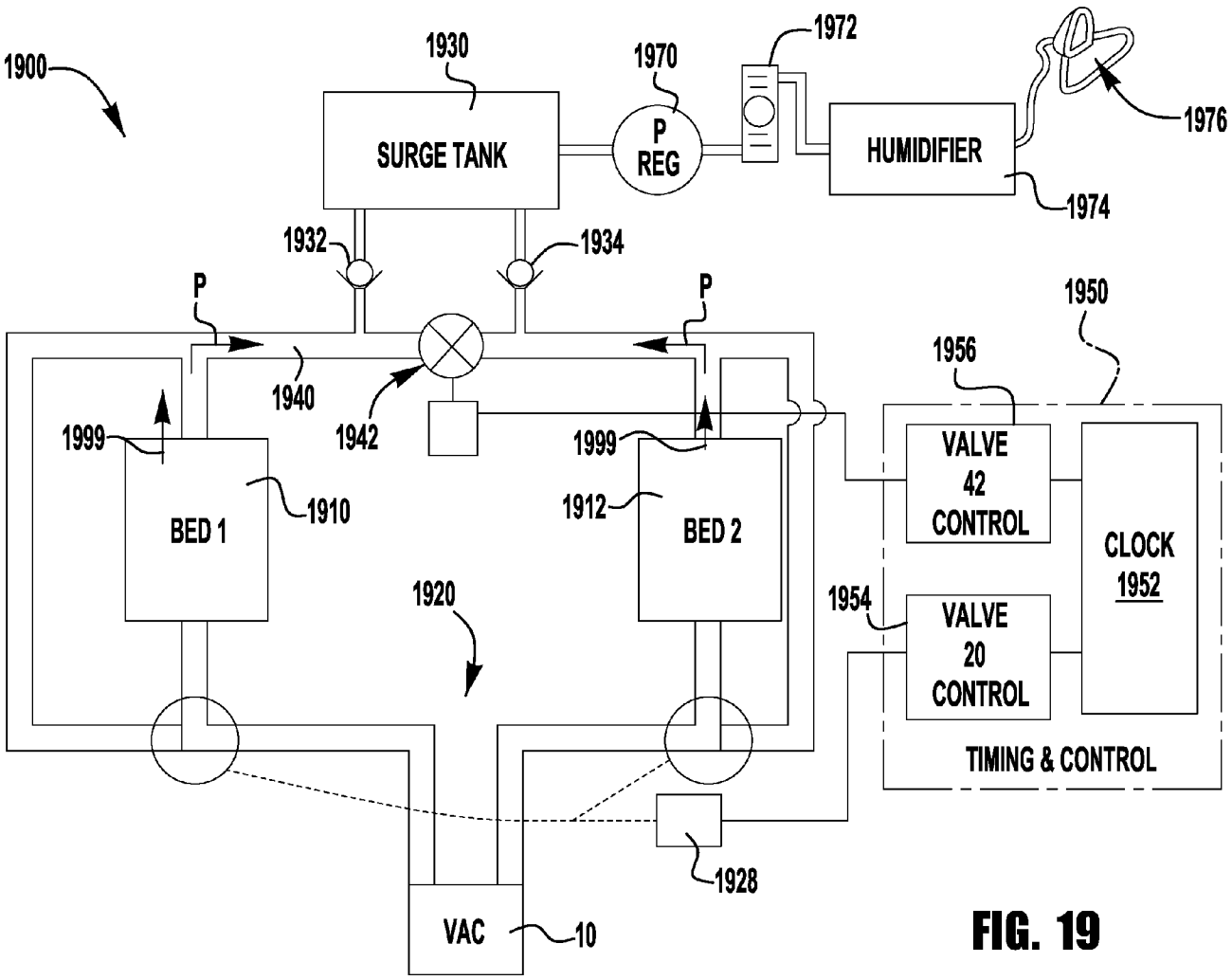
FIG. 19 is a schematic illustration of an exemplary embodiment of an oxygen concentrator.
Figure 20:
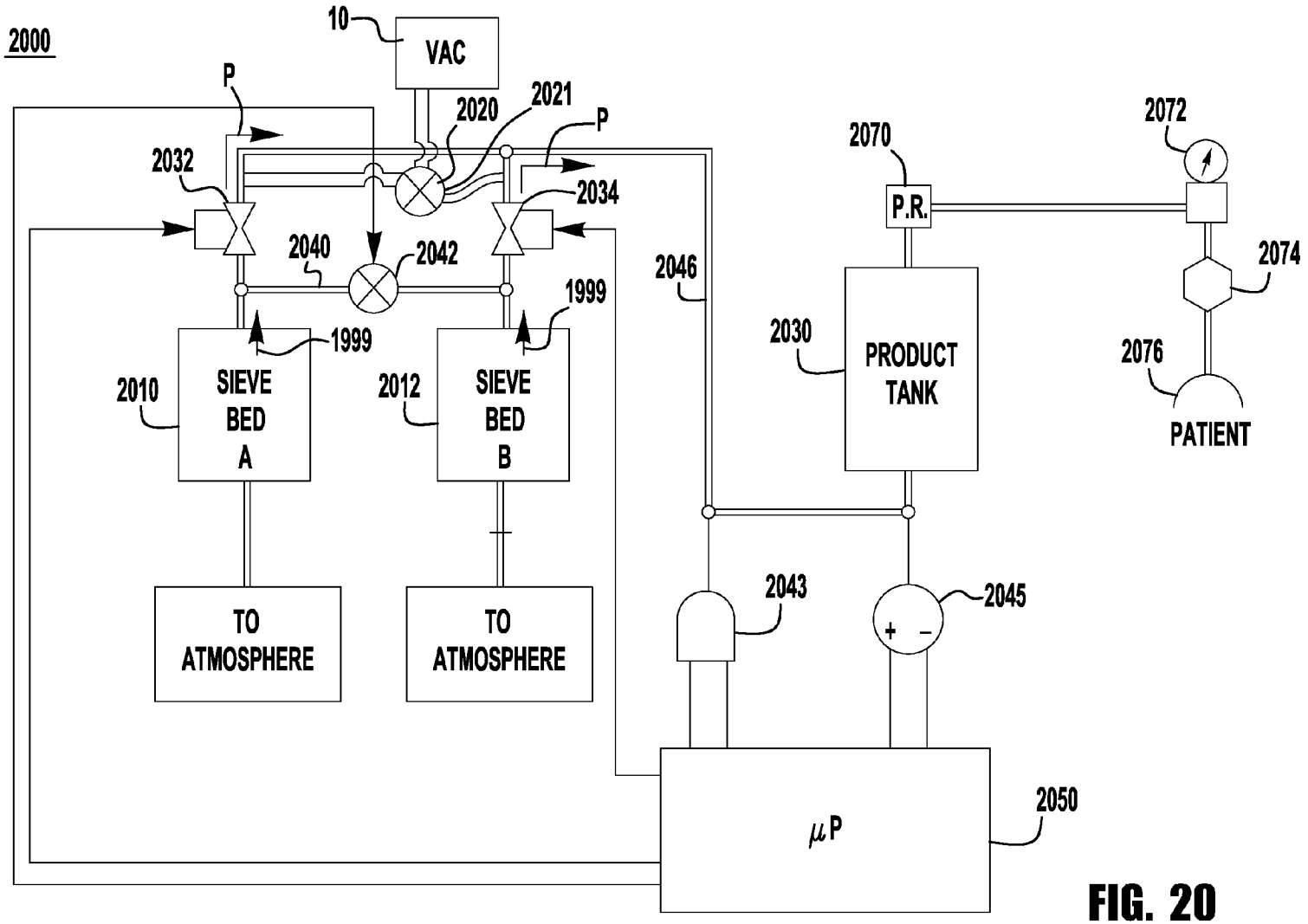
FIG. 20 is a schematic illustration of an exemplary embodiment of an oxygen concentrator.

FIGS. 19 and 20 illustrate exemplary embodiments of oxygen concentrators 1900, 2000. FIG. 19 corresponds to FIG. 1 of U.S. Pat. No. 4,449,990, except the pump, motor, and vacuum are replaced with a vacuum, such as a pump device 10 described by the present application provided with two vacuum ports. In FIG. 19, the reference characters from U.S. Pat. No. 4,449,990 are prefixed with "19" so the reference characters would not conflict with other reference characters of this application. The oxygen concentrator 1900 functions in much the same way as the oxygen concentrator described in U.S. Pat. No. 4,449,990, except the air is alternately drawn into the sieve beds 1910, 1912 by a vacuum 10 as indicated by arrows 1999 instead of being alternately forced into the sieve beds 1910, 1912 by a compressor. An optional assist pump or pumps (indicated by arrows P) may be provided at the exit of the sieve beds to convey oxygen enriched gas drawn through the sieve bed by the pump device 10 to the tank 1930. In one exemplary embodiment, the pump device 10 provides both a vacuum outlet and a compressed fluid outlet that are used by the oxygen concentrator. For example, the port 165 of the first head 110*a* may provide the vacuum indicated by arrows 1999 and the second head 110*b* may pump the concentrated oxygen as indicated by arrows P. In this example, the vacuum providing head 110*a* may be used in place of the vacuum shown in FIG. 1 of U.S. Pat. No. 4,449,990. Also in this example, the vacuum providing head 110*b* may be used in place of the pump shown in FIG. 1 of U.S. Pat. No. 4,449,990. A pump 10 with a head that provides a vacuum and a head that provides compressed fluid may be used in a wide variety of different oxygen concentrator arrangements.

FIG. 20 corresponds to FIG. 1 of U.S. Pat. No. 5,917,135, except the compressor is replaced with a vacuum, such as a pump device 10 of the present application. In FIG. 20, the reference characters from U.S. Pat. No. 5,917,135 are prefixed with "20" so the reference characters would not conflict with other reference characters of this application. The oxygen concentrator 2000 functions in much the same way as the oxygen concentrator described in U.S. Pat. No. 5,917,135, except the air is alternately drawn into the sieve beds 2010, 2012 by a vacuum 10 as indicated by arrows 1999 instead of being alternately forced into the sieve beds 2010, 2012 by a compressor. An optional assist pump or pumps (indicated by arrows P) may be provided to convey oxygen enriched gas drawn through the sieve bed by the pump device 10 to the tank 2030. In one exemplary embodiment, the pump device 10 provides both a vacuum outlet and a compressed fluid outlet that are used by the oxygen concentrator. For example, the port 165 of the first head 110*a* may provide the vacuum indicated by arrows 1999 and the second head 110*b* may pump the concentrated oxygen as indicated by arrows P. In this example, an inlet port may be added to each of the cylinders 14C, 14D that receives the concentrated oxygen that is pumped as indicated by arrows P.

The foregoing description relates to a four-cylinder compressor. However, the features described in this application are applicable to compressors that have different numbers of cylinders. In addition, disclosed features may be used in compressors having cylinder heads with different check valve designs.

Several exemplary embodiments of pumping devices and oxygen concentrators are disclosed by this application. Pumping devices and oxygen concentrators in accordance with the present invention may include any combination or subcombination of the features disclosed by the present application.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Still further, while cylindrical components have been shown and described herein, other geometries can be used including elliptical, polygonal (e.g., square, rectangular, triangular, hexagonal, etc.) and other shapes can also be used. Therefore, the invention, in its broader aspects, is not limited to the specific details, the representative apparatus, and illustrative examples shown and described. Accordingly, departures can be made from such details without departing from the spirit or scope of the applicant's general inventive concept.

The invention claimed is:

1. A pumping device for compressing gas and providing a vacuum, comprising:

a first head having a first head assembly configured as a vacuum;

first and second cylinders coupled to the first head;

a first check valve provided between the first head and the first cylinder, wherein the first check valve is configured to allow fluid to flow from the first head into the first cylinder and to prevent fluid from flowing from the first cylinder into the first head;

a second check valve provided between the first head and the second cylinder, wherein the second check valve is configured to allow fluid to flow from the first head into the second cylinder and to prevent fluid from flowing from the second cylinder into the first head;

first and second pistons disposed in the first and second cylinders;

a second head having a second head assembly configured as a compressor;

third and fourth cylinders coupled to the second head;

a third check valve provided between the second head and the third cylinder, wherein the third check valve is configured to allow fluid to flow from the third cylinder into the second head and to prevent fluid from flowing from the second head into the third cylinder;

a fourth check valve provided between the second head and the fourth cylinder, wherein the fourth check valve is configured to allow fluid to flow from the fourth cylinder into the second head and to prevent fluid from flowing from the second head into the fourth cylinder;

third and fourth pistons disposed in the third and fourth cylinders;

a crankshaft coupled to the first, second, third, and fourth pistons, such that rotation of the crankshaft reciprocates the first, second, third, and fourth pistons in the first, second, third, and fourth cylinders, such that a vacuum is provided at a first head port and compressed fluid is provided at a second head port;

a fifth check valve disposed on the first piston, wherein the fifth check valve is configured to allow fluid to flow out of the first cylinder through the first piston and to prevent fluid from flowing into the first cylinder through the first piston;

a sixth check valve disposed on the second piston, wherein the sixth check valve is configured to allow fluid to flow out of the second cylinder through the second piston and to prevent fluid from flowing into the second cylinder through the second piston;

a seventh check valve disposed on the third piston, wherein the seventh check valve is configured to allow fluid to flow into the third cylinder through the third piston and to prevent fluid from flowing out of third cylinder through the third piston; and an eighth check valve disposed on the fourth piston, wherein the eighth check valve is configured to allow fluid to flow into the fourth cylinder through the fourth piston and to prevent fluid from flowing out of the fourth cylinder through the fourth piston.

2. The pumping device of claim 1 wherein an angle formed between the axes of the first and second cylinders and the axes of the third and fourth cylinders is one-hundred-eighty degrees.

3. The pumping device of claim 1 wherein the first, second, third, and fourth pistons have the same diameter.

4. An oxygen concentrator comprising:

at least one sieve bed;

a pumping device in fluid communication with the at least one sieve bed, wherein the pumping device comprises:

a first head having a first head assembly configured as a vacuum;

first and second cylinders coupled to the first head;

a first check valve provided between the first head and the first cylinder, wherein the first check valve is configured to allow fluid to flow from the first head into the first cylinder and to prevent fluid from flowing from the first cylinder into the first head;

a second check valve provided between the first head and the second cylinder, wherein the second check valve is configured to allow fluid to flow from the first head into the second cylinder and to prevent fluid from flowing from the second cylinder into the first head;

first and second pistons disposed in the first and second cylinders;

a second head having a second head assembly configured as a compressor;

third and fourth cylinders coupled to the second head;

a third check valve provided between the second head and the third cylinder, wherein the third check valve is configured to allow fluid to flow from the third cylinder into the second head and to prevent fluid from flowing from the second head into the third cylinder;

a fourth check valve provided between the second head and the fourth cylinder, wherein the fourth check valve is configured to allow fluid to flow from the fourth cylinder into the second head and to prevent fluid from flowing from the second head into the fourth cylinder;

third and fourth pistons disposed in the third and fourth cylinders;

a crankshaft coupled to the first, second, third, and fourth pistons, such that rotation of the crankshaft reciprocates the first, second, third, and fourth pistons in the first, second, third, and fourth cylinders, such that a vacuum is provided at a first head port and compressed fluid is provided at a second head port;

a fifth check valve disposed on the first piston, wherein the fifth check valve is configured to allow fluid to flow out of the first cylinder through the first piston and to prevent fluid from flowing into the first cylinder through the first piston;

a sixth check valve disposed on the second piston, wherein the sixth check valve is configured to allow fluid to flow out of the second cylinder through the second piston and to prevent fluid from flowing into the second cylinder through the second piston a seventh check valve disposed on the third piston, wherein the seventh check valve is configured to allow fluid to flow into the third cylinder through the third piston and to prevent fluid from flowing out of third cylinder through the third piston; and an eighth check valve disposed on the fourth piston, wherein the eighth check valve is configured to allow fluid to flow into the fourth cylinder through the fourth piston and to prevent fluid from flowing out of the fourth cylinder through the fourth piston.

5. The pumping device of claim 4 wherein an angle formed between the axes of the first and second cylinders and the axes of the third and fourth cylinders is one-hundred-eighty degrees.

6. The pumping device of claim 4 wherein the crankshaft is configured to be driven at over eight-thousand revolutions per minute.

7. The pumping device of claim 1 wherein an angle formed between the axes of the first and second cylinders and the axes of the third and fourth cylinders is between 90 and 180 degrees.

* * * * *